US008942592B2

(12) United States Patent
Uratani et al.

(10) Patent No.: US 8,942,592 B2
(45) Date of Patent: Jan. 27, 2015

(54) PROCESS CARTRIDGE, PHOTOSENSITIVE DRUM UNIT, DEVELOPING UNIT AND ELECTROPHOTOGRAPHIC IMAGE FORMING APPARATUS

(75) Inventors: Shunsuke Uratani, Mishima (JP); Noriyuki Komatsu, Numazu (JP); Toru Oguma, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 190 days.

(21) Appl. No.: 13/514,434

(22) PCT Filed: Dec. 16, 2010

(86) PCT No.: PCT/JP2010/073264

§ 371 (c)(1),
(2), (4) Date: Jun. 7, 2012

(87) PCT Pub. No.: WO2011/074707

PCT Pub. Date: Jun. 23, 2011

(65) Prior Publication Data

US 2012/0243905 A1 Sep. 27, 2012

(30) Foreign Application Priority Data

Dec. 16, 2009 (JP) ..... 2009-285750

(51) Int. Cl.
*G03G 21/18* (2006.01)

(52) U.S. Cl.
CPC ..... *G03G 21/186* (2013.01); *G03G 21/1853* (2013.01)
USPC ..... 399/111; 399/117

(58) Field of Classification Search
USPC ..... 399/111, 117
See application file for complete search history.

(56) References Cited

U.S. PATENT DOCUMENTS 5,455,665 A 10/1995 Baba et al.
5,768,658 A 6/1998 Watanabe et al.

(Continued)

FOREIGN PATENT DOCUMENTS

JP 2007-128113 5/2007
JP 2007128113 A * 5/2007

(Continued)

OTHER PUBLICATIONS

Communication in Taiwanse Patent Application No. 099144237, mailed Sep. 10, 2013.

(Continued)

*Primary Examiner* — David Gray
*Assistant Examiner* — Michael Harrison
(74) *Attorney, Agent, or Firm* — Fitzpatrick, Cella, Harper & Scinto

(57) ABSTRACT

A process cartridge usable with an electrophotographic image forming apparatus, a main assembly of which is not provided with a mechanism for moving a main assembly side engaging portion provided in the main assembly to transmit a rotational force to an image bearing member in the direction of the rotational axis of the image bearing member by an opening and closing operation of a cover member for the main assembly. The process cartridge can be mounted to the main assembly in a direction substantially perpendicular to the rotational axis of the image bearing member without deterioration of the usability performance. With the process cartridge, the electrophotographic image forming apparatus can be downsized. in accordance with the movement of the process cartridge when the process cartridge is dismounted from the main assembly of the electrophotographic image forming apparatus, a coupling member which is inclinable and translatable relative to a rotational axis of a rotational force transmitted member enters an inside of the recess of the main assembly side engaging portion to receive the rotational force from the main assembly engaging portion.

16 Claims, 77 Drawing Sheets

(56) References Cited

U.S. PATENT DOCUMENTS

| | | | |
|---|---|---|---|
| 5,790,923 | A | 8/1998 | Oguma et al. |
| 5,812,909 | A | 9/1998 | Oguma et al. |
| 6,097,909 | A | 8/2000 | Watanabe et al. |
| 6,128,454 | A | 10/2000 | Kawai et al. |
| 6,144,821 | A | 11/2000 | Oguma |
| 6,173,130 | B1 | 1/2001 | Oguma |
| 6,266,500 | B1 | 7/2001 | Numagami et al. |
| 6,272,299 | B1 | 8/2001 | Numagami et al. |
| 6,377,759 | B1 | 4/2002 | Abe et al. |
| 6,512,895 | B2 | 1/2003 | Sakurai et al. |
| 6,571,070 | B2 | 5/2003 | Oguma et al. |
| 6,587,650 | B2 | 7/2003 | Yokoi et al. |
| 6,594,454 | B2 | 7/2003 | Oguma et al. |
| 6,625,413 | B2 | 9/2003 | Oguma et al. |
| 6,658,224 | B2 | 12/2003 | Yokoi et al. |
| 6,671,477 | B2 | 12/2003 | Komatsu et al. |
| 6,684,040 | B2 | 1/2004 | Yokoi et al. |
| 6,704,525 | B2 | 3/2004 | Oguma et al. |
| 6,735,405 | B2 | 5/2004 | Yokoi et al. |
| 6,804,475 | B2 | 10/2004 | Oguma et al. |
| 6,804,476 | B2 | 10/2004 | Yokoi et al. |
| 6,804,483 | B2 | 10/2004 | Yokoi et al. |
| 6,832,057 | B2 | 12/2004 | Oguma et al. |
| 6,859,627 | B2 | 2/2005 | Karakama et al. |
| 6,868,243 | B2 | 3/2005 | Watanabe et al. |
| 6,892,035 | B2 | 5/2005 | Matsumoto et al. |
| 6,952,544 | B2 | 10/2005 | Kikuchi et al. |
| 6,993,264 | B2 | 1/2006 | Oguma et al. |
| 7,024,131 | B2 | 4/2006 | Komatsu et al. |
| 7,062,192 | B2 | 6/2006 | Oguma et al. |
| 7,073,251 | B2 | 7/2006 | Kikuchi et al. |
| 7,095,967 | B2 | 8/2006 | Karakama et al. |
| 7,110,703 | B2 | 9/2006 | Uratani et al. |
| 7,156,797 | B2 | 1/2007 | Komatsu et al. |
| 7,162,176 | B2 | 1/2007 | Oguma et al. |
| 7,239,823 | B2 | 7/2007 | Oguma et al. |
| 7,266,326 | B2 | 9/2007 | Karakama et al. |
| 7,283,765 | B2 | 10/2007 | Uratani et al. |
| 7,296,341 | B2 | 11/2007 | Kikuchi et al. |
| 7,315,706 | B2 | 1/2008 | Oguma et al. |
| 7,865,115 | B2 | 1/2011 | Oguma et al. |
| 8,208,830 | B2 | 6/2012 | Uratani et al. |
| 8,437,669 | B2 | 5/2013 | Morioka et al. |
| 2007/0160388 | A1* | 7/2007 | Yoshimura et al. ..... 399/111 |
| 2008/0152388 | A1* | 6/2008 | Ueno et al. ..... 399/167 |
| 2008/0240796 | A1 | 10/2008 | Morioka et al. |
| 2010/0189462 | A1 | 7/2010 | Kawashima et al. |
| 2010/0278559 | A1 | 11/2010 | Komatsu et al. |
| 2011/0091239 | A1 | 4/2011 | Ueno et al. |
| 2011/0268471 | A1 | 11/2011 | Miyazaki et al. |
| 2012/0269540 | A1 | 10/2012 | Kawai et al. |

FOREIGN PATENT DOCUMENTS

| | | |
|---|---|---|
| JP | 2008-233867 | 10/2008 |
| JP | 2008-268927 | 11/2008 |
| JP | 2009-134284 | 6/2009 |
| TW | 420784 | 2/2001 |
| TW | 200424813 | 11/2004 |
| TW | 200632598 | 9/2006 |
| TW | 200905423 | 2/2009 |

OTHER PUBLICATIONS

International Search Report in International Application No. PCT/JP2010/073254, dated Apr. 5, 2011.

* cited by examiner (a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(a)

(b)

(c)

(a)

(b)

(a)

(b)

(a)

(b)

(c)

(a)

(b)

(a)

(b)

(c)

(a)

(b)

(c)

(a)

(b)

(a)

(b)

(a)

(b)

(c)

(a)

(b)

(c)

(a)

(b)

(c)

(a)

(b)

(a)

(b)

(c)

(a)

(b)

PROCESS CARTRIDGE, PHOTOSENSITIVE DRUM UNIT, DEVELOPING UNIT AND ELECTROPHOTOGRAPHIC IMAGE FORMING APPARATUS

FIELD OF THE INVENTION

The present invention relates to a process cartridge, a photosensitive drum unit, a developing unit and an electrophotographic image forming apparatus to which the process cartridge, the photosensitive drum unit and/or the developing unit is demountably mountable.

The electrophotographic image forming apparatus is an electrophotographic copying machine, an electrophotographic printer (a laser beam printer, a LED printer or the like) or the like.

The process cartridge is a unit in which an image bearing member (photosensitive member) and at least one of process means actable on the image bearing member are unified into a cartridge which is detachably mountable to a main assembly of the electrophotographic image forming apparatus. Here, the process means is developing means, charging means and/or cleaning means, for example. An example of the process cartridge may contain the image bearing member and charging means as the process means which are unified into a cartridge. Another example of the process cartridge may contain the image bearing member, and charging means and cleaning means as the process means which are unified into a cartridge. A further example of the process cartridge may contain the image bearing member, developing means, charging means and cleaning means as the process means which are unified into a cartridge.

Here, the process cartridge, the photosensitive drum unit and/or the developing unit can be mounted and demounted relative to a main assembly of the electrophotographic image forming apparatus by the user. Therefore, maintenance operation of the apparatus can be carried out in effect by the user without relying on a service person. This improves the maintenance operation of the electrophotographic image forming apparatus.

BACKGROUND ART

A structure of the process cartridge is known in which it is demountable, in a predetermined direction substantially perpendicular to a rotational axis of the image bearing member or the like, from the main assembly of the apparatus which is not provided with a mechanism for moving a main assembly side engaging portion (main assembly side coupling member) provided in the main assembly of the electrophotographic image forming apparatus to transmit a rotational force to a rotatable member such as the image bearing member, in the rotational axis direction, in interrelation with an opening and closing operation of a main assembly cover of the main assembly of the apparatus. In the structure, the coupling member of the process cartridge is engaged with the main assembly side engaging portion.

In such a coupling type (rotational force transmission means), it is known that the coupling member provided in the process cartridge is movable in the rotational axis direction, by which an engaging operation and a disengaging operation of the coupling member by a mounting and demounting operation of the process cartridge to the main assembly of the apparatus is made possible (Japanese Laid-open Patent Application No. 2009-134284).

It is also known that the coupling member provided on the process cartridge is made movable in the rotational axis direction, and is inclinable relative to the rotational axis, by which the engaging operation and the disengaging operation of the coupling member in interrelation with the mounting and demounting operation of the process cartridge relative to the main assembly of the apparatus is enabled (Japanese Patent 4498407).

DISCLOSURE OF THE INVENTION

However, with the conventional structure disclosed in Japanese Laid-open Patent Application No. 2009-134284, in a dismounting operation the process cartridge is taken out of the main assembly of the apparatus, at least one of the main assembly side engaging portion provided in the main assembly of the apparatus and the rotatable member provided in the process cartridge is rotated significantly, as the case may be. If this occurs, a large load may be required for dismounting of the process cartridge with the result of deterioration the usability performance.

With the conventional structure disclosed in FIG. 87 of Japanese patent 4498407, the coupling member has a recessed configuration expanding toward the main assembly side engaging portion so as to be over the main assembly side engaging portion. At this time, an outer diameter of the recessed configuration of the coupling member is larger than an inner diameter of a rotational force transmitted member for transmitting the rotational force to the image bearing member from the coupling member, and therefore, it is difficult to accommodate the coupling member completely in the rotational force receiving member with the result of difficulty in downsizing the apparatus.

The present invention further develops the above-described prior-art technique, and provides a process cartridge, a photosensitive drum unit and developing unit which can be demounted from said main assembly of the apparatus in a predetermined direction substantially perpendicular to the rotational axis the image bearing member, which can be demounted from the main assembly of the apparatus without deterioration of the usability performance and with which the apparatus can be downsized, wherein the main assembly of the apparatus is not provided with a mechanism for moving the main assembly side engaging portion provided on the main assembly of the electrophotographic image forming apparatus to transmit a rotational force to the image bearing member, in interrelation with opening and closing operations of the main assembly cover of said main assembly of the apparatus. The present invention also provides an electrophotographic image forming apparatus to which the process cartridge, the photosensitive drum unit, and/or the developing unit is detachably mountable.

According to the present invention, there is provided a process cartridge detachably mountable to a main assembly of an electrophotographic image forming apparatus, wherein said main assembly includes a rotatable main assembly side engaging portion having a recess and a rotational force applying portion provided in the recess, said process cartridge comprising:

a photosensitive drum having a rotational axis substantially perpendicular to a mounting and demounting direction of said process cartridge;

process means actable on said photosensitive drum;

a cylindrical rotational force transmitted member for receiving a rotational force for rotating said photosensitive drum; and a coupling member held inside said rotational force transmitted member and including a rotational force receiving portion for receiving the rotational force from the rotational force applying portion, and a rotational force transmitting portion for transmitting the rotational force to said rotational force transmitted member, wherein said coupling member enters the recess in a state that process cartridge is mounted to the main assembly of the apparatus, and said coupling member is inclinable and translatable relative to a rotational axis of said rotational force transmitted member to disengage from the main assembly side engaging portion when said process cartridge is dismounted at said main assembly of the apparatus.

According to the present invention, there is provided a photosensitive drum unit detachably mountable to a main assembly of the electrophotographic image forming apparatus, wherein said main assembly includes a rotatable main assembly side engaging portion having a recess and a rotational force applying portion provided in the recess, said photosensitive drum unit comprising:

a photosensitive drum having a rotational axis substantially perpendicular to a mounting and demounting direction of said photosensitive drum unit;

a cylindrical rotational force transmitted member for receiving a rotational force for rotating said photosensitive drum; and a coupling member held inside said rotational force transmitted member and including a rotational force receiving portion for receiving the rotational force from the rotational force applying portion, and a rotational force transmitting portion for transmitting the rotational force to said rotational force transmitted member, wherein said coupling member enters the recess in a state that photosensitive drum unit is mounted to the main assembly of the apparatus, and said coupling member is inclinable and translatable relative to a rotational axis of said rotational force transmitted member to disengage from the main assembly side engaging portion when said photosensitive drum unit is dismounted at said main assembly of the apparatus.

According to the present invention, there is provided a developing unit detachably mountable to a main assembly of the electrophotographic image forming apparatus, wherein said main assembly includes a rotatable main assembly side engaging portion having a recess and a rotational force applying portion provided in the recess, said process cartridge comprising:

a developing roller having a rotational axis substantially perpendicular to a mounting and demounting direction of said developing unit;

a cylindrical rotational force transmitted member for receiving a rotational force for rotating said developing roller; and a coupling member held inside said rotational force transmitted member and including a rotational force receiving portion for receiving the rotational force from the rotational force applying portion, and a rotational force transmitting portion for transmitting the rotational force to said rotational force transmitted member, wherein said coupling member enters the recess in a state that developing unit is mounted to the main assembly of the apparatus, and said coupling member is inclinable and translatable relative to a rotational axis of said rotational force transmitted member to disengage from the main assembly side engaging portion when said developing unit is dismounted at said main assembly of the apparatus.

According to the present invention, there is provided an electrophotographic image forming apparatus comprising:

a main assembly of an electrophotographic image forming apparatus, wherein said main assembly includes a rotatable main assembly side engaging portion having a recess and a rotational force applying portion provided in the recess;

a process cartridge including, a photosensitive drum having a rotational axis substantially perpendicular to a mounting and demounting direction of said developing unit;

process means actable on said photosensitive drum;

a cylindrical rotational force transmitted member for receiving a rotational force for rotating said photosensitive drum; and a coupling member held inside said rotational force transmitted member and including a rotational force receiving portion for receiving the rotational force from the rotational force applying portion, and a rotational force transmitting portion for transmitting the rotational force to said rotational force transmitted member, wherein said coupling member enters the recess in a state that developing unit is mounted to the main assembly of the apparatus, and said coupling member is inclinable and translatable relative to a rotational axis of said rotational force transmitted member to disengage from the main assembly side engaging portion when said developing unit is dismounted at said main assembly of the apparatus.

These and other objects, features and advantages of the present invention will become more apparent upon a consideration of the following description of the preferred embodiments of the present invention taken in conjunction with the accompanying drawings.

EMBODIMENT FOR CARRYING OUT THE INVENTION

Figure 1:
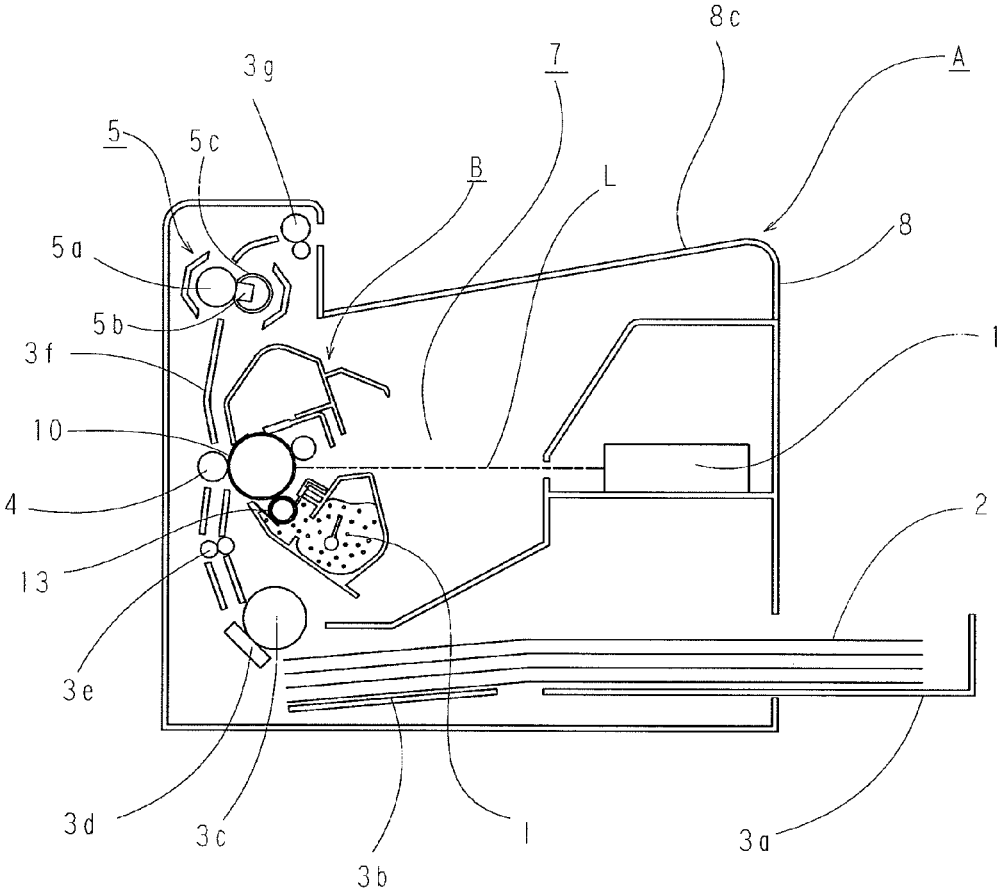
FIG. 1 is a side schematic sectional view of an electrophotographic image forming apparatus according to an embodiment of the present invention.

Referring to the accompanying drawings, a cartridge and an electrophotographic image forming apparatus according to the present invention will be described. In the following, a laser beam printer is taken as an example of the electrophotographic image forming apparatus, and a process cartridge for use with the laser beam printer is taken as an example of the cartridge. In the following description, a widthwise direction of the process cartridge is a direction in which the process cartridge is mounted and demounted to a main assembly of the electrophotographic image forming apparatus are is the same as a feeding direction of a recording material. In addition, a longitudinal direction of the process cartridge is a direction substantially perpendicular to the direction in which the process cartridge is mounted and demounted relative to the main assembly of the electrophotographic image forming apparatus, and is parallel with a rotational axis of an image bearing member. In addition, reference numerals in the description are for reference to the drawing and are not intended to limit the structures.

(Embodiment 1)

Figure 2:
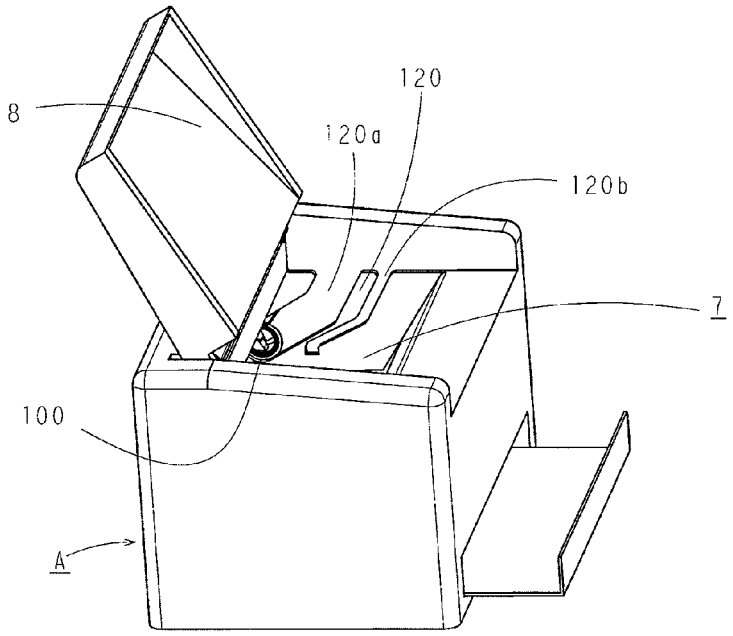
FIG. 2 is a schematic perspective view of a main assembly of the electrophotographic image forming apparatus according to one embodiment of the present invention.
Figure 2:
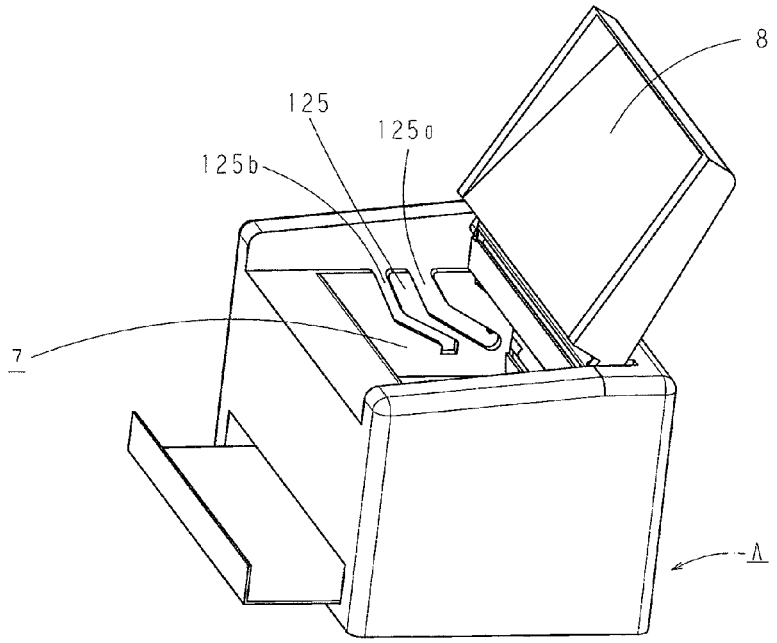
Figure 3:
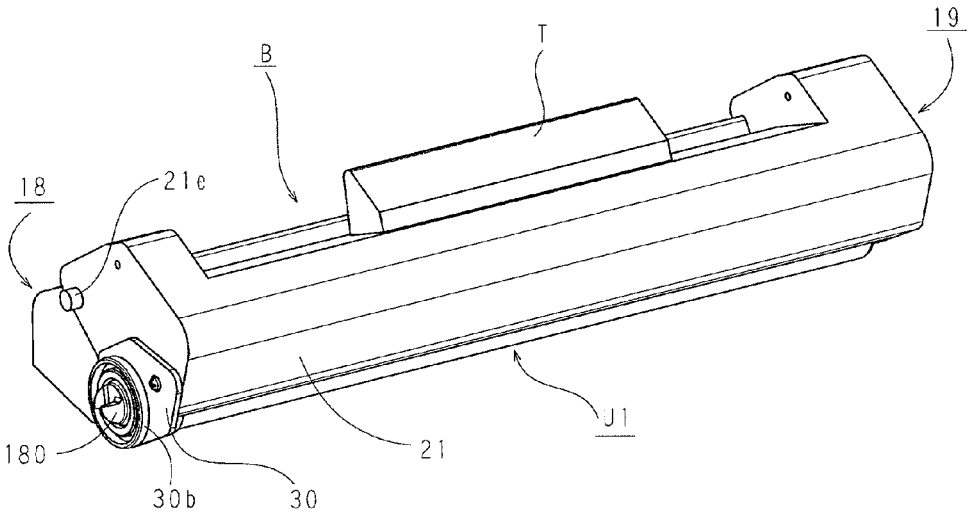
FIG. 3 is a schematic perspective view of a process cartridge according to one embodiment of the present invention.
Figure 3:
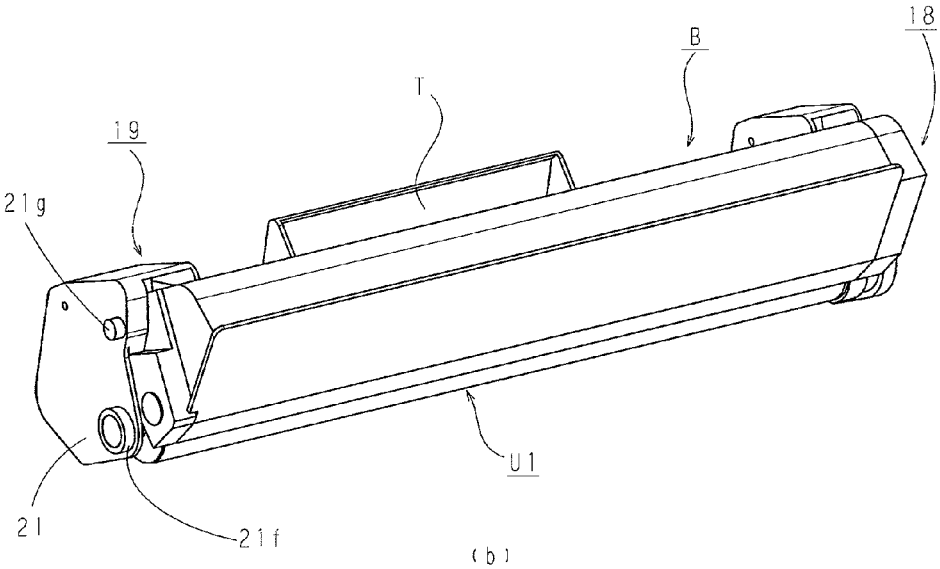
Figure 4:
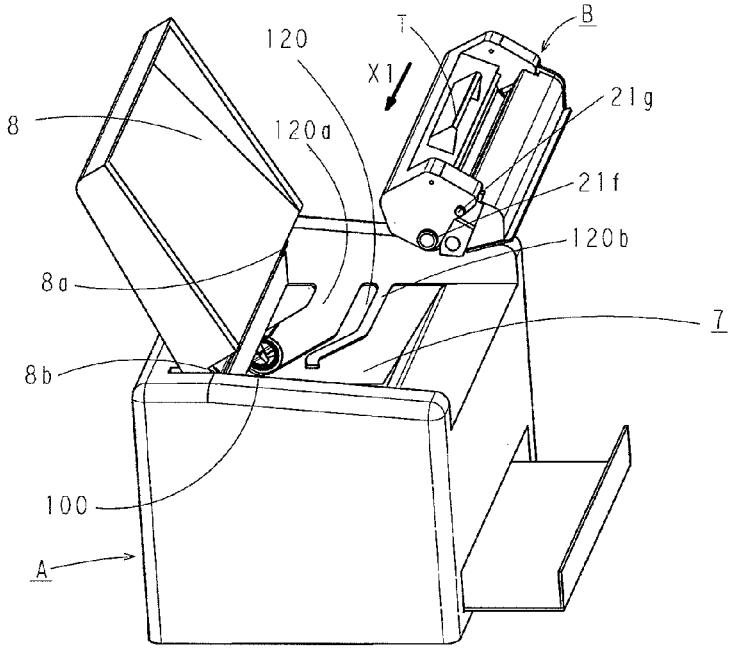
FIG. 4 is a schematic perspective view showing an operation of mounting a process cartridge to a main assembly of the electrophotographic image forming apparatus, according to one embodiment of the present invention.
Figure 4:
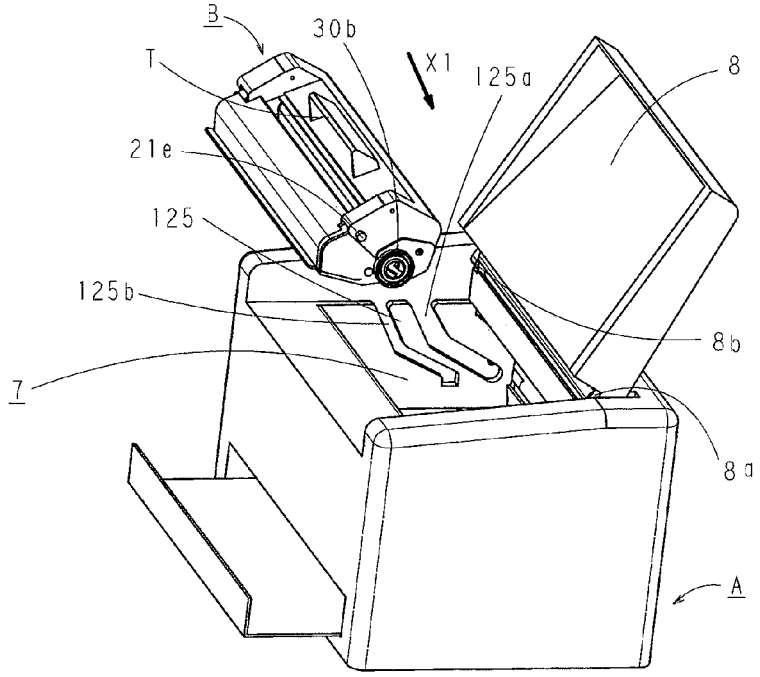

(1) Description of the Electrophotographic Image Forming Apparatus:

Referring to FIG. 1 to FIG. 4, the electrophotographic image forming apparatus with which is process cartridge according to an embodiment of the present invention will be described. In the following description, the main assembly of the electrophotographic image forming apparatus (main assembly A of the apparatus) is a portion of the electrophotographic image forming apparatus except for the process cartridge (cartridge B). Here, the cartridge B is detachably mountable to the main assembly of the apparatus A. FIG. 1 is a schematic sectional view of the electrophotographic image forming apparatus side. FIG. 2 is a schematic perspective view of the main assembly A of the apparatus. FIG. 3 is a schematic perspective view of the cartridge B. FIG. 4 is a schematic perspective view illustrating a mounting operation of the cartridge B to the main assembly of the apparatus.

As shown in FIG. 1, the main assembly A of the apparatus projects a laser beam in accordance with image information from optical means 1 to a surface of the electrophotographic photosensitive member 10 (photosensitive drum 10) in the form of a drum configuration which is image bearing member (rotatable member). By doing so, an electrostatic latent image is formed on the photosensitive drum 10 in accordance with the image information. The electrostatic latent image is developed with a developer t by a developing roller 13 which will be described hereinafter. As a result, a developed image is formed on the photosensitive drum 10.

In synchronism with the formation the developed image, a lift-up plate 3*b* provided at a free end of a sheet feeding tray 3*a* accommodating recording materials 2 is raised, and one of the recording materials 2 is fed by sheet feeding rollers 3*c*, a separation pad 3*d* and registration rollers 3*e* and so on.

In an image transfer position, there is provided a transfer roller 4 as transferring means. And, the transfer roller 4 is supplied with a voltage of a polarity opposite to that of the developed image. By doing so, the developed image formed on the surface of the photosensitive drum 10 is transferred onto the recording material 2. Here, the recording material 2 is a material on which the image of the developer is formed, and is recording paper, label, OHP sheet, for example.

The recording material 2 having the transferred developed image is fed to a fixing means 5 by way of a feeding guide 3*f*. Fixing means 5 is provided with a driving roller 5*a* and a fixing roller 5*c* containing therein a heater 5*b*. The fixing means 5 applies heat and pressure to the passing recording material 2 to fix the developed image transferred onto the recording material 2 on the recording material 2. In this manner, the image is formed on the recording material 2.

Thereafter, the recording material 2 is fed by discharging rollers and is discharged to a discharging portion 8*c* of a main assembly cover 8. The sheet feeding roller 3*c*, the separation pad 3*d*, the registration rollers 3*e*, the feeding guide 3*f*, the discharging rollers 3 *g* and so on structures a feeding means for the recording material 2.

Referring to FIG. 2 to FIG. 4, the description will be made as to mounting and dismounting of the cartridge B relative to the main assembly A of the apparatus. In the following description, the side where a rotational force is transmitted from the main assembly A of the apparatus to the photosensitive drum 10 is called "driving side". The side opposite the driving side with respect to a rotational axis direction of the photosensitive drum 10 is called "non-driving side".

As shown in FIG. 2, the main assembly A of the apparatus is provided with a setting portion 7 which is a space for setting the cartridge B. In a state that the cartridge B is set in the space, a coupling member 180 of the cartridge B engages (connects) with a main assembly side engaging portion 100 of the main assembly A of the apparatus. The rotational force is transmitted from the main assembly side engaging portion 100 to the photosensitive drum 10 through the coupling member 180 or the like, as will be described hereinafter. In the state that the cartridge B is positioned in the setting portion 7, engaging portion 100 and the photosensitive drum 10 are such that the rotational axis of the engaging portion 100 and the rotational axis of the photosensitive drum 10 are substantially co-axial (on the common line).

As shown in part (a) of FIG. 2, the driving side of the main assembly A of the apparatus is provided with the main assembly side engaging portion 100 and a driving side guiding member 120. The driving side guide portion 120 is provided with a first guide portion 120*a* and a second guide portion 120*b* disposed along the mounting and demounting direction of the cartridge B. As shown in part (b) of FIG. 2, the non-driving side of the main assembly A of the apparatus is provided with a non-driving side guiding member 125. The non-driving side guide portion 125 is provided with a first guide portion 125*a* and a second guide portion 125*b* disposed along the mounting and demounting direction of the cartridge B. The driving side guiding member 120 and the non-driving side guiding member 125 are provided inside the main assembly A of the apparatus so as to be opposed to each other with the setting portion 7 interposed therebetween.

On the other hand, as shown in part (a) FIG. 3, the driving side of the cartridge B is provided with a drum bearing 30 for rotatably supporting a photosensitive drum unit U1. The drum bearing 30 is provided with a driving side portion-to-be-supported 30*b*. In addition, at the driving side of the cartridge B, the cleaning frame 21 is provided with a driving side rotation preventing portion 21*e*. As shown in part (b) of FIG. 3, at the non-driving side of the cartridge B, the cleaning frame 21 is provided with a non-driving side portion-to-be-supported 21*f* and a non-driving side guide portion 21*g*.

Referring to FIG. 4, the mounting of the cartridge B to the main assembly A of the apparatus will be described. The main assembly cover 8 is capable of opening and closing relative to the main assembly A of the apparatus, and is opened by rotating upwardly about hinge portions 8*a*, 8*b*. By doing so, the setting portion 7 in the main assembly A of the apparatus is exposed. And, the cartridge B is moved in the direction (direction of an arrow X1 in FIG. 4) substantially perpendicular to the rotational axis of the photosensitive drum 10 in the cartridge B to be mounted to the main assembly A of the apparatus (setting portion 7). In the mounting process, at the driving side of the cartridge B, the driving side portion-to-be-supported 30*b* and the driving side rotation preventing portion 21*e* are guided by the first guide portion 120*a* and the second guide portion 120*b* of the driving side guide portion 120, respectively. Similarly, at the non-driving side of the cartridge B, the non-driving side portion-to-be-supported 21*f* and the non-driving side guide portion 21 *g* are guided by the first guide portion 125*a* and the second guide portion 125*b* of the non-driving side guide portion 125, respectively. As a result, the cartridge B is placed in the setting portion 7. Thereafter, the main assembly cover 8 is closed by downward rotation, by which the mounting of the cartridge B to the main assembly A of the apparatus. When the cartridge B is dismounted from the main assembly A of the apparatus, the main assembly cover 8 is opened, and a dismounting operation is carries out. These operations are carries out by the user, that is, the user grips a grip T of the cartridge B and moves the cartridge B.

In this embodiment, setting the cartridge B in the setting portion 7 is called "mounting the cartridge B to the main assembly A of the apparatus". In addition, dismounting the cartridge B from the setting portion 7 is called "dismounting the cartridge B from the main assembly A of the apparatus". Furthermore, the position of the cartridge B disposed to the setting portion 7 relative to the main assembly A of the apparatus is called "mounting completed position".

In the foregoing description, the mounting type for the cartridge B is a manual type in which the user inserts the cartridge B to the setting portion 7, but this is not inevitable. For example, in another type, the user inserts the cartridge B manually half way, and the final mounting operation may be carries out by another means. More particularly, using the operation of closing the main assembly cover 8, the cartridge B placed half way may pushed into the setting portion 7. Or, the user pushes the cartridge B half way, and the cartridge B may be let fall into the setting portion 7 by the weight thereof.

Here, "substantially perpendicular" will be described.

A slight gap is provided between the cartridge B and the main assembly A of the apparatus, for the purpose of smooth mounting and demounting of the cartridge B. Therefore, when the cartridge B is mounted to the main assembly A of the apparatus, and when it is dismounted, the cartridge B as a whole may become slightly oblique within the limit of the gap. Therefore, the mounting and/or the dismounting may not be in the perpendicular direction, strictly. However, even in such a case, the present invention applies, and therefore, the slightly oblique direction of the cartridge is covered by "substantially perpendicular".

Figure 5:
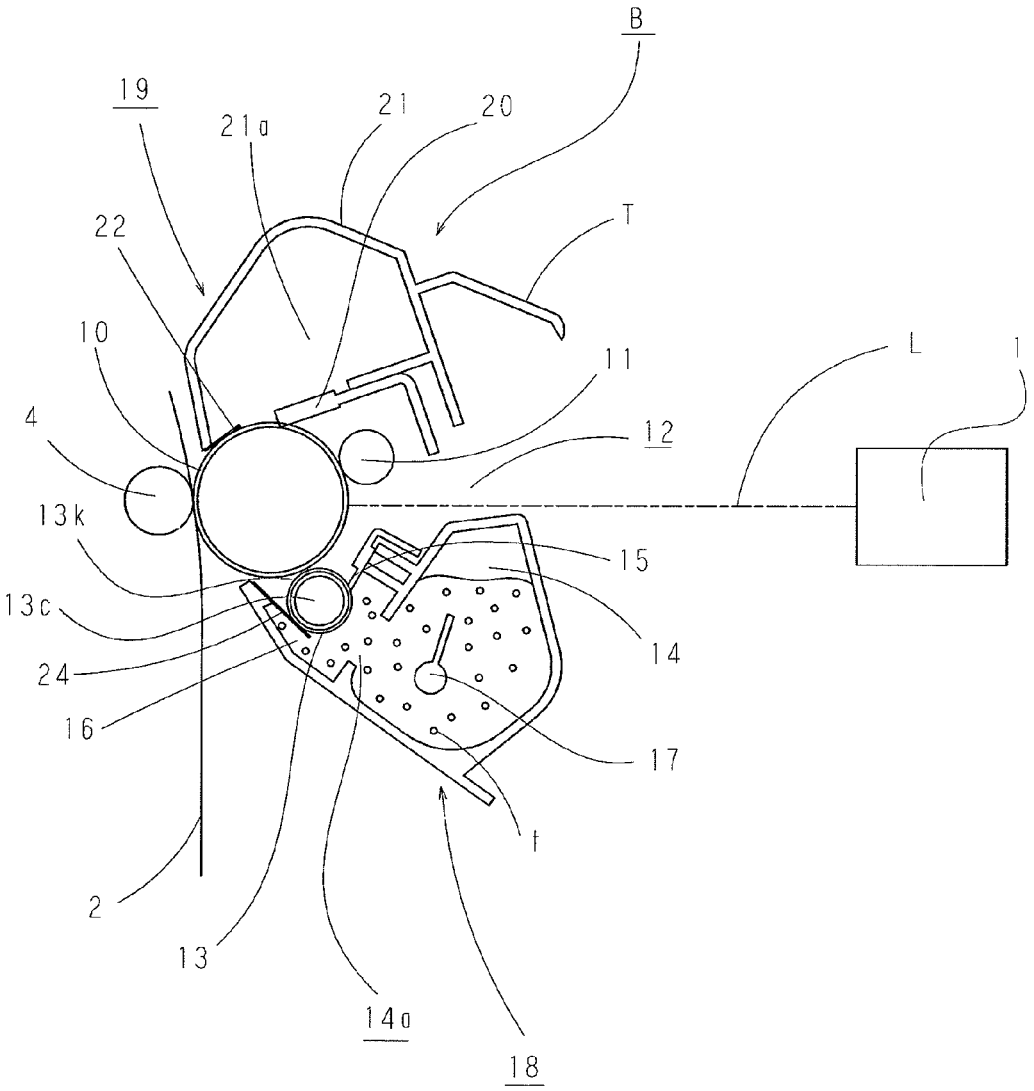
FIG. 5 is a sectional side elevation of a process cartridge according to an embodiment of the present invention.
Figure 6:
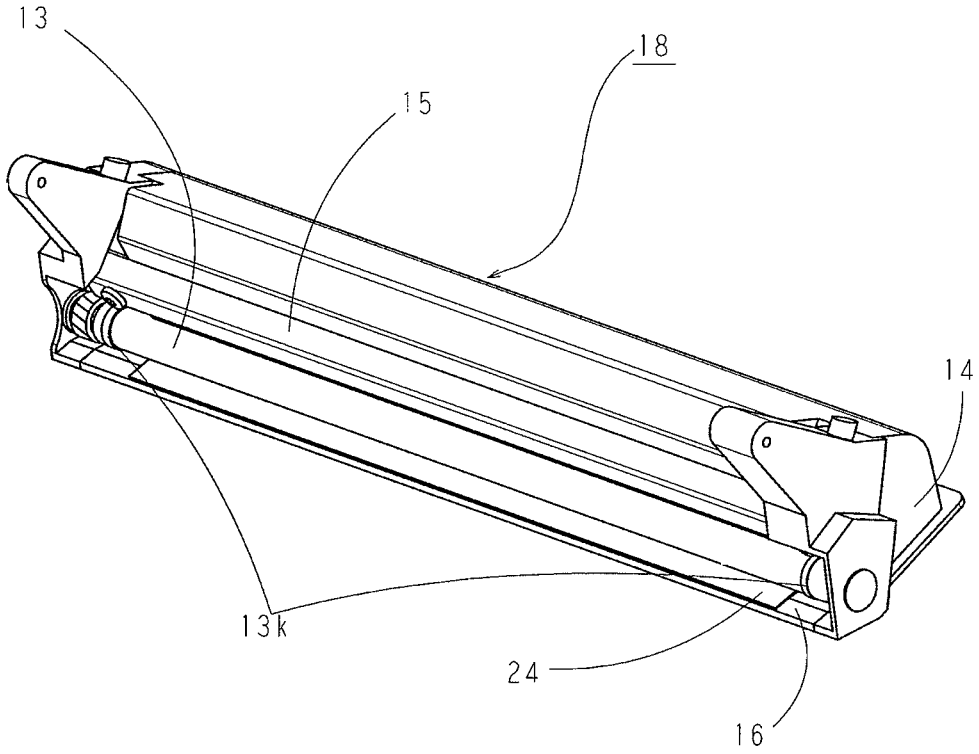
FIG. 6 is a schematic perspective view of a first frame unit according to one embodiment of the present invention.
Figure 7:
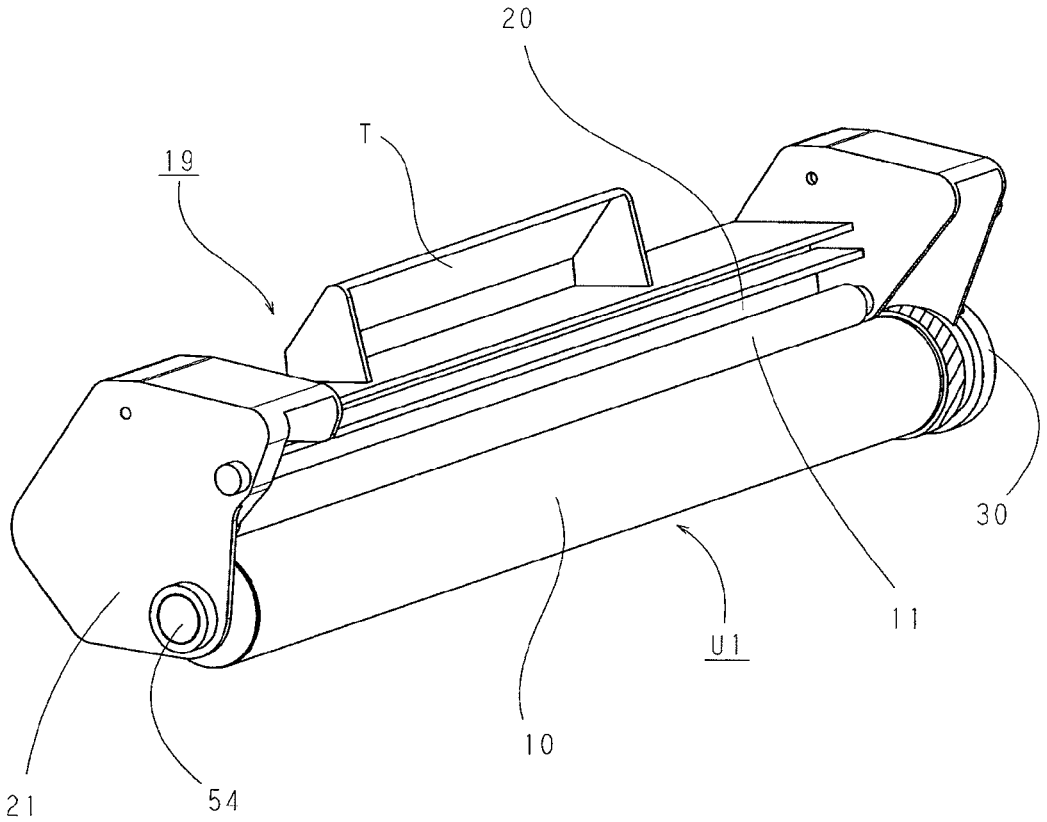
FIG. 7 is a schematic perspective view of a second frame unit according to one embodiment of the present invention.
Figure 8:
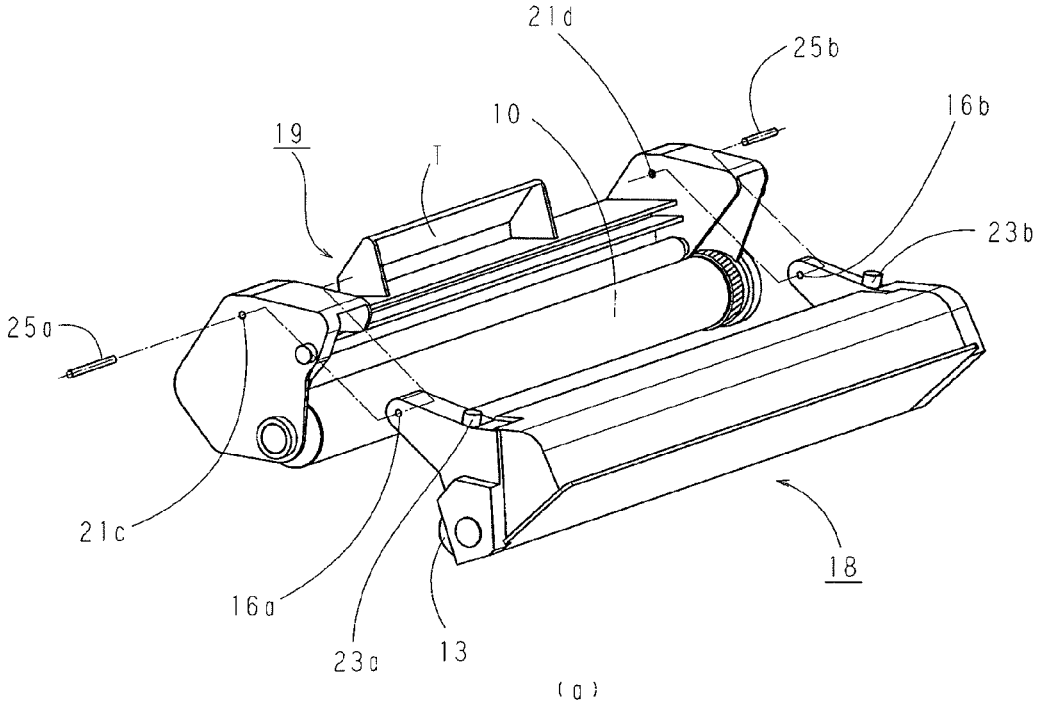
FIG. 8 is an illustration of coupling between the first frame unit and the second frame unit according to one embodiment of the present invention.
Figure 8:
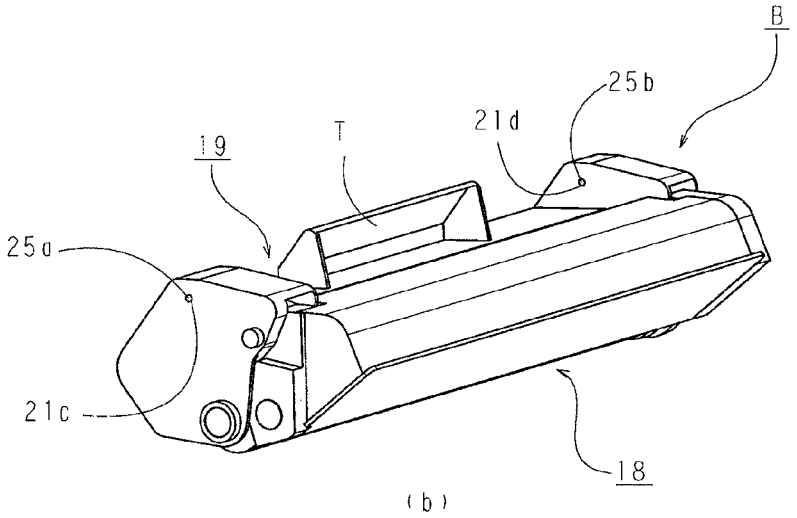

(2) General Description of Process Cartridge:

Referring to FIG. 5 to FIG. 8, a cartridge B according to an embodiment of the present invention is shown. FIG. 5 is a schematic sectional view of the cartridge B. FIG. 6 is a schematic perspective view of a first frame unit 18. FIG. 7 is a schematic perspective view of a second frame unit 19. FIG. 8 is an illustration of the connection between the first frame unit 18 and the second frame unit 19.

As shown in FIG. 5, the cartridge B is provided with a photosensitive drum 10 having a photosensitive layer. A charging roller 11 as a charging means (process means) is provided contacted to the surface of the photosensitive drum 10. The charging roller 11 charges the surface of the photosensitive drum 10 uniformly by a voltage application from the main assembly A of the apparatus. The charging roller 11 is driven by the photosensitive drum 10 to rotate. The charged photosensitive drum 10 is exposed to a laser beam from optical means 1 through an opening 12 to form an electrostatic latent image. The electrostatic latent image is developed by a developing means which will be described hereinafter.

The developer t accommodated in a developer accommodating container 14 is delivered into a developing container 16 through an opening 14*a* of the developer accommodating container 14 by a rotatable developer feeding member 17. The developing container 16 includes a developing roller 13 as a developing means (process means). The developing roller 13 functions as a rotatable member for carrying the developer t. The developing roller 13 contains a magnet roller (fixed magnet) 13*c*. A developing blade 15 is provided contacted to the peripheral surface of the developing roller 13. Developing blade 15 regulates an amount of the developer t deposited on the peripheral surface of the developing roller 13 and applies triboelectric charge to the developer t. By this, a developer layer is formed on the surface of the developing roller 13. By a blow preventing sheet 24, leakage of the developer t through the developing container 16 is prevented.

Developing roller 13 is urged to the photosensitive drum 10 by urging springs 23*a*, 23*b* while keeping a constant clearance relative to the photosensitive drum 10 by spacer rollers 13*k* which are gap holding members. And, the developing roller 13 supplied with a voltage is rotated to supply the developer t to a developing zone of the photosensitive drum 10. The developing roller 13 transfers the developer t in accordance with the electrostatic latent image formed on the photosensitive drum 10 to visualize the electrostatic latent image on the photosensitive drum 10, thus forming the developed image. That is, the photosensitive drum 10 functions as a rotatable member for carrying the developed image (developer).

Thereafter, the developed image formed on the photosensitive drum 10 is transferred onto the recording material 2 by the transfer roller 4.

The cleaning frame 21 is provided with a cleaning blade 20 as cleaning means (process means) contacted to the outer surface of the photosensitive drum 10. A free end of the cleaning blade 20 is elastically contacted to the photosensitive drum 10. The cleaning blade 20 scrapes the developer t off the photosensitive drum 10 after the developed image is transferred onto the recording material 2. The developer t scraped from the surface of the photosensitive drum 10 by the cleaning blade 20 is accommodated in a removed developer accommodating portion 21*a*. A receptor sheet 22 is provided to prevent the leakage of the developer t from the removed developer accommodating portion 21*a*.

The cartridge B comprises the first frame unit 18 and the second frame unit 19 which are connected integrally with each other. The description will be made as to the first frame unit 18 and the second frame unit 19.

As shown in FIG. 6, the first frame unit 18 comprises the developer accommodating container 14 and the developing container 16. The developer accommodating container 14 is provided with members such as a developer feeding member 17 (unshown) and so on. The developing container 16 is provided with a developing roller 13, a developing blade 15, spacer rollers 13*k* provided at the opposite ends of the developing roller 13, and a blow preventing sheet 24 and so on.

As shown in FIG. 7, the second frame unit 19 comprises a cleaning frame 21, a cleaning blade 20 and the charging roller 11 and so on. In addition, the photosensitive drum unit U1 including the photosensitive drum 10 is rotatably supported by a drum shaft 54 and the drum bearing 30.

As shown in FIG. 8, rotation holes 16*a*, 16*b* at the opposite ends of the first frame unit 18 and fixing holes 21*c*, 21*d* at the opposite ends of the second frame unit 19 are connected with each other by unit connecting pins 25*a*, 25*b*. By this, the first frame unit 18 and the second frame unit 19 are connected rotatably. By the urging springs 23*a*, 23*b* provided between the first frame unit 18 and the second frame unit 19, the developing roller 13 is urged toward the photosensitive drum 10 while keeping a constant clearance relative to the photosensitive drum 10 through the spacer roller 13*k* (FIG. 6).

Figure 9:
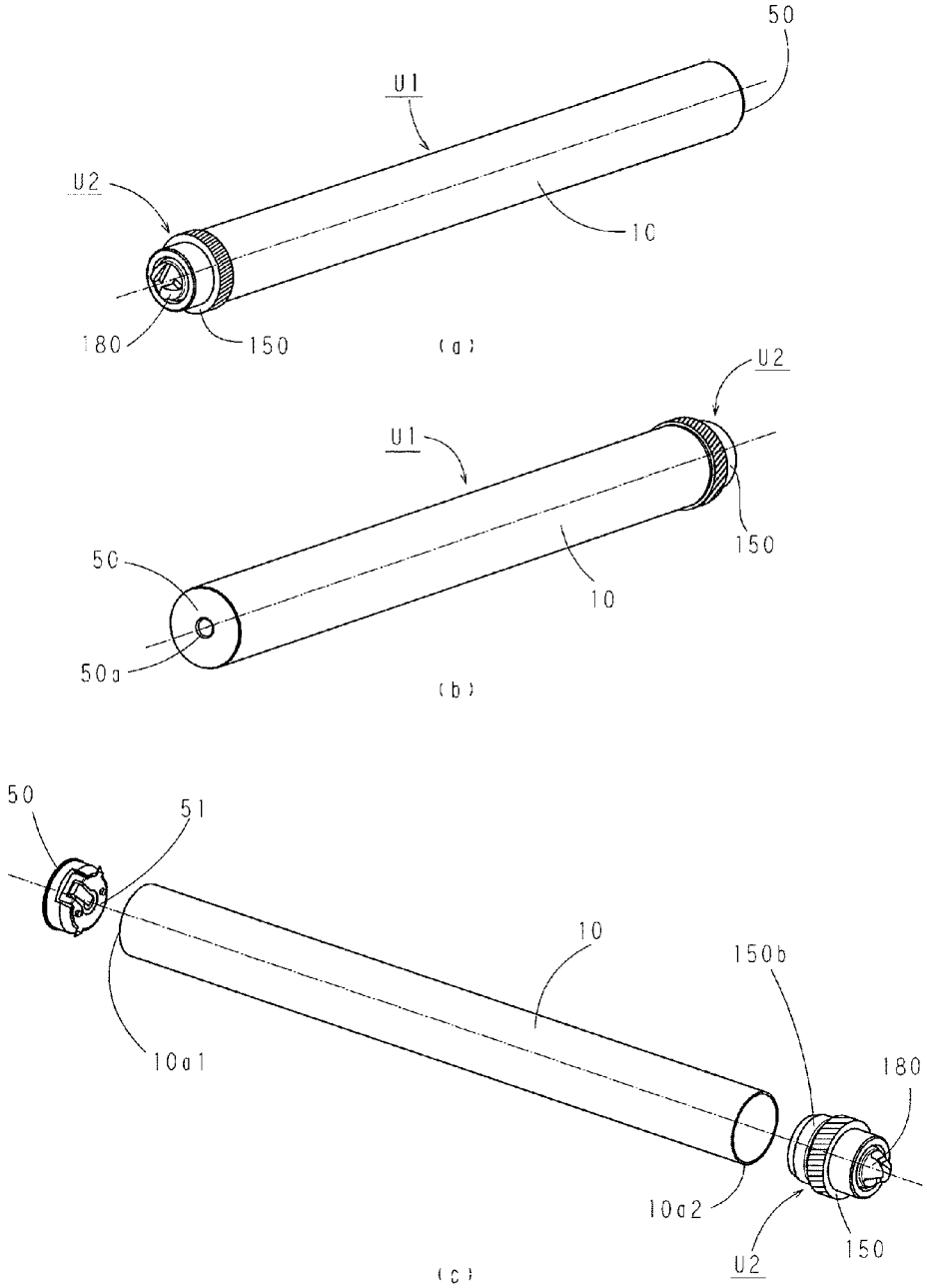
FIG. 9 is a schematic perspective view of a photosensitive drum unit according to one embodiment of the present invention.
Figure 10:
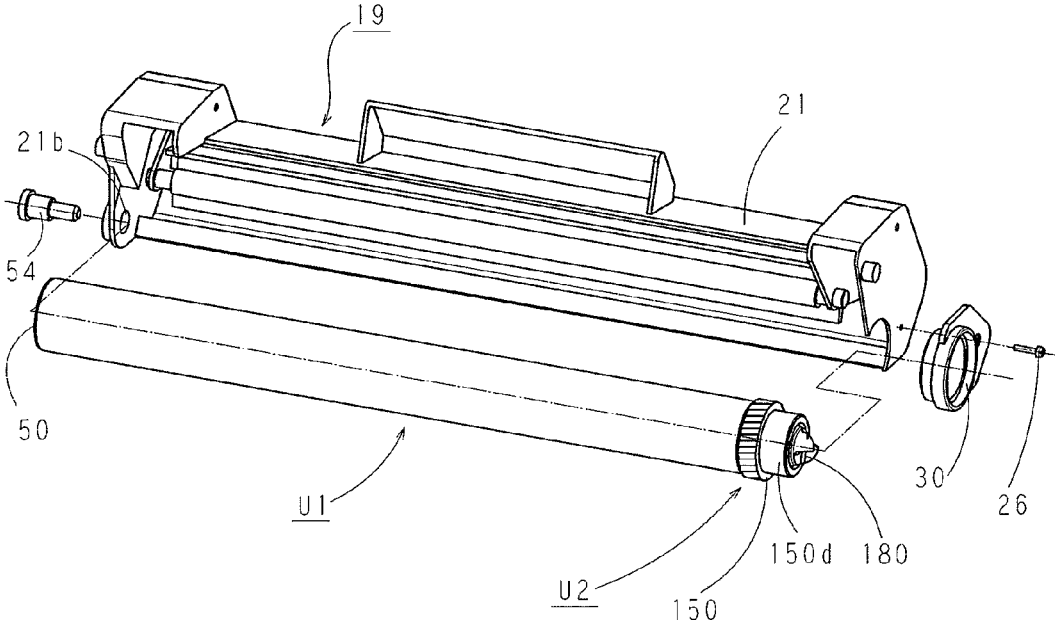
FIG. 10 is a schematic perspective view showing mounting of the photosensitive drum unit to second frame unit according to one embodiment of the present invention.

(3) Photosensitive Drum Unit:

Referring to FIGS. 9 and 10, a structure of the photosensitive drum unit U1 (photosensitive drum unit U1) will be described. Part (a) of FIG. 9 is a schematic perspective view of the photosensitive drum unit U1 as seen from the driving side, and part (b) of FIG. 9 is a schematic perspective view as seen from a non-driving side. Part (c) of FIG. 9 is an exploded schematic perspective view of the photosensitive drum unit U1. FIG. 10 illustrates the state in which the photosensitive drum unit U1 is assembled into the second frame unit 19.

As shown in FIG. 9, the photosensitive drum unit U1 includes the photosensitive drum 10 a driving side flange unit U2 and a non-driving side flange 50 and so on.

The photosensitive drum 10 comprises an electroconductive member of the aluminum or the like, coated with a photosensitive layer. The photosensitive drum 10 may be hollow or solid.

The driving side flange unit U2 is disposed at the driving side end portion of the photosensitive drum 10. More specifically, as shown in part (c) of FIG. 9, in the driving side flange unit U2 an engagement supporting portion 150*b* of the driving side flange (rotational force transmitted member) 150 engages with an opening 10*a*2 of the end portion of the photosensitive drum 10 and is fixed to the photosensitive drum 10 by bonding or clamping. When the driving side flange 150 rotates, the photosensitive drum 10 rotates integrally. The driving side flange 150 is fixed to the photosensitive drum 10 so that the rotational axis of the driving side flange 150 and the rotational axis of the photosensitive drum 10 are substantially co-axial (on the same line) with each other. Therefore, in the following description, the mounting and demounting direction of the cartridge B relative to the main assembly A of the apparatus is the direction substantially perpendicular to the rotational axis of the photosensitive drum 10, and is the direction substantially perpendicular to the rotational axis of the driving side flange 150, and further is the direction substantially perpendicular to the rotational axis of the main assembly side engaging portion 100. Here, the "substantially co-axial" covers the completely coaxial case and the case in which they are slightly deviated due to the variation or the like of the dimensions of the parts. The same applies to the following description.

Similarly, the non-driving side flange 50 is substantially co-axial with the photosensitive drum 10 is disposed at the non-driving side end portion of the photosensitive drum 10. The non-driving side flange 50 is made of a resin material, and as shown in part (c) of FIG. 9, and is fixed to the photosensitive drum 10 by bonding or clamping or the like at the opening 10*a*1 of the end portion of the photosensitive drum 10. The non-driving side flange 50 is provided with an electroconductive (mainly metal) to ground the photosensitive drum 10 electrically. The grounding plate 51 is contacted to an inner surface of the photosensitive drum 10 and is connected electrically when the main assembly A of the apparatus.

The photosensitive drum unit U1 is rotatably supported by the second frame unit 19. As shown in FIG. 10, in the driving side of the photosensitive drum unit U1, a portion-to-be-supported 150*d* of the driving side flange 150 is supported rotatably by the drum bearing 30. The drum bearing 30 is fixed to the cleaning frame 21 by a screw 26. On the other hand, in the non-driving side of the photosensitive drum unit U1, the shaft receiving portion 50*a* (part (b) of FIG. 9) of the non-driving side flange 50 is supported rotatably by the drum shaft 54. The drum shaft 54 is press-fitted into a supporting portion 21*b* provided in the non-driving side of the cleaning frame 21.

Figure 11:
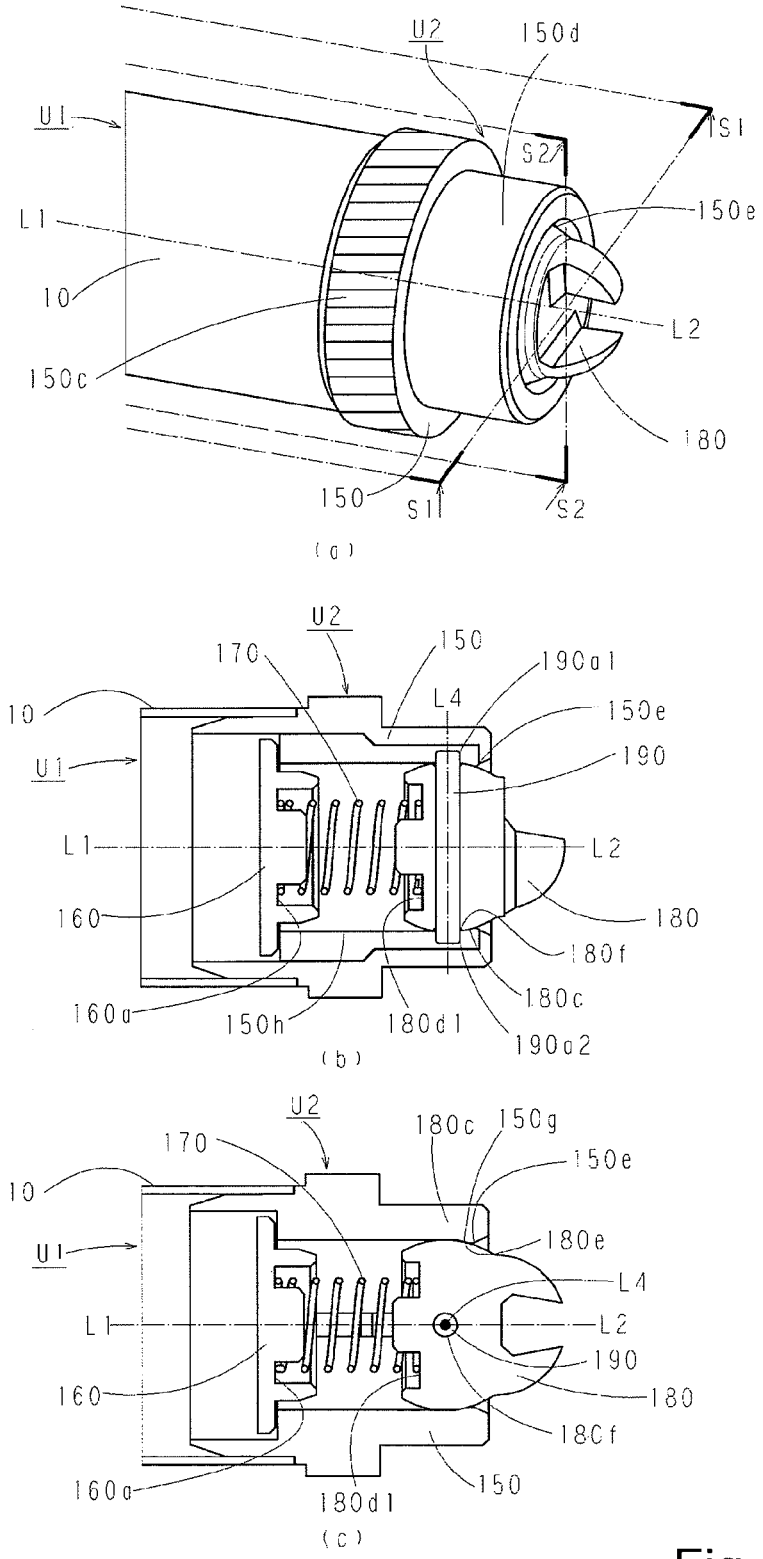
FIG. 11 is a schematic perspective view and a schematic sectional view of the photosensitive drum unit according to one embodiment of the present invention.
Figure 12:
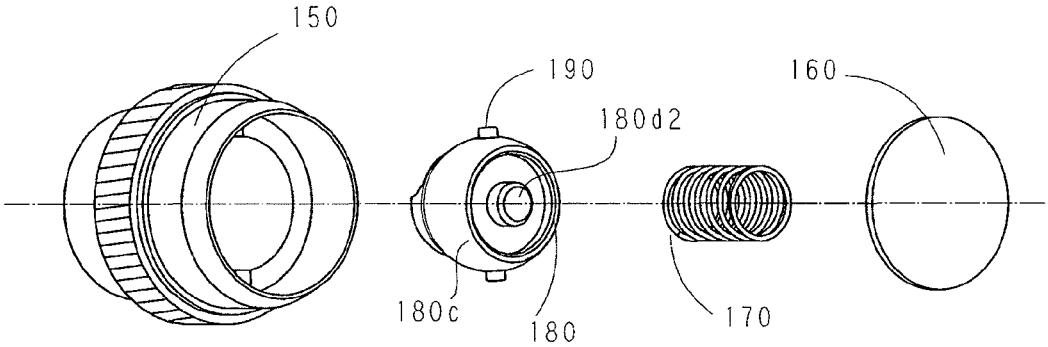
FIG. 12 is an exploded schematic perspective view of a driving side flange unit according to one embodiment of the present invention.
Figure 12:
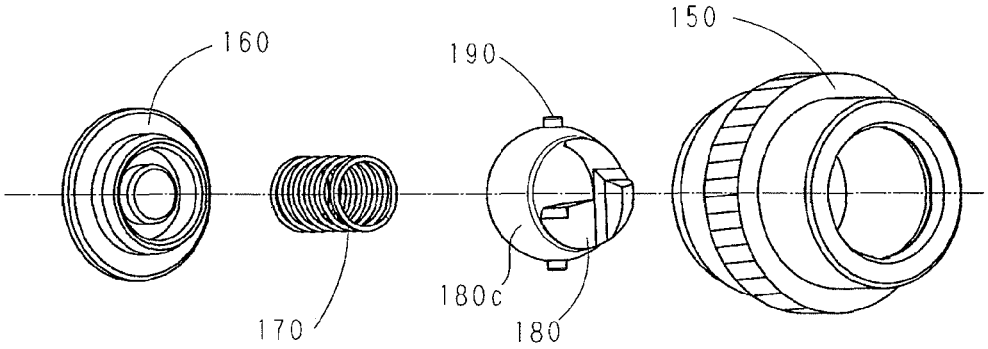
Figure 13:
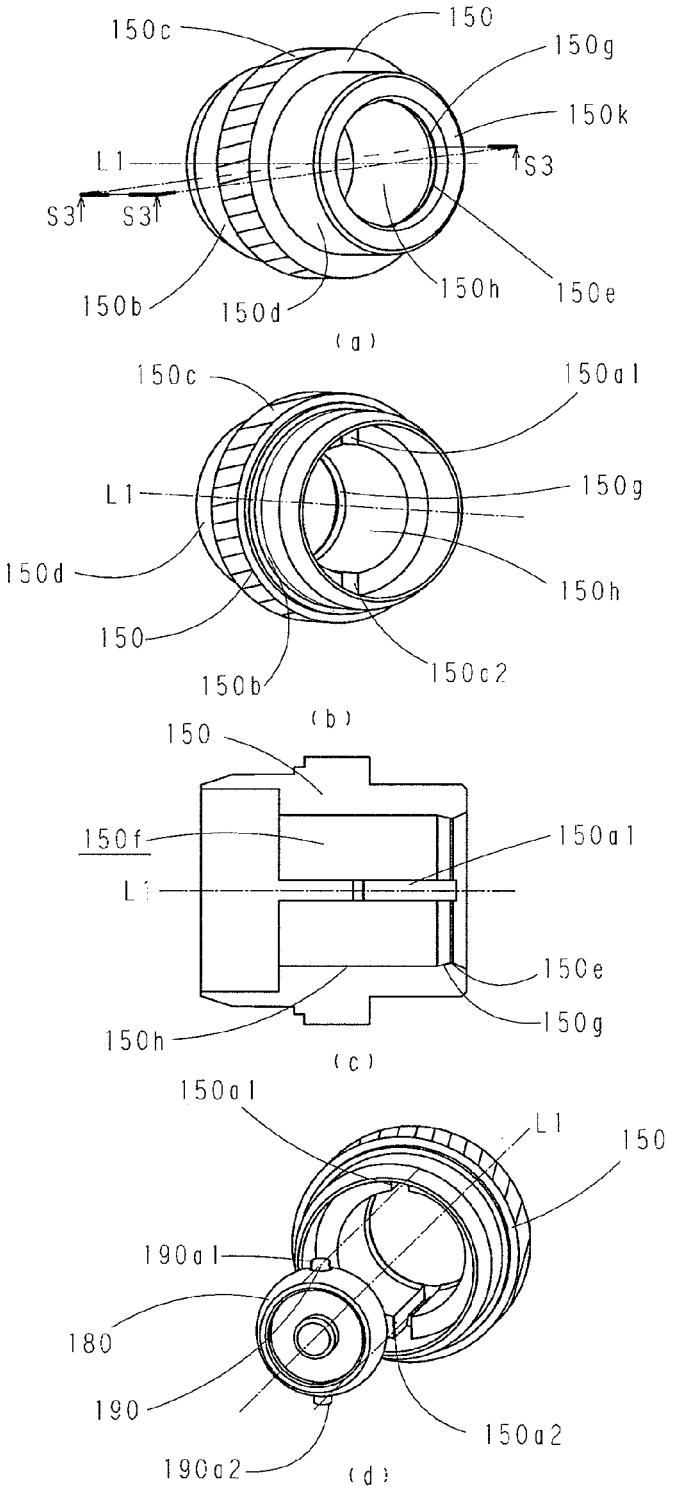
FIG. 13 is a schematic perspective view and a schematic sectional view of a driving side flange according to one embodiment of the present invention.
Figure 14:
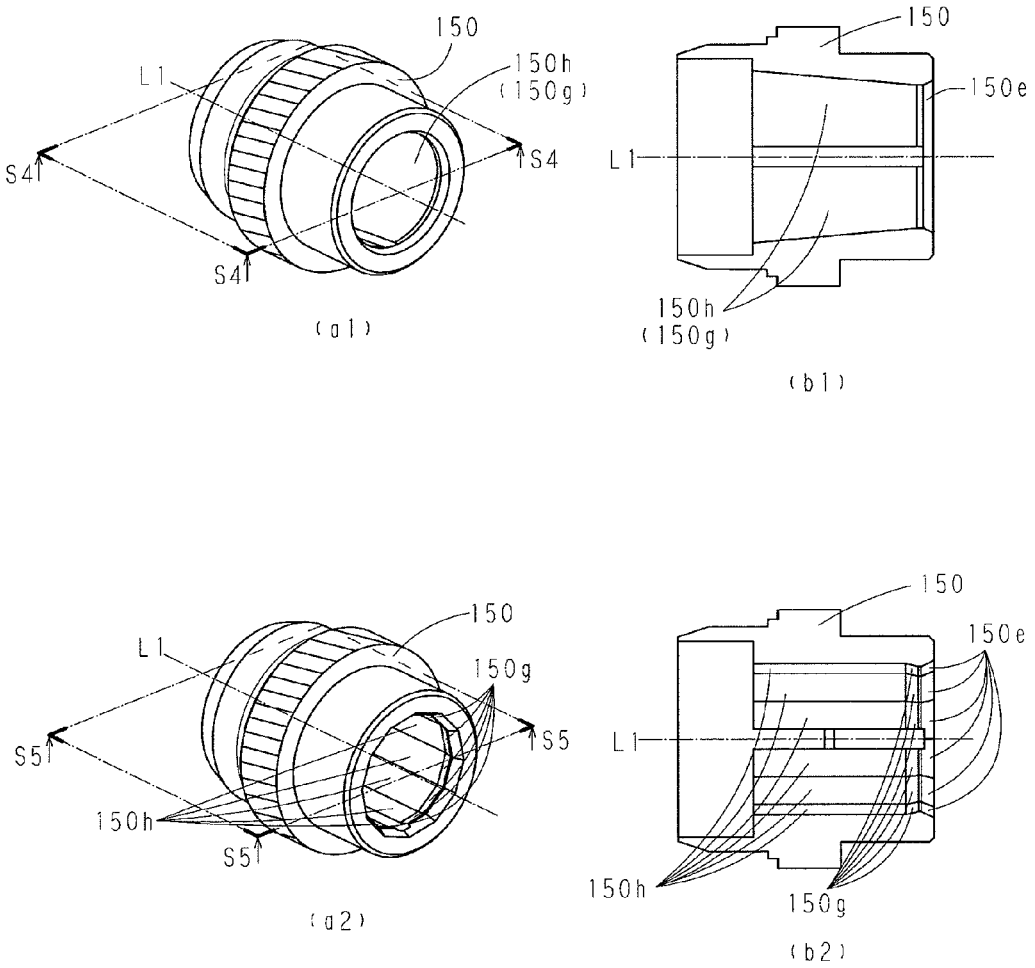
FIG. 14 is a schematic perspective view and a schematic sectional view of the driving side flange according to one embodiment of the present invention.

(4) Driving Side Flange Unit:

Referring to FIGS. 11 to 14, a structure of the driving side flange unit U2 will be described. Part (a) of FIG. 11 is a schematic perspective view of the photosensitive drum unit U1 having the driving side flange unit U2 mounted thereto, as seen from the driving side. Part (b) of FIG. 11 is a schematic sectional view taken along a plane S1 of the part (a) of FIG. 11, part (c) of FIG. 11 is a schematic sectional view taken along a plane S2 of part (a) of FIG. 11. FIG. 12 is an exploded schematic perspective view of the driving side flange unit U2. Parts (a) and (b) of FIG. 13 are schematic perspective views of the driving side flange 150. Part (c) of FIG. 13 is a schematic sectional view taken along a plane S3 of the part (a) of FIG. 13. Part (d) of FIG. 13 is a schematic perspective view of the coupling member 180 and the driving side flange 150. Parts (a1) and (b1) of FIG. 14 are illustrations of the driving side flange 150 according to other examples.

As shown in FIGS. 11 and 12, the driving side flange unit U2 comprises the driving side flange (rotational force transmitted member 150, the coupling member 180, a drive pin 190, an urging member 170 and a covering member 160.

Here, "L1" in FIG. 11 is the rotational axis when the driving side flange 150 rotates, and in the following description, the rotational axis L1 is simply called "axis L1". Similarly, "L2" is the rotational axis when the coupling member 180 rotates, and in the following description, the rotational axis L2 is simply called "axis L2".

Into the coupling member 180, the drive pin 190 is press-fitted, and is provided in the driving side flange 150 together with the urging member 170 and the covering member 160. And, the covering member 160 is fixed to the driving side flange 150 by a method such as bonding or welding or the like.

In this embodiment, the urging member 170 is a compression coil spring as an elastic member. One end portion of the urging member 170 is contacted to a spring contact portion 180*d*1 of the coupling member 180, and the other end portion is contacted to a spring contact portion 160*a* of the covering member 160. And, the urging member 170 is compressed the coupling member 180 and the covering member 160 and urges the coupling member 180 in the direction from the non-driving side toward the driving side. The urging member may be a leaf spring, a torsion spring, a rubber, a sponge or the like if it can produce an elastic force. However, as will be described hereinafter, the urging member has to have a certain stroke since the coupling member 180 moves in the direction parallel with the axis L1 of the driving side flange 150. For this reason, the coil spring or the like is desirable since it has a stroke.

On the other hand, drive pin 190 is press-fitted in a hole 180*f* provided in a portion-to-be-guided 180*c* of the coupling member 180. Opposite ends 190*a*1, 190*a*2 of the drive pin 190 project from the portion-to-be-guided 180*c*. In this embodiment, the drive pin 190 has a circular column configuration, and in the following description, a center axis of the circular column configuration is called "axis L4". The portion-to-be-guided 180*c* of the coupling member 180 has a part spherical shape, and the axis L4 of the drive pin 190 passes substantially through a center of the spherical shape.

In this embodiment, the coupling member 180 and the drive pin 190 are unintegral with each other, but they may be formed integrally.

As shown in parts (a) and (b) of FIG. 13, the driving side flange 150 is provided with a rotational force transmitted portions 150*a*1 150*a*2, an engagement supporting portion 150*b* for engaging with an inner surface of the photosensitive drum 10, a gear portion 150*c*, a portion-to-be-supported 150*d* supported by the drum bearing 30, and, so on. The driving side flange 150 has a hollow cylindrical shape having an inner wall 150*h*. The driving side of the driving side flange 150 is provided with an opening 150*e*, and an inner diameter of the opening 150*e* is smaller than an inner diameter of the inner wall 150*h*. As shown in part (c) of FIG. 13, the opening 150*e* and the inner wall 150*h* are connected by a conical shape contact portion 150 *g* having a center shaft coaxial with the axis L1 of the flange 150. The opening 150*e*, the contact portion 150 *g* and the inner wall 150*h* forms a space which will be called "space portion 150*f*".

In this embodiment, the portion-to-be-guided 180*c* is constituted by the spherical surface and the inner wall 150*h* which is in the form of a hollow cylinder provided by penetrating by a circular column. A small clearance is provided between the inner wall 150*h* and the portion-to-be-guided 180*c*, and the driving side flange 150 guides the coupling member 180. Therefore, the center of the spherical shape of the portion-to-be-guided 180*c* is substantially on the axis L1 of the driving side flange 150. While keeping such a relation, the coupling member 180 is translatable along an axis L1 of the driving side flange 150. In addition, the axis L2 of the coupling member 180 is movable (inclinable, pivotable, swingable, whirlable) in any directions relative to the axis L1 of the driving side flange 150.

Hereinafter, a combination of the inner wall 150*h* and the contact portion 150 *g* is called "guide portion (holding portion)" which has a guide configuration for the inclining, pivoting, swinging, and/or whirling movement of the axis L2 of the coupling member 180 relative to the axis L1 or for the movement of the coupling member 180 along the axis L1.

In this embodiment, the driving side flange 150 is provided with the inner wall 150*h* as a guide portion (holding portion) for guiding the sliding movement (translational movement) of the coupling member 180 along the axis L1. By this, the coupling member 180 does not need to provide the coupling member 180 with a guide configuration for movement of the coupling member 180 in the direction of the axis L1, and the coupling member 180 may be short in the direction of the axis L2. In other words, a distance between rotational force receiving portions 180*a*3, 180*b*3 which will be described hereinafter and the drive pin 190 in the direction of the axis L2 can be reduced. By doing so, when the coupling member 180 transmits the rotational force, the amount of twisting of the coupling member 180 by the load to the cartridge B or the like can be reduced. Therefore, the coupling member 180 can transmit the rotational force from the main assembly side engaging portion 100 of the main assembly A of the apparatus to the driving side flange 150 with high accuracy.

The inner surface of the driving side flange 150 guides an outer periphery of the portion-to-be-guided 180*c* of the coupling member 180. In other words, the formed on the inner surface of the driving side flange 150 directly holds a portion-to-be-supported which is the portion-to-be-guided 180*c*. By doing so, the coupling member 180 can be maximized relative to the inner surface of the driving side flange 150. Then, a rigid of the coupling member 180 can be enhanced, and therefore, the amount of twisting of the coupling member by the load or the like of the cartridge B when the coupling member 180 transmits the rotational force can be reduced. Therefore, the coupling member 180 can transmit the rotational force from the main assembly side engaging portion 100 to the driving side flange 150 with high accuracy.

The inner wall 150*h* of the driving side flange 150 may have a shape other than those provided by penetration with a circular column. For example, as shown in parts (a1) or (b1) of FIG. 14, the shape may be provided by hollowing with a conical shape, or it maybe provided by hollowing with a polygonal prism as shown in parts (a2) or (b2) of FIG. 14.

In addition, in this embodiment, the inner diameter of the opening 150*e* of the driving side flange 150 is made smaller than an outer diameter of the portion-to-be-guided 180*c* of the coupling member 180. By this, the coupling member 180 does not disengage from the opening 150*e* by a portion-to-be-contacted 180*e* abutting to a contact portion 150 *g* of the driving side flange 150. The portion-to-be-contacted 180*e* is a part of the portion-to-be-guided 180*c* (part (c) of FIG. 11). That is, the portion-to-be-contacted 180*e* is formed on the same spherical surface of the portion-to-be-guided 180*c*. When the portion-to-be-contacted 180*e* contacts the contact portion 150*g*, the free end portion of the coupling member 180 is projected through the opening 150*e* of the driving side flange 150.

In the state that the spherical surface of the portion-to-be-contacted 180*e* is in contact with the conical surface of the contact portion 150*g*, the center of the spherical shape of the portion-to-be-guided 180*c* is held on the axis L1. By this, the coupling member 180 and the driving side flange 150 are positioned relative to each other with high accuracy in a diametrical direction from the axis L1. As a result, the rotational force can be transmitted from the coupling member 180 to the driving side flange 150 with high accuracy.

On the other hand, in the side opposite from the opening 150*e*, the coupling member 180 is prevented from being dislodged by the covering member 160.

Rotational force transmitted portions 150*a*1, 150*a*2 of the driving side flange 150 functions to receive the rotational force for rotating the photosensitive drum 10 from the coupling member 180. As shown in part (d) of FIG. 13, the rotational force transmitted portions 150*a*1, 150*a*2 extend from the opening 150*e* of the driving side flange 150 to the inner wall 150*h*, and has a groove configuration substantially parallel with the axis L1. End portions 190*a*1, 190*a*2 of the drive pin 190 press-fitted into the coupling member 180 engages with the rotational force transmitted portions 150*a*1, 150*a*2 of the driving side flange 150, by which the rotational force is transmitted from the coupling member 180 to the driving side flange 150.

In this embodiment, the driving side flange 150, the coupling member 180 and the covering member 160 are made of resin material, more particularly polyacetal or polycarbonate or the like. The drive pin 190 is made of metal, more particularly steel or stainless steel. However, metal or resin material may be selected for each part depending on the load torque required for rotating the photosensitive drum 10. As described above, the drive pin 190 may be integral with the coupling member 180.

In this embodiment, the gear portion 150*c* transmits the rotational force received by the coupling member 180 from the main assembly side engaging portion 100 to the developing roller 13, and includes a helical gear or a spur gear which is integral with the driving side flange 150. The rotation of the developing roller 13 may be made not through the driving side flange 150. In such a case, the gear portion 150*c* may be omitted.

Referring to FIG. 11 through FIG. 13, an assembling process of the driving side flange unit U2 will be described. First, the drive pin 190 is inserted into the coupling member 180. In this embodiment, the drive pin 190 is press-fitted into the hole 180*f*, but may be loosely fitted thereinto. Or, the coupling member 180 and the drive pin 190 may be fixed by bonding. The coupling member 180 into which the drive pin 190 has been inserted is inserted into the space portion 150*f* of the driving side flange 150. At this time, the coupling member 180 and the driving side flange 150 are aligned in phase so that the end portions 190*a*1, 190*a*2 of the drive pin 190 are engaged with the rotational force transmitted portions 150*a*1, 150*a*2 of the driving side flange 150. Then, the urging member 170 is mounted. The urging member 170 is regulated by a shaft portion 160*a* of the covering member 160 and a shaft portion 180*d*2 of the coupling member 180 in the diametrical direction. The urging member 170 may be mounted beforehand on both or one of the shaft portion 180*d*2 and the shaft portion 160*a*. Here, the relation between the inner diameter of the urging member 170 and the outer diameter of the shaft portion 180*d*2 (or 160*a*) may be selected so as to be a press-fitting relation, and then the urging member 170 is prevented from being dislodged, thus improving the mounting operativity. Thereafter, covering member 160 is mounted. In this embodiment, the covering member 160 is fixed to the driving side flange 150 by bonding, welding or the like, but this is not inevitable. For example, a snap fitting structure may be used to prevent the covering member 160 from disengaging from the driving side flange 150.

Figure 15:
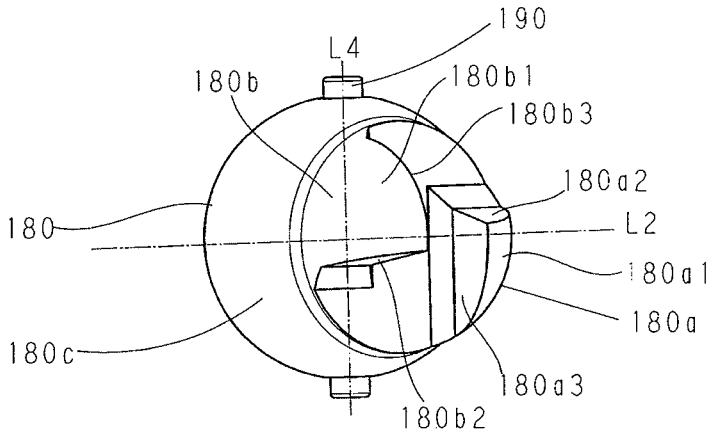
FIG. 15 is a schematic perspective view of a coupling member according to one embodiment of the present invention.
Figure 15:
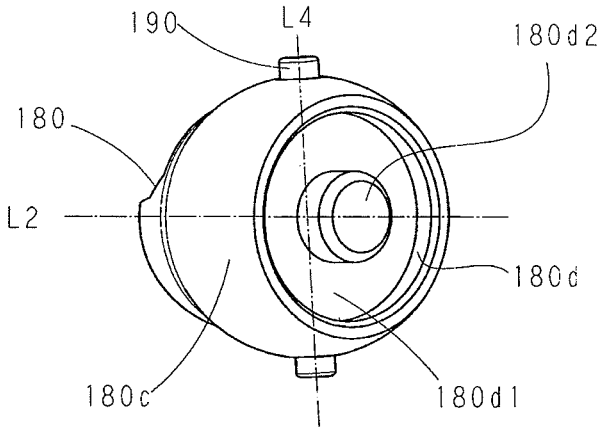
Figure 16:
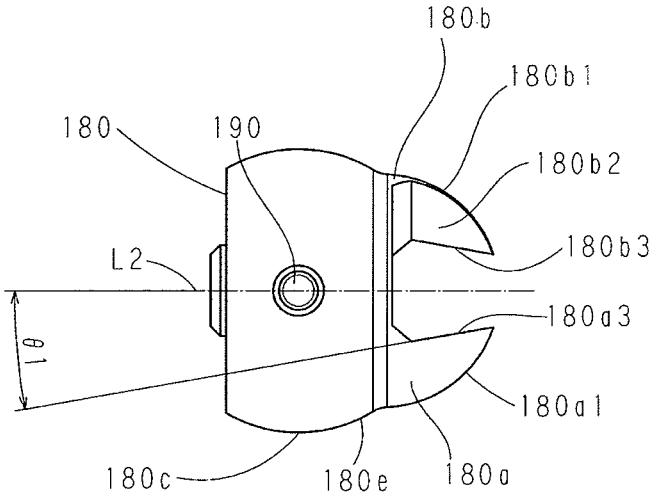
FIG. 16 is an illustration of the coupling member according to one embodiment of the present invention.
Figure 16:
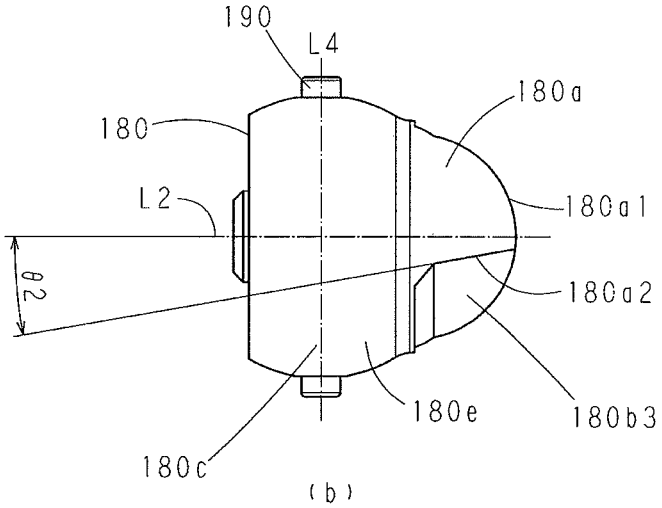
Figure 17:
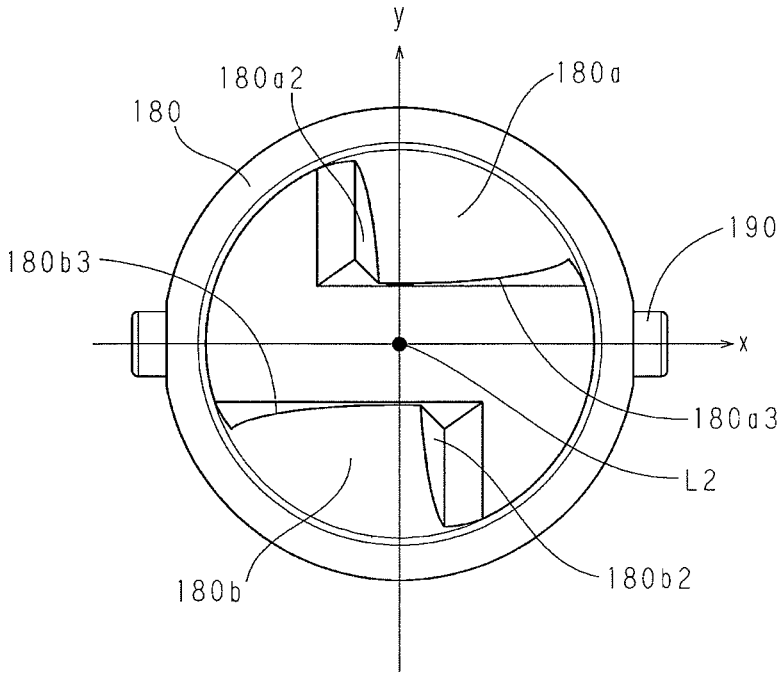
FIG. 17 is an illustration of the coupling member according to one embodiment of the present invention.

(5) Coupling Member:

Referring to FIG. 15 through FIG. 17, the configuration of the coupling member 180 will be described. FIG. 15 is a schematic perspective view of the coupling member 180 and the drive pin 190. Part (a) of FIG. 16 is an illustration of the coupling member 180 as seen in the direction of the axis L4. Part (b) of FIG. 16 is an illustration of the coupling member 180 as seen in the directing direction perpendicular to the axis L2 and the axis L4. FIG. 17 is an illustration the coupling member 180 as seen in the direction of the axis L2 from the driving side.

As shown in FIGS. 15 and 16, the coupling member 180 comprises mainly a first projected portion 180*a*, a second projected portion 180*b*, the portion-to-be-guided 180*c* and a spring mounting portion 180*d*.

The portion-to-be-guided 180*c* is guided inside the flange 150 so that the coupling member 180 translates relative to the axis L1, and that the axis L2 inclines relative to the axis L1 (FIG. 11). The portion-to-be-guided 180*c* has a shape of barrel including part spherical portion. Here, a portion in the driving side of the portion-to-be-guided 180*c* is the portion-to-be-contacted 180*e*. When the coupling member 180 is mounted to the driving side flange 150, the contact portion 150*g* of the driving side flange contacts with the portion-to-be-contacted 180*e*.

The first projected portion 180*a* and the second projected portion 180*b* project toward the free end portion (driving side of the axis L2) of the coupling member 180 directly from the part of the spherical shape (barrel configuration) forming the portion-to-be-guided (portion-to-be-supported) 180*c*. The first projected portion 180*a* and the second projected portion 180*b* are positioned symmetrically with each other with respect to the axis L2 of the coupling member 180 (180 degrees). Here, the first projected portion 180*a* and the second projected portion 180*b* is formed closer to the axis L2 of the coupling member 180 than an outermost circumference of the portion-to-be-guided the portion-to-be-supported) 180*c* in the radial direction of the coupling member 180.

In addition, the structure is such that centers of gravity of cross-sections of the first projected portion 180*a* and the second projected portion 180*b* taken along a plane perpendicular to the axis L2 of the coupling member 180 approaches to the axis L2 toward the free end portion (driving side of the axis L2) of the coupling member 180.

Further, the first projected portion 180*a* and the second projected portion 180*b* each comprises a main assembly contact portion 180*a*1, 180*b*1, another main assembly contact portion 180*a*2, 180*b*2 and a rotational force receiving portion 180*a*3, 180*b*3. The main assembly contact portion 180*a*1, 180*b*1 is outside the first projected portion 180*a* and the second projected portion 180*b* as seen from the axis L2. In other words, the main assembly contact portion 180*a*1, 180*b*1 is outside the first projected portion 180*a* and the second projected portion 180*b*, respectively in the radial direction of the coupling member 180. Here the main assembly contact portion 180*a*1, 180*b*1 is the portion which is contactable with a part of the main assembly of the apparatus such as the main assembly side engaging portion 100 when the coupling member 180 is engaged with the main assembly side engaging portion 100, or when the coupling member 180 disengages from the main assembly side engaging portion, as will be described hereinafter.

The rotational force receiving portion 180*a*3 is an inclined surface (part (a) of FIG. 16) inclined by an angle θ1 the axis L2 of the coupling member 180. This applies to the rotational force receiving portion 180*b*3. The other main assembly contact portion 180*a*2 is an inclined surface inclined by an angle θ2 relative to the axis L2 of the coupling member 180 (part (b) of FIG. 16). This applies to the other main assembly contact portion 180*b*2.

Here, the main assembly contact portion 180*a*1, 180*b*1 approaches the axis L2 toward the driving side of the axis L2. In addition, in this embodiment, the main assembly contact portion 180*a*1, 180*b*1 comprises a curved surface. In other words, the main assembly contact portion 180*a*1, 180*b*1 comprises a part of spherical surface having a diameter which is smaller than that of the portion-to-be-guided 180*c*, and the diameter reduces toward the driving side of the axis L2.

The spring mounting portion 180*d* is provided in the non-driving side of the portion-to-be-guided 180*c* and has a circumferential groove configuration. A bottom surface of the circumferential groove constitutes a spring contact portion 180*d*1 to which the urging member 170 abuts. The spring contact portion 180*d*1 is a surface substantially perpendicular to the axis L2 of the coupling member 180.

The arrangement of the rotational force receiving portions 180*a*3, 180*b*3 and the other main assembly contact portions 180*a*2, 180*b*2 are as follows. As shown in FIG. 17, an x-y coordinate system is taken such that a point of origin is on the axis L2, the first projected portion 180*a* is in a first quadrant, and the second projected portion 180*b* is in a third quadrant. Then, the rotational force receiving portion 180*a*3 of the first projected portion 180*a* opposes to a fourth quadrant, and the rotational force receiving portion 180*b*3 of the second projected portion 180*b* opposes to a second quadrant. In this embodiment, the other main assembly contact portion 180*a*2 of the first projected portion 180 enters the second quadrant, and the other main assembly contact portion 180*b*2 of the second projected portion 180*b* enters the fourth quadrant. Thus, the rotational force receiving portion 180*a*3 and the rotational force receiving portion 180*b*3 are disposed at 180-degrees symmetrical positions with respect to the axis L2, and the other main assembly contact portion 180*a*2 and the other main assembly contact portion 180*b*2 are disposed at 180-degrees symmetrical positions with respect to the axis L2. However, it is not inevitable that the other main assembly contact portion 180*a*2 enters the second quadrant, and it is not inevitable that the other main assembly contact portion 180*b*2 enters the fourth quadrant. Nevertheless, if the main assembly contact portion 180*a*2 enters the second quadrant, and the main assembly contact portion 180*b*2 enters the fourth quadrant, the rigidities of the first projected portion 180*a* and the second projected portion 180*b* can be enhanced. This enhances the strengths of the rotational force receiving portions 180*a*3, 180*b*3, so that the rotational force can be transmitted from the main assembly side engaging portion 100 to the coupling member 180 with high accuracy.

Here, the configuration of the "sphere" of the portion-to-be-guided 180*c* in this embodiment will be described.

The configuration of the sphere of the portion-to-be-guided 180*c* of the coupling member 180 may not be a true sphere (distorted or polygonal) due to variation in the part dimensions or production of small corners or the like in the machining thereof. The spherical configuration including such a shape is called "substantially spherical configuration". The present invention is usable with the function effects when the substantially spherical configuration is used.

Figure 18:
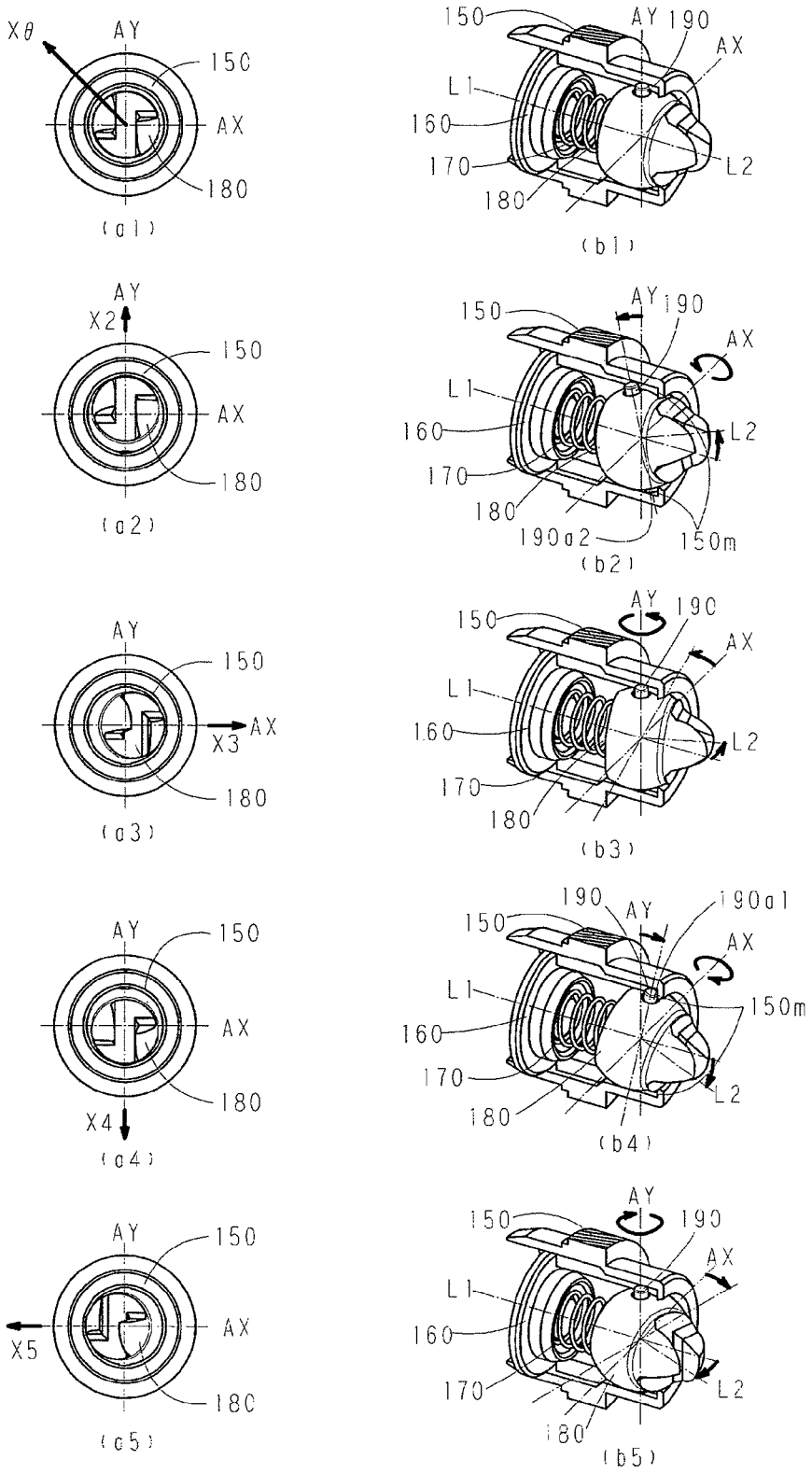
FIG. 18 is an illustration showing a state in which the coupling member is inclined relative to the driving side flange according to one embodiment of the present invention.
Figure 19:
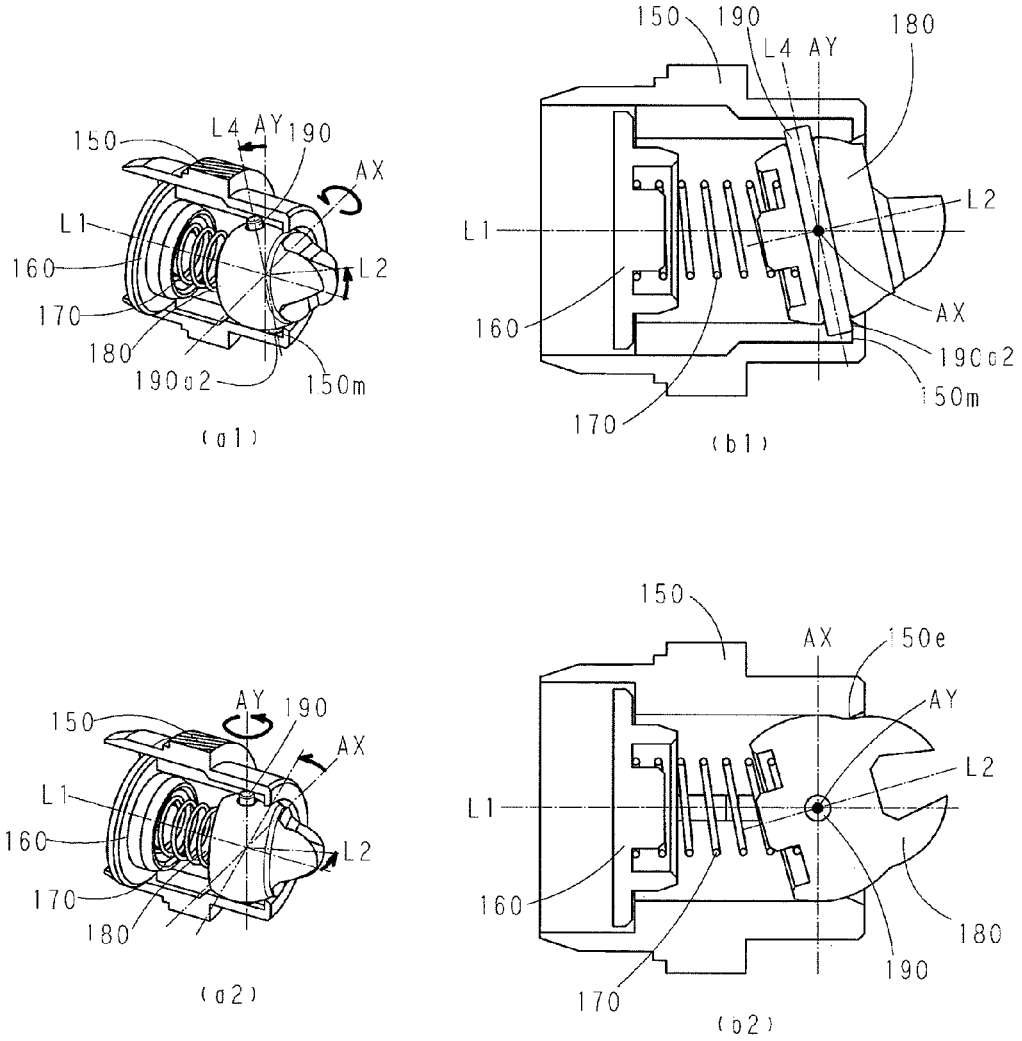
FIG. 19 is an illustration showing a state in which the coupling member is inclined relative to the driving side flange according to one embodiment of the present invention.
Figure 20:
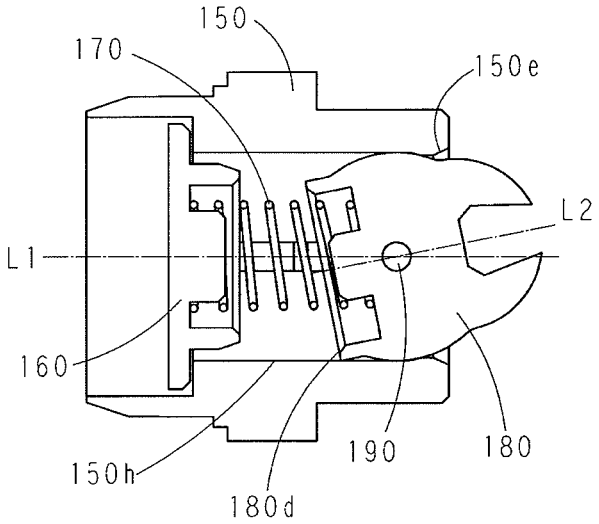
FIG. 20 is an illustration showing a state in which an amount of inclination of the coupling member is limited, according to one embodiment of the present invention.
Figure 21:
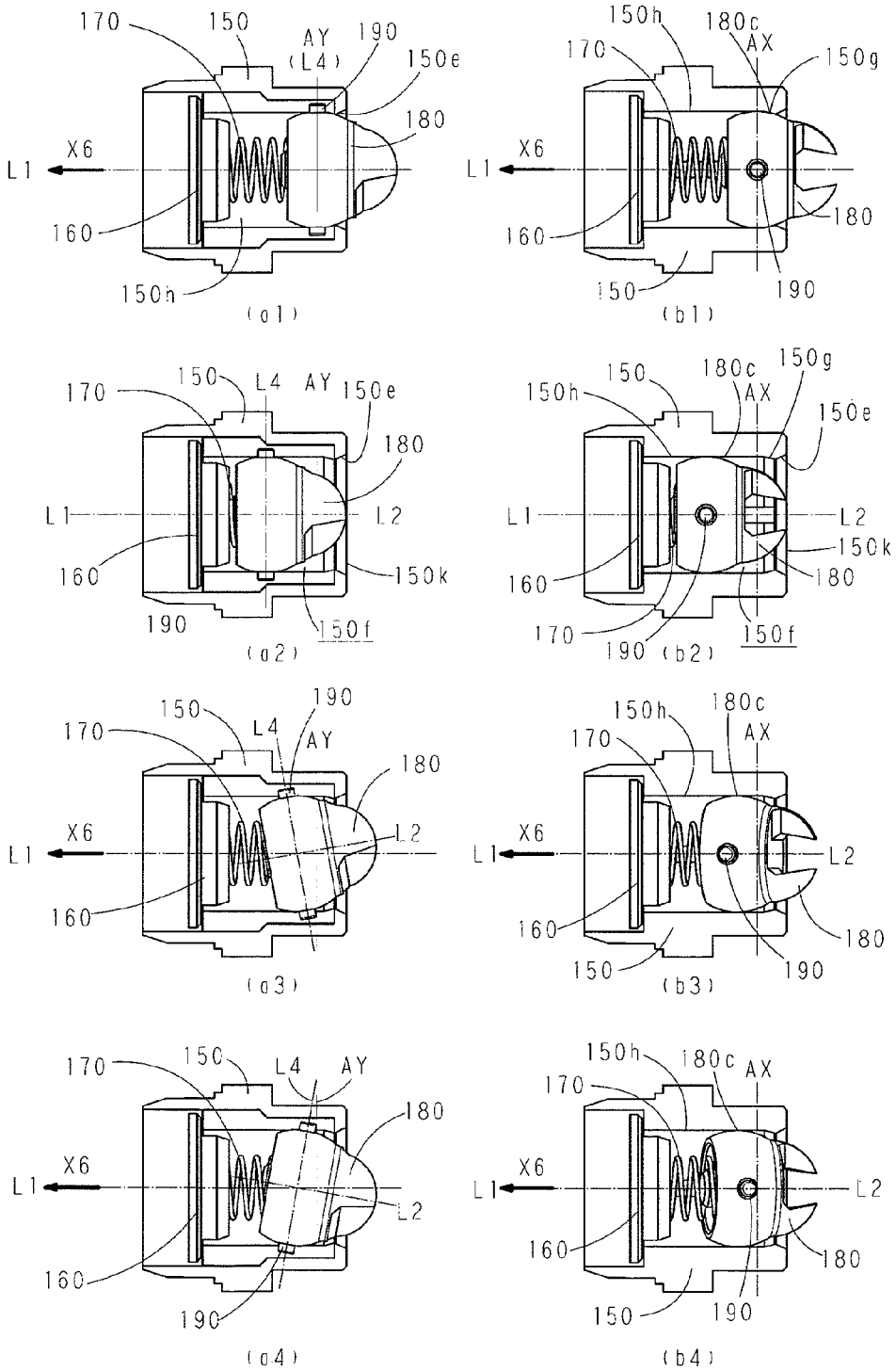
FIG. 21 is a schematic sectional view showing a moving state of the driving side flange of the coupling member relative to an axial direction, according to one embodiment of the present invention.

(6) Operation of the Coupling Member:

Referring to FIG. 18 through FIG. 21, the operation of the coupling member 180 will be described. FIG. 18 is an illustration of the inclination state of the coupling member 180 relative to the driving side flange 150. Parts (a1)-(a5) of FIG. 18 are illustrations of the driving side flange unit U2 as seen from the driving side, and parts (b1)-(b5) of FIG. 18 are perspective sectional views of the driving side flange unit U2. FIG. 19 is an illustration of a state in which the inclination of the coupling member 180 is limited. FIG. 20 is an illustration of another state in which the inclination of the coupling member 180 is limited. Parts (a1)-(a4) of FIG. 21 are views as seen in the direction perpendicular to the axis L2 and the axis L4, and parts (b1)-(b4) of FIG. 21 are views as seen in the direction rotated by 90 degrees about the axis L from the direction of (a1)-(a4) of FIG. 18.

Referring first to FIG. 18, the description will be made as to the structure by which the coupling member 180 is capable of being guided so that the axis L2 of the coupling member 180 can incline (pivot, swing or whirl) in any directions relative to the axis L1 of the flange 150.

Parts (a1) and (b1) of FIG. 18 illustrates the state in which the axis L2 of the coupling member 180 is coaxial with the axis L1 of the driving side flange 150. In this state, an axis perpendicular to the axis L2 and the axis L4 of the drive pin 190 provided in the coupling member 180 is an axis AX, and an axis co-axial with the axis L4 of the drive pin 190 is an axis AY.

Parts (a2) and (b2) of FIG. 18 illustrates a state in which the coupling member 180 is inclined in the direction of an arrow X2 about the axis AX from the state of (a1) and (b1) of FIG. 18. At this time, the axis L4 of the drive pin is inclined relative to the axis AY. The Coupling member 180 is capable of inclining until an end portion 190*a*2 of the drive pin 190 abuts to the groove end portion 150*m* of the driving side flange 150.

Parts (a3) and (b3) of FIG. 18 illustrates a state in which the coupling member 180 is inclined in the direction of an arrow X3 about the axis AY from the state of (a1) and (b1) of FIG. 18. The coupling member 180 is capable of inclining until the coupling member 180 abuts to the opening 150*e* of the driving side flange 150 ((a2) and (b2) of FIG. 19).

Parts (a4) and (b4) of FIG. 18 illustrate a state in which the coupling member 180 is inclined in the direction of an arrow X4 about the axis AX from the state of the (a1) and (b1) of FIG. 18. Parts (a5) and (b5) of FIG. 18 illustrate a state in which the coupling member 180 is inclined in the direction of an arrow X5 about the axis AY from the state of the (a1) and (b1) of FIG. 18. The description of the state of the inclination in the X4 direction applies to the state of the inclination in the X2 direction, and the description of the state of the inclination in the X5 direction applies to the state of the inclination in the X3 direction, and therefore the descriptions are omitted for the sake of simplicity.

Here, as for the direction different from the inclining direction described above, in the direction of an arrow X8 in the (a1) of FIG. 18, for example, the coupling member 180 is capable of inclining in such a direction by combining the inclination about the axis AX and the inclination about the axis AY.

In this manner, the coupling member 180 is rotatable substantially in all directions relative to the axis L1. That is, the coupling member 180 is inclinable in any directions relative to the axis L1.

Furthermore, the coupling member 180 can swing in any directions relative to the axis L1. Furthermore, the coupling member 180 is capable of whirling substantially all directions relative to the axis L1. Here, the rotation of the coupling member 180 is such a motion that the inclined axis L2 rotates about the axis L1.

When the coupling member 180 inclines, the urging force of the urging member 170 is a drag against the inclination of the coupling member 180. Therefore, it is preferable that the urging force of the urging member 170 is minimized, for the purpose of easy inclination of the coupling member 180.

In this embodiment, the structure for limiting the inclination of the coupling member 180 is the abutment between the coupling member 180 or the drive pin 190 and the driving side flange 150, but this is not inevitable, and another structure can be used. For example, as shown in FIG. 20, the spring mounting portion 180*d* of the coupling member 180 may be abutted to the inner wall 150*h* of the driving side flange 150 to limit the inclination of the coupling member 180.

Referring next to FIG. 21, the description will be made as to the structure in which the coupling member 180 is guided so as to be movable along the axis L1 of the driving side flange 150 while inclining.

As shown in parts (a1) and (b1) of FIG. 21, the portion-to-be-guided 180*c* guided by the driving side flange 150 of the coupling member 180 is a part of the spherical shape. The inner wall 150*h* for guiding the coupling member 180 of the driving side flange 150 is an inner surface provided by hollowing it with a circular column. In addition, the coupling member 180 is provided inside of the driving side flange 150 with a fine clearance between the inner wall 150*h* and the portion-to-be-guided 180*c*. By doing so, the coupling member 180 can move in the direction (arrow X6) parallel with the axis L1 of the driving side flange 150. As shown in parts (a2) and (b2) of FIG. 21, the coupling member 180 can move from the opening end portion 150*k* of the flange 150 until it is completely accommodated in the inside space portion 150*f* of the driving side flange 150.

On the other hand, as shown in (a3), (b3), (a4) and (b4) of FIG. 21, the spherical shape portion of the portion-to-be-guided 180*c* is guided by the cylindrical portion of the inner wall 150*h*, and therefore, the coupling member 180 inclines about the center of the portion-to-be-guided 180*c*. At this time, the center of the portion-to-be-guided 180*c* is kept aligned substantially on the axis L1 of the driving side flange 150. Thus, the coupling member 180 can move along the axis L1 in the state that the axis L2 of the coupling member 180 is inclined relative to the axis L1 of the driving side flange 150. At this time, the coupling member 180 can move along the axis L1 in the state that is center of the portion-to-be-guided 180*c* is kept substantially on the axis L1 of the driving side flange 150.

As described in the foregoing, the coupling member 180 is guided so that the axis L2 of the coupling member 180 is capable of inclining (pivoting, swing or whirling) in any direction relative to the axis L1 of the driving side flange 150 and so that it is translatable along the axis. L1 of the driving side flange 150.

Figure 22:
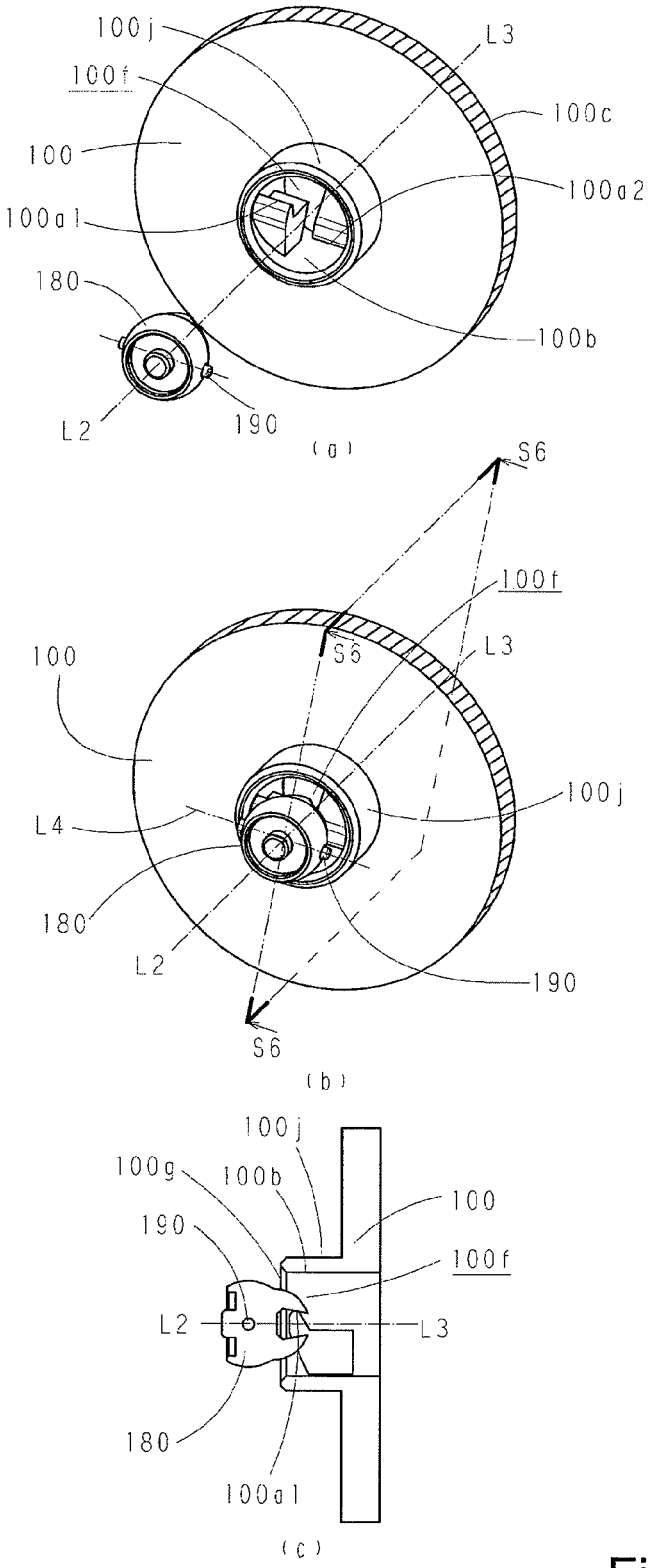
FIG. 22 is a schematic perspective view and the schematic sectional view showing a main assembly side engaging portion according to one embodiment of the present invention.
Figure 23:
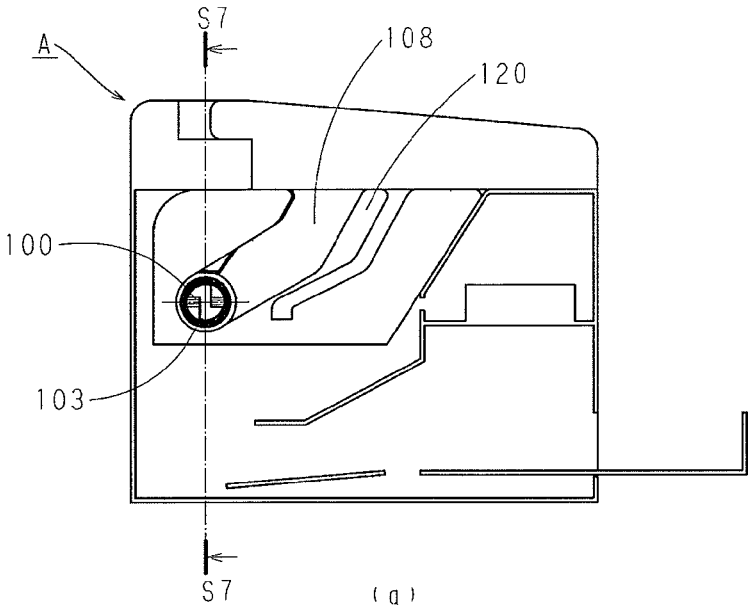
FIG. 23 is an illustration showing a supporting structure for a main assembly side engaging portion according to one embodiment of the present invention.
Figure 23:
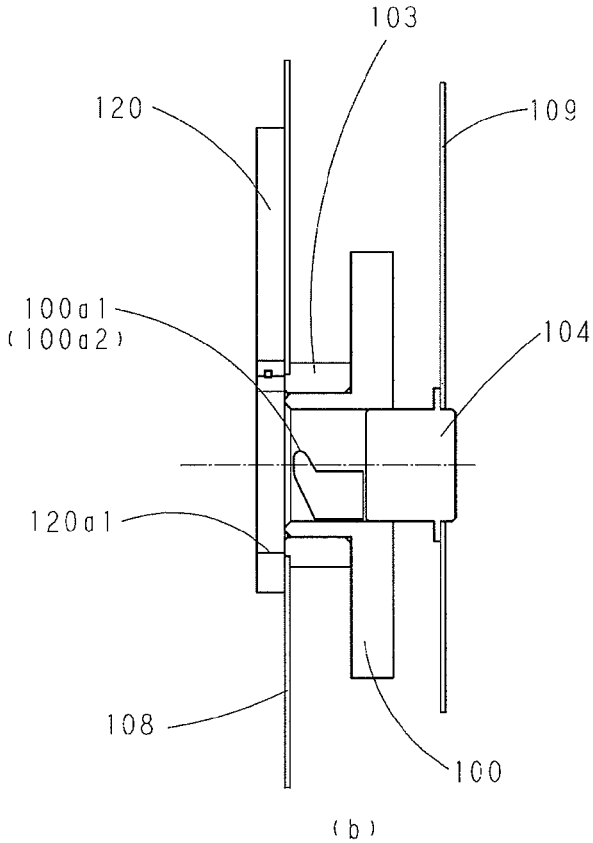

(7) Main Assembly Side Engaging Portion and Drive Structure of the Main Assembly of the Apparatus:

Referring to FIGS. 22 and 23, the description will be made as to the structure for rotating the photosensitive drum 10 in the main assembly A of the apparatus. FIG. 22 is an illustration of the configuration of the main assembly side engaging portion 100. Parts (a) and (b) of FIG. 22 is schematic perspective views of the main assembly side engaging portion 100 of the main assembly A of the apparatus, and part (c) of FIG. 22 is a schematic sectional view taken along a S6 plane of the part (b) of FIG. 22 (taken along the plane including a axis L3 and perpendicular to the axis L4 of the drive pin 190). FIG. 23 is an illustration of a supporting method for the main assembly side engaging portion 100. Part (a) of FIG. 23 is a side view of the driving side of the main assembly A of the apparatus, and part (b) of FIG. 23 is a schematic sectional view showing a supporting structure of the main assembly side engaging portion 100 taken along a line S7-S7 of the part (a).

Here, L3 in FIG. 22 is a rotational axis when the main assembly side engaging portion 100 rotates, and the rotational axis L3 is simply called "axis L3".

As shown in part (a) of FIG. 22, the main assembly side engaging portion 100 has a cylindrical (recess) at the center thereof. The recess inside the cylindrical shape is formed by an inner wall 100*b*. Here, in this embodiment, the space enclosed by the inner wall 100*b* of the main assembly side engaging portion 100 is called "space portion 100*f*". As shown in parts (b) and (c) of FIG. 22, the coupling member 180 enters the space portion 100*f* in the case of rotational force transmission to transmit the rotational force. A rotational force applying portion 100*a*1, 100*a*2 is provided at each of two positions apart in the circumferential direction of the inner wall 100*b*. That is, the rotational force applying portions 100*a*1, 100*a*2 are provided on the inner wall 100*b* of the recess of the main assembly side engaging portion 100. The rotational force applying portions 100*a*1, 100*a*2 are positioned at the positions 180-degrees symmetrical about the axis L3 of the main assembly side engaging portion 100. By the rotational force applying portions 100*a*1, 100*a*2, the rotational force is transmitted to the coupling member 180. Here, the portion of the main assembly side engaging portion 100 excluding the rotational force applying portions 100*a*1, 100*a*2 is called "driving shaft 100*j*".

The driving shaft 100*j* has a cylindrical recess, and the rotational force applying portions 100*a*1 and 100*a*2 are provided on the inner wall 100*b* forming the recess. By doing so, the rotational force applying portions 100*a*1 and 100*a*2 are connected by inner wall 100*b* so that the strength of the rotational force applying portions 100*a*1 and 100*a*2 can be enhanced. Therefore, the main assembly side engaging portion 100 can transmit the rotational force smoothly to the coupling member 180.

In a side opposite the cartridge B side with respect to the axis L3 of the main assembly side engaging portion 100, a drive gear portion 100*c* having the center on the axis L3 is provided. The drive gear portion 100*c* is integrally or unrotatably fixed on the main assembly side engaging portion 100, and when the drive gear portion 100*c* rotates about the axis L3, the main assembly side engaging portion 100 rotates about the axis L3.

Here, as shown in part (c) of FIG. 22, the rotational force applying portions 100*a*1, 100*a*2 enters into the space portion 100*f* beyond the end portion 100 *g* of the opening of the main assembly side engaging portion 100. By this, when the cartridge B is mounted and demounted relative to the main assembly A of the apparatus, it can be avoided that a projected portion or the like of the cartridge B contacts the rotational force applying portions 100*a*1, 100*a*2 with the result of damage such as dent or the like in the rotational force applying portions 100*a*1, 100*a*2.

As shown in parts (a) and (b) of FIG. 23, the main assembly side engaging portion 100 is supported rotatably relative to the main assembly A of the apparatus by bearing members 103, 104. The bearing members 103, 104 are fixed on side plates 108, 109 constituting a casing of the main assembly A of the apparatus. Therefore, the main assembly side engaging portion 100 is positioned correctly at a predetermined position of the main assembly A of the apparatus with respect to the diametrical direction thereof.

Figure 24:
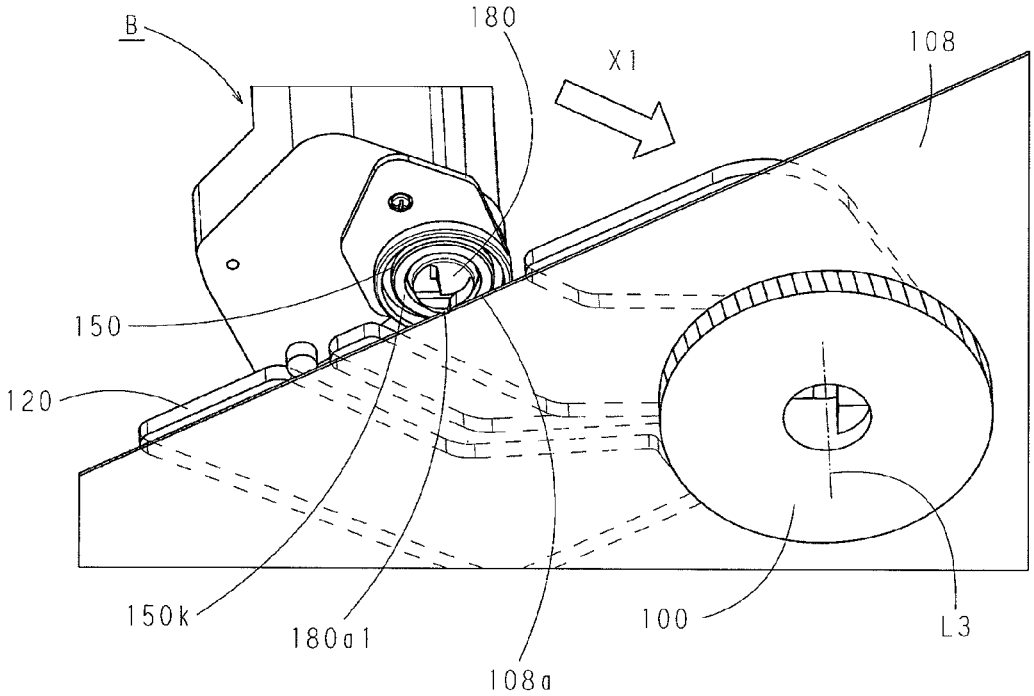
FIG. 24 is a schematic perspective view in midstream of process cartridge mounting as seen from the driving side, according to one embodiment of the present invention.
Figure 25:
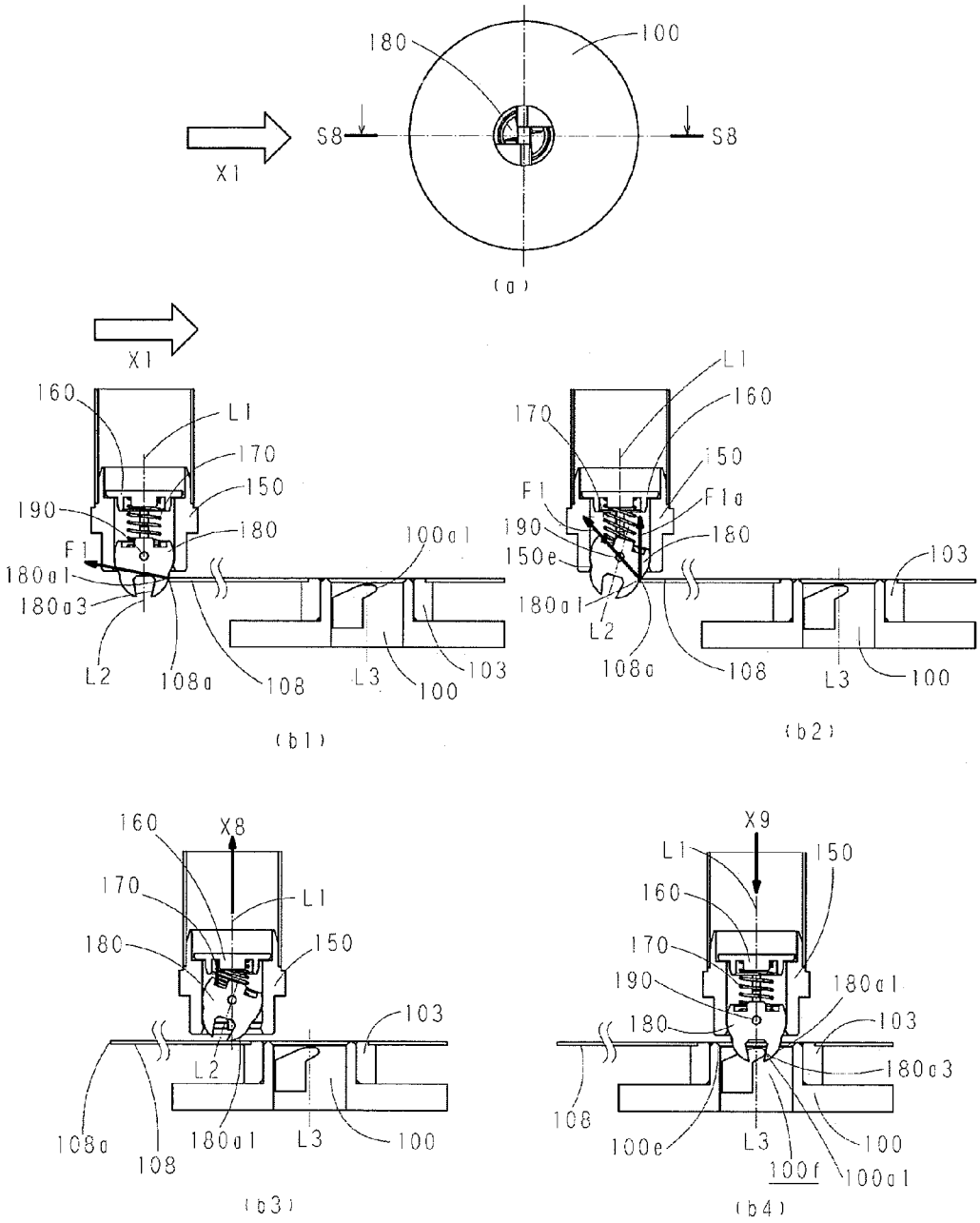
FIG. 25 is an illustration showing an operation state when coupling member is brought into engagement with the main assembly side engaging portion according to one embodiment of the present invention.

(8) Engaging Operation of the Coupling Member:

Referring to FIGS. 24 and 25, the engaging operation of the coupling member 180 will be described. FIG. 24 is a perspective view showing a major part of the driving side of the cartridge B in the state that the cartridge B is mounted to the main assembly A of the apparatus. FIG. 25 is a schematic sectional view when the coupling member 180 is engaging with the main assembly side engaging portion 100. Part (a) of FIG. 25 is an illustration showing mounting direction and the cutting direction of the S8 sectional view. Parts (b1)-(b4) of FIG. 25 are schematic sectional views, taken along a line S8-S8 of the part (a) of FIG. 25, showing engagement of the coupling member 180 with the main assembly side engaging portion 100 while inclining. In the following description, "engagement" is a state in which the axis L1 and the axis L3 are substantially co-axial with each other, and the rotational force can be transmitted from the main assembly side engaging portion 100 to the coupling member 180. Referring to the drawing showing the state in which the rotational force applying portion 100*a*1 and the rotational force receiving portion 180*a*3 are contacted to each other, and the engagement between the main assembly side engaging portion 100 and the coupling member 180 is completed.

As shown in FIG. 24, the cartridge B is moved in the direction (arrow X1) which is substantially perpendicular to the rotational axis of the photosensitive drum 10 and which is substantially perpendicular to the axis L1 of the driving side flange 150. As shown in (b1) of FIG. 25, when the cartridge B starts to mount to the main assembly A of the apparatus, the coupling member 180 is most protruded toward the driving side from the opening end portion 150*k* of the driving side flange 150 by the urging force of the urging member 170. In the state, when the cartridge B is moved in the direction of arrow X1, a main assembly contact portion 180*a*1 of the coupling member 180 contacts a contact portion 108*a* of a side plate 108 of the main assembly A of the apparatus. At this time, a mounting force F1 of the cartridge B is applied to the main assembly contact portion 180*a*1.

When the cartridge B is further moved in the direction of the arrow X1, as shown in (b2) of FIG. 25, coupling member 180 is inclined by the force F1 relative to the axis L1 of the driving side flange 150 in such a direction that the free end portion side (main assembly side engaging portion 100 side) of the coupling member 180 faces upstream (direction of arrow X1). In other words, the axis L2 of the coupling member 180 is inclined by the force F1 in the direction opposite the direction of the arrow X1 relative to the axis L1 of the driving side flange 150. In this embodiment, the coupling member 180 can incline until it abuts to the opening 150*e* of the driving side flange 150.

When the cartridge B is moved further in direction of the arrow X1, the coupling member 180 moves in the direction of an arrow X8 parallel with the axis L1 in the inclined state, as shown in (b3) of FIG. 25, by a component force F1*a* of the force F1 parallel with the axis L1. By this, the coupling member 180 can pass the contact portion 108*a* of the side plate 108.

As shown in (b4) of FIG. 25, when the cartridge B is moved to a mounting completion position, the axis L3 of the main assembly side engaging portion 100 and the axis L1 of the driving side flange 150 become substantially co-axial. At this time, by the urging force of the urging member 170, the coupling member 180 moves in the direction of an arrow X9.

And, the coupling member 180 enters the space portion 100*f* of the main assembly side engaging portion 100. At this time, the main assembly side engaging portion 100 covers the coupling member 180. In this state, the coupling member 180 and the main assembly side engaging portion 100 overlap as seen in the direction perpendicular to the axis L3. Simultaneously, the rotational force receiving portion 180*a*3 is opposed to the rotational force applying portion 100*a*1. In this manner, the coupling member 180 is engaged with the main assembly side engaging portion 100 to enable rotation of the coupling member 180.

In this embodiment, an amount of inclination of the coupling member when the coupling member 180 contacts the opening 150*e* of the driving side flange 150 (angle of the axis L2 relative to the axis L1) is a maximum inclination amount ((b2) of FIG. 25). The maximum inclination amount of the coupling member 180 is limited or set within such a range that when the cartridge B is moved to the mounting completion position, the coupling member 180 can pass the inner surface contact portion 100*e* of the main assembly side engaging portion 100. Therefore, even if the coupling member 180 is most inclined when the cartridge B is placed at the mounting completion position, the coupling member 180 can enter the space portion 100*f* of the main assembly side engaging portion 100. As a result, the coupling member 180 can engage with the main assembly side engaging portion 100.

In this embodiment, as the structure for limiting the maximum inclination amount of the coupling member 180, the structure in which the coupling member 180 contacts the opening 150*e* of the driving side flange 150, but another structure may be used. For example, as described above, the maximum inclination amount of the coupling member 180 may be limited by contacting the spring mounting portion 180*d* of the coupling member 180 to the inner wall 150*h* of the driving side flange 150.

When the cartridge B is moved to the mounting completion position, the main assembly contact portion 180*a*1, 180*b*1 and the rotational force applying portion 100*a*1, 100*a*2 may contact to each other in the direction of the axis L3, depending on the phases of the coupling member 180 and the main assembly side engaging portion 100 in the rotational moving direction. In this case, the coupling member 180 can not enter the space portion 100*f*. However, by rotation of the main assembly side engaging portion 100 by a driving source which will be described hereinafter, the main assembly contact portion 180*a*1, 180*b*1 and the rotational force applying portion 100*a*1, 100*a*2 becomes out of contact from each other in the direction of the axis L3. Then, by the urging force of the urging member 170, the main assembly contact portion 180*a*1, 180*b*1 can enter the space portion 100*f*. As a result, the main assembly side engaging portion 100 can engage with the coupling member 180 while being rotated by the driving source, by which the coupling member 180 starts to rotate.

Thus, upon mounting of the cartridge B to the main assembly A of the apparatus, the main assembly side engaging portion 100 can engage with the coupling member 180 irrespective of the phase relation in the rotational moving direction between the coupling member 180 and the main assembly side engaging portion 100.

As described in the foregoing, according to the structure of this embodiment, the coupling member 180 and the main assembly side engaging portion 100 can be engaged with a simple structure without a complicated structure in the main assembly A of the apparatus and/or the cartridge B.

Figure 26:
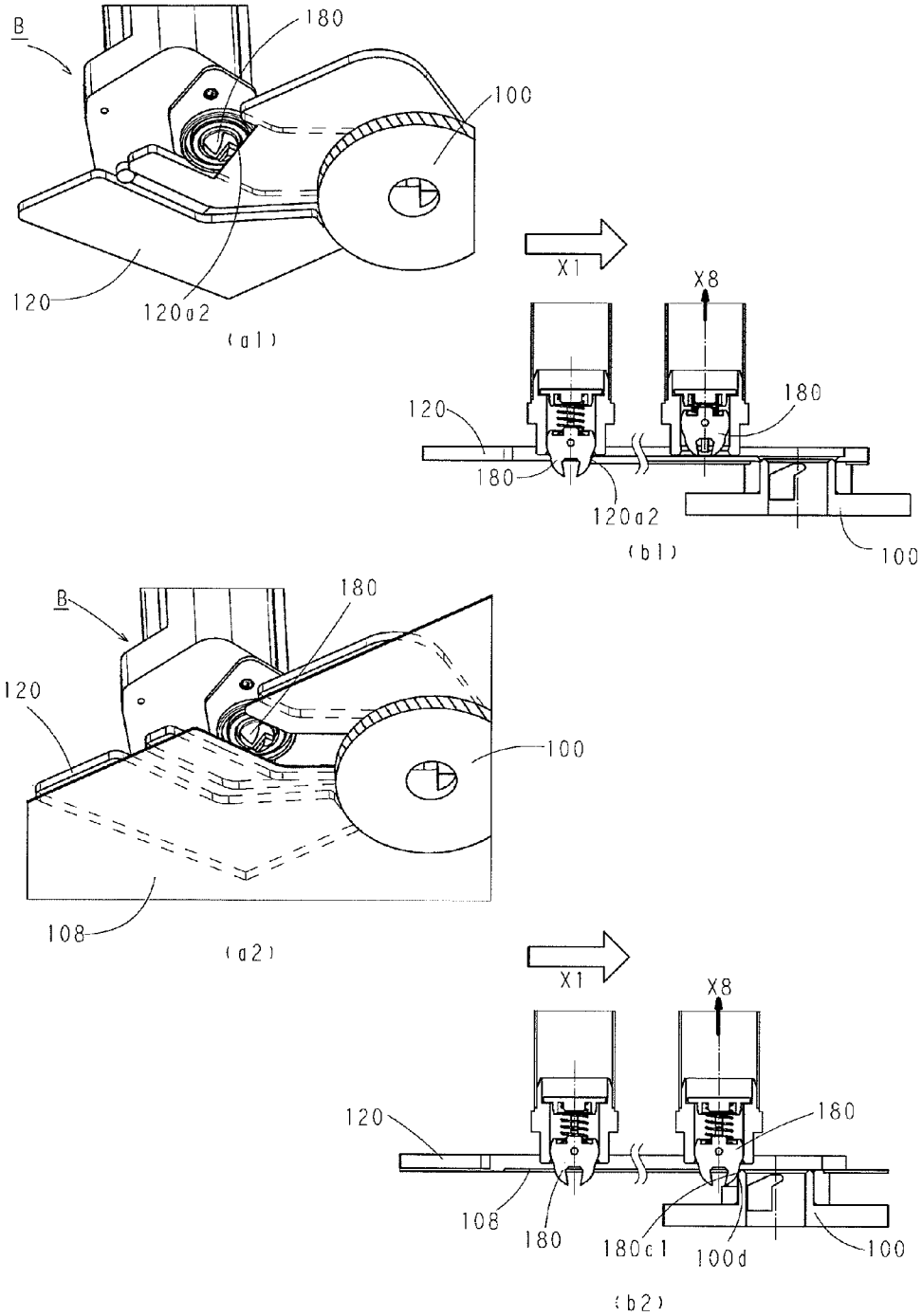
FIG. 26 is an illustration showing a means for moving the coupling member relative to an axial direction of the driving side flange, according to one embodiment of the present invention.

In this embodiment, the structure for moving the coupling member 180 in the direction X8 parallel with the axis L1 uses the contact of the coupling member 180 to the side plate 108 of the main assembly A of the apparatus, but this is not inevitable. For example, as shown in (a1) and (b1) of FIG. 26, a contact portion 120*a*2 is provided on the first guide portion 120*a* of the driving side guiding member 120. And, in the process of mounting of the cartridge B, the coupling member 180 abuts to the contact portion 120*a*2 to move the coupling member 180 in the direction of the arrow X8. This is a possible alternative. As shown in (a2) and (b2) of FIG. 26, in the process of mounting of the cartridge B, the coupling member 180 is abutted to the engaging portion 100 to move the coupling member 180 in the direction of an arrow X8. This is another possible alternative. At this time, the side plate 108 of the main assembly A of the apparatus and/or the driving side guiding member 120 is cut away along a mounting-and-demounting path of the cartridge B, and therefore, there is no part to which the coupling member 180 contacts except for the main assembly side engaging portion 100, in the process of mounting of the cartridge B. Therefore, the dent and/or wearing or the like due to abutment of the coupling member 180 to the other part can be reduced. Furthermore, the above-described structure of moving coupling member 180 in the direction of the arrow X8 may be combined.

In this embodiment, the contact portion 108*a* of the side plate 108 shown in FIG. 24 has an edge-like, but the contact portion 108*a* may be beveled or rounded. By this, in the movement of the cartridge B in the direction of the arrow X1, the coupling member 180 is easily moved in the direction of the arrow X8. As a result, a usability performance upon mounting of the cartridge B to the main assembly A of the apparatus is improved. In addition, the damage, dent or the like on the coupling member 180 and/or side plate 108 due to the contact between the main assembly contact portion 180*a*1 and the contact portion 108*a* can be reduced.

Figure 27:
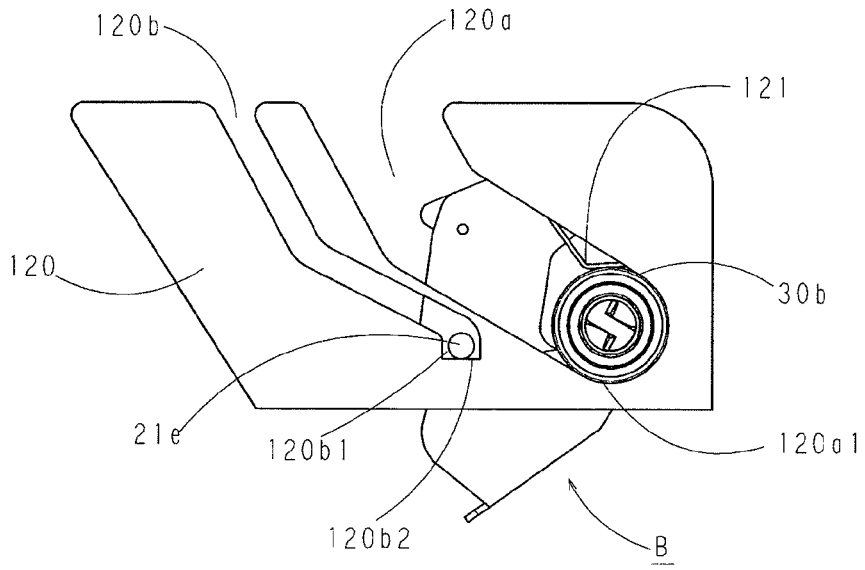
FIG. 27 is an illustration when the process cartridge mounting is completed, according to one embodiment of the present invention.
Figure 27:
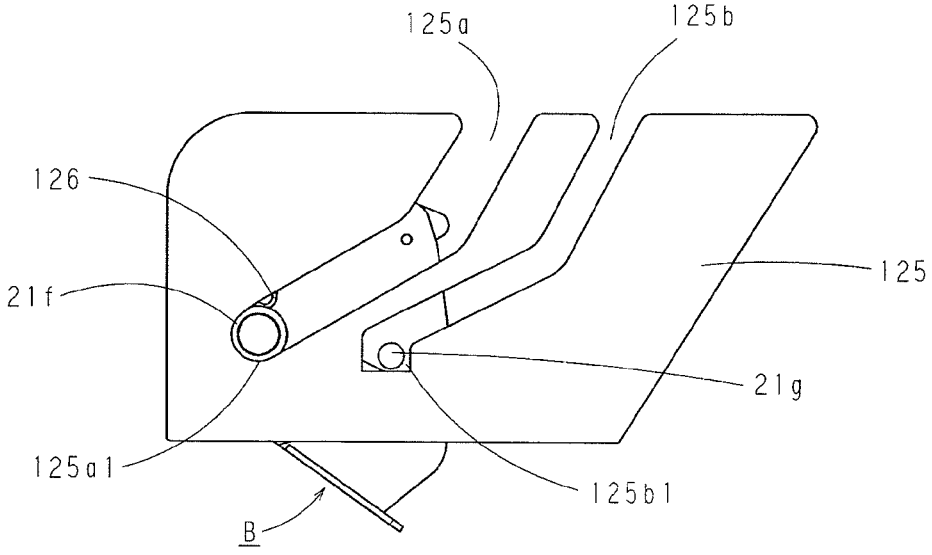
Figure 28:
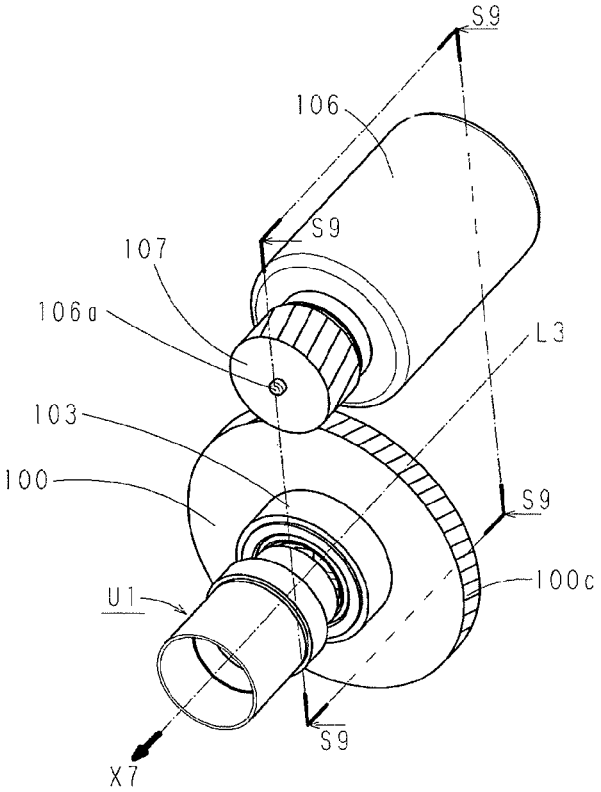
FIG. 28 is a schematic perspective view and a schematic sectional view showing a driving structure of the main assembly of the electrophotographic image forming apparatus and the photosensitive drum unit according to one embodiment of the present invention.
Figure 28:
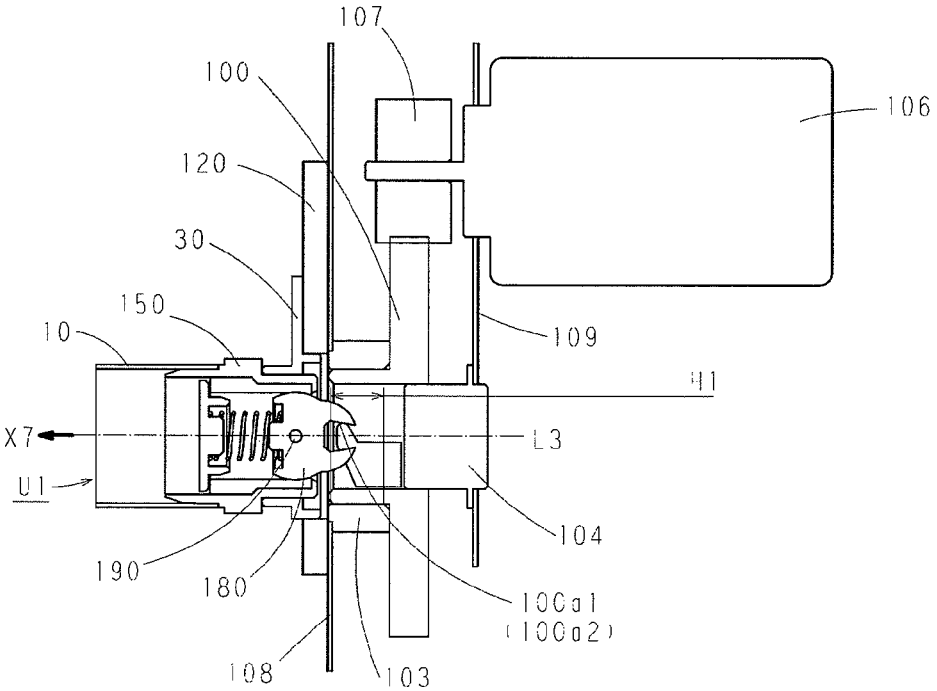
Figure 29:
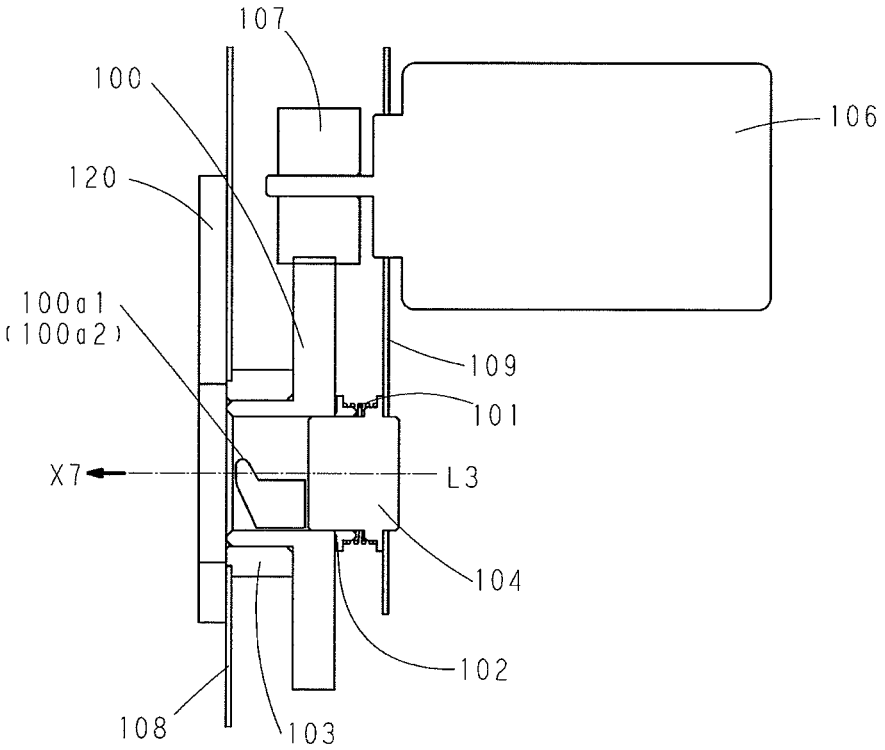
FIG. 29 is a schematic sectional view showing an urging means of the main assembly side engaging portion according to one embodiment of the present invention.
Figure 30:
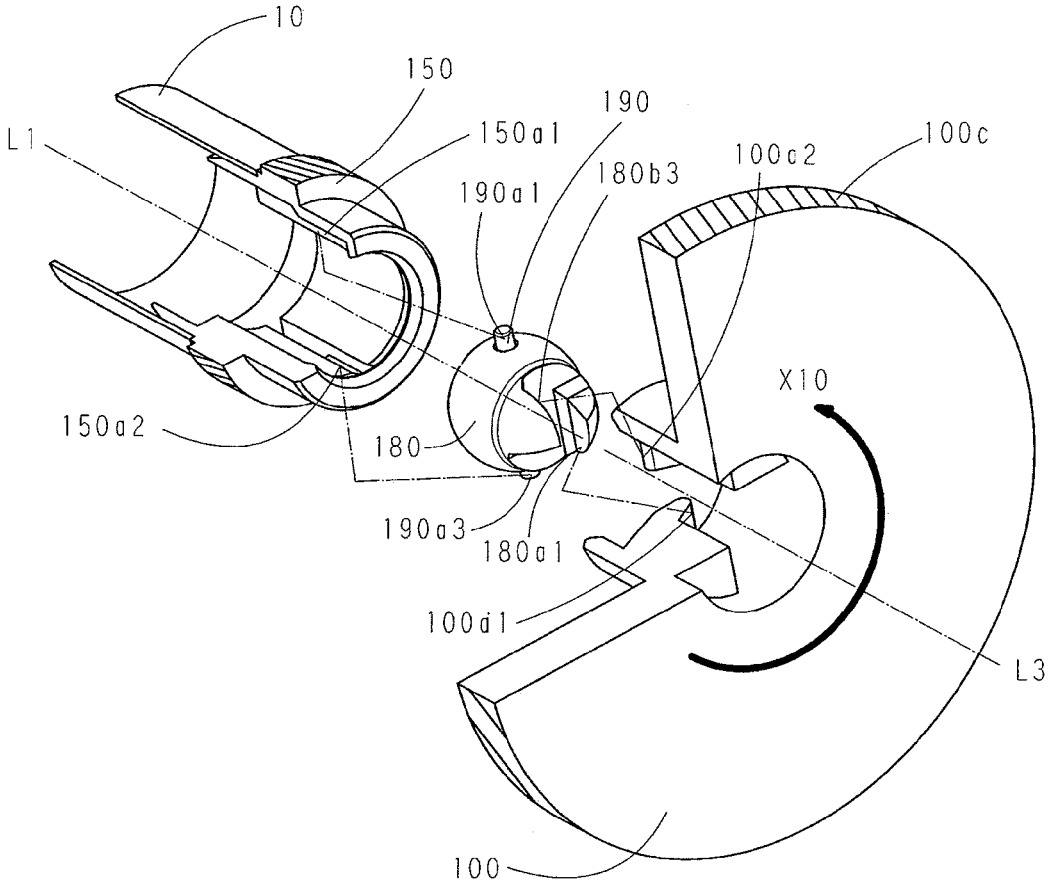
FIG. 30 is a perspective sectional view showing a rotational force transmission path, according to one embodiment of the present invention.
Figure 31:
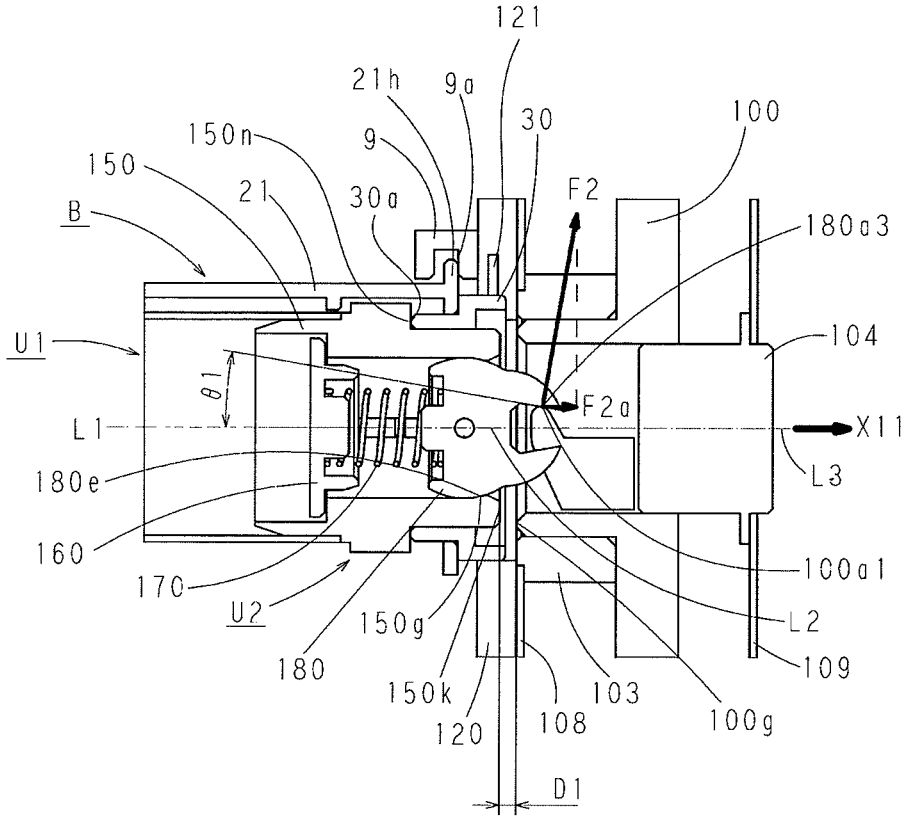
FIG. 31 is an illustration showing a positioning state of the photosensitive drum unit relative to the main assembly side engaging portion according to one embodiment of the present invention.

(9) Rotational Force Transmitting Operation of Coupling:

Referring to FIG. 27 through FIG. 31, the rotational force transmitting operation for rotating the photosensitive drum 10 will be described. FIG. 27 is an illustration of the mounting completion position of the cartridge B. Part (a) of FIG. 27 is a view as seen from the driving side, part (b) of FIG. 27 is a view as seen from the non-driving side. FIG. 28 is a schematic perspective view of a driving structure of the main assembly A of the apparatus. Part (a) of FIG. 28 is a schematic perspective view of a drive transmission path, and part (b) of FIG. 28 is a schematic sectional view taken along a plane S9 of the part (a) of FIG. 28. FIG. 29 is an illustration showing another type of the urging means of the main assembly side engaging portion 100. FIG. 30 is a perspective sectional view showing a rotational force transmission path. FIG. 31 is an illustration shows a position of the photosensitive drum unit U1 relative to the main assembly side engaging portion 100.

First, the description will be made as to the positioning of the cartridge B relative to the main assembly A of the apparatus in the rotational force transmission. When the cartridge B is placed in the mounting completion position, as shown in FIG. 27, driving side portion-to-be-supported 30*b* and the non-driving side portion-to-be-supported 21*f* are accommodated in a cartridge positioning portions 120*a*1 and 125*a*1 at the terminal ends of a first guide portion 120*a* and a second guide portion 125*a*, respectively. And, the driving side portion-to-be-supported 30*b* is urged to the cartridge positioning portion 120*a*1 by a driving side urging spring 121. Similarly, the non-driving side portion-to-be-supported 21*f* is urged to a cartridge positioning portion 125*a*1 by a non-driving side urging spring 126. By this, the position of the cartridge B relative to main assembly A of the apparatus is kept. At this time, the rotation preventing portion 21*e* is accommodated in a rotational position regulating portion 120*b*1 formed at the terminal end of a lower guide portion 120*b* and contacts to a rotational position regulation surface 120*b*2. On the other hand, the non-driving side guide portion 21 *g* is accommodated in an accommodating portion 125*b*1 formed at the terminal end of a lower guide portion 125*b*.

In this manner, the cartridge B is positioned at the cartridge positioning portions 120*a*1, 125*a*1 of the main assembly A of the apparatus.

The rotational force transmitting operation for rotating the photosensitive drum 10 will be described.

As shown in part (a) and (b) of FIG. 28, a motor 106 which is a driving source of the main assembly A of the apparatus is fixed to a side plate 109 which is a part of the casing of the main assembly A of the apparatus, and is provided with a co-axial pinion gear 107 which rotates integrally with the motor 106. As described above, the main assembly side engaging portion 100 is positioned correctly at a predetermined position of the main assembly A of the apparatus in the diametrical direction, and the pinion gear 107 is engaging with the drive gear portion 100*c*. Therefore, when the motor 106 rotates, the main assembly side engaging portion 100 is rotated through the drive gear portion 100*c*.

In this embodiment, the drive gear portion 100*c* is driven directly by the pinion gear 107, but this is not inevitable. For example, a plurality of gears may be provided between the drive gear portion 100*c* and the pinion gear 107. In addition, the rotational force may be transmitted using a belt or the like from the pinion gear 107 to the drive gear portion 100*c*.

The main assembly side engaging portion 100 is positioned so that during the rotational force transmission of the main assembly side engaging portion 100, the positions of the rotational force applying portions 100*a*1, 100*a*2 in the direction of the axis L3 is within a supporting range of the bearing member 103 (within the contact region). Here, the supporting range (contact region) of the bearing member 103 is a range in which the bearing member 103 and the main assembly side engaging portion 100 are contacted with each other when the bearing member 103 supports the main assembly side engaging portion 100 rotatably. By this, during the rotational force transmission, the axis tilting of the main assembly side engaging portion 100 due to the load applied to the main assembly side engaging portion 100 can be suppressed. Therefore, rotation non-uniformity of the main assembly side engaging portion 100 attributable to the axis tilting can be suppressed, so that the rotational force is transmitted smoothly from the main assembly side engaging portion 100 to the coupling member 180. Then, the photosensitive drum 10 can be rotated with high accuracy.

Furthermore, the drive gear portion 100*c* and the pinion gear 107 are engaged by helical gear engagement. A twist angle and direction of the helical gears are so selected that when the motor 106 rotates, the main assembly side engaging portion 100 is urged in the direction of an arrow X7 parallel with the axis L3 by the rotational force. By this, the position of the main assembly side engaging portion 100 in the direction of the axis L3 relative to the main assembly A of the apparatus can be determined. Then, the amount engagement between the main assembly side engaging portion 100 and the coupling member 180 which will be described hereinafter can be maintained constant.

In this embodiment, the helical gears are used as the urging means for main assembly side engaging portion 100 in the direction of the arrow X7 but this is not inevitable. For example, as shown in FIG. 29, an urging spring 101 and a spring receiving member 102 may be provided between the main assembly side engaging portion 100 and the side plate 109 to urge the main assembly side engaging portion 100 in the direction of the arrow X7. In addition, using both of the helical gear and the urging spring 101, the main assembly side engaging portion 100 may be urged in the direction of the arrow X7.

As shown in FIG. 30, the main assembly side engaging portion 100 is rotated in the direction of X10 in the Figure by the rotational force received from the motor 106 which is the driving source. The rotational force applying portions 100*a*1, 100*a*2 of the main assembly side engaging portion 100 contact the rotational force receiving portions 180*a*3, 180*b*3 of the coupling member 180, respectively. By doing so, is rotational force of the main assembly side engaging portion 100 is transmitted to the coupling member 180. By the rotation of the coupling member 180, the end portions 190*a*1, 190*a*2 of the drive pin 190 contact the rotational force transmitted portions 150*a*1, 150*a*2 of the driving side flange 150.

As described in the foregoing, the rotational force of the main assembly side engaging portion 100 is transmitted to the photosensitive drum 10 through the coupling member 180, the drive pin 190, and the driving side flange 150 to rotate the photosensitive drum 10.

Here, in this embodiment, upon the rotational force transmitting operation, the main assembly side engaging portion 100 is positioned at the predetermined position in the main assembly A of the apparatus in the diametrical direction. The driving side flange 150 is also positioned at the predetermined position of the main assembly A of the apparatus through the cartridge B in the diametrical direction. And, by the coupling member 180, the main assembly side engaging portion 100 positioned at the predetermined position and the driving side flange 150 positioned at the predetermined position are connected. In the case that the main assembly side engaging portion 100 and the driving side flange 150 are positioned so that the axis L1 and the axis L3 are substantially co-axial with each other, the coupling member 180 rotates substantially without the inclination. Therefore, the main assembly side engaging portion 100 can transmit the rotational force smoothly to the photosensitive drum 10 through the coupling member 180.

On the other hand, depending on the variation of the part dimensions or the like, the axis L1 and the axis L3 may be deviated slightly from the co-axial relation. Even in such a case, by the coupling member 180 rotating with the inclination (pivoting, swing and/or rotation) of the axis L2 relative to the axis L1, the coupling member 180 can transmit the rotational force from the main assembly side engaging portion 100 to the driving side flange 150. At this time the coupling member 180 can rotate without imparting a large load to the driving side flange 150 and to the main assembly side engaging portion 100.

The description will be made as to the positioning of the photosensitive drum unit U1 relative to the main assembly of the apparatus in the direction of the axis L3 in this embodiment. For the purpose of simplification of the description, the rotational force receiving portion 180*a*3 side is taken, and the description about the rotational force receiving portion 180*b*3 side is omitted since the same applies to the rotational force receiving portion 180*b*3.

As shown in FIG. 31, the rotational force receiving portion 180*a*3 of the coupling member 180 is inclined by an angle θ1 relative to the axis L2 of the coupling member. The inclination θ1 is so selected that a direction of the component force F2*a*, parallel with the axis L3, of the rotational force F2 applied to the rotational force receiving portion 180*a*3 from the rotational force applying portion 100*a*1 is parallel with an arrow X11 of the axis L3. In addition, the same applies to a rotational force receiving portion 100*b*3.

When the rotational force F2 is applied to the rotational force receiving portion 180*a*1 from the rotational force applying portion 100*a*1, the coupling member 180 is moved in the direction of the arrow X11 by the urging force of the urging member 170 and the component force F2*a*. And, the portion-to-be-contacted 180*e* of the coupling member 180 contacts to the contact portion 150 *g* of the driving side flange 150. Furthermore, by the rotational force F2, the U2 and the photosensitive drum unit U1 is moved in the direction of the arrow X11. When the photosensitive drum unit U1 is moved in the direction of the arrow X11, a contact portion 150*n* of the driving side flange 150 and a contact portion 30*a* are contacted to each other so that the drum bearing 30 and the cleaning frame 21 move in the direction of the arrow X11. Therefore, the cartridge B also moves in the direction of the arrow X11.

Thereafter, in the direction of the axis L3, a regulating portion 21*h* of the cleaning frame 21 contacts to a driving side end portion 9*a* of a longitudinal direction regulating portion 9 for the cartridge provided in the main assembly A of the apparatus. By this, the photosensitive drum unit U1 is positioned through the drum bearing 30 and the cleaning frame 21 in the direction of the axis L3 relative to the main assembly A of the apparatus. At this time, the photosensitive drum unit U1 rotates while keeping a clearance D1 between the end portion 100 *g* of the opening of the main assembly side engaging portion 100 and the end portion 150*k* of the opening of the driving side flange 150.

In place of the cleaning frame 21, the drum bearing 30 or the like may be contacted to the driving side end portion 9*a* of the longitudinal direction regulating portion 9 for the cartridge provided in the main assembly A of the apparatus to determine the position of the photosensitive drum unit U1 in the direction of the axis L3.

Here, the overlapping amount between the coupling member 180 and the main assembly side engaging portion 100 in the direction of the axis L3 in a state that the coupling member 180 receives the rotational force from the main assembly side engaging portion 100. And, an amount through which the coupling member 180 is translatable away from the main assembly side engaging portion 100 along the axis L1 without inclination relative to the axis L1 of the driving side flange 150, from the position where the coupling member 180 receives the rotational force from the main assembly side engaging portion 100, is called "translatable amount". The translatable amount is larger than the engagement amount (overlying amount) in the state that the coupling member 180 receives the rotational force from the main assembly side engaging portion 100. With such a structure, the engaging operation between the coupling member 180 and the main assembly side engaging portion 100 at the time of mounting of the cartridge B is easy, and the structure for the engagement is simplified.

The inclination θ1 is set so that the rotational force F2 can move the coupling member 180, the photosensitive drum unit U1 and the cartridge B in the direction of X11 of the axis L3. In this case, in the state that the coupling member 180 receives the rotational force, the portion-to-be-contacted 180*e* of the coupling member 180 keeps in contact with the contact portion 150 *g* of the driving side flange 150. Therefore, it does not occur that the coupling member 180 moves along the axis L1 while rotating. For this reason, the rotational force can be transmitted from the main assembly side engaging portion 100 to the driving side flange 150 with high accuracy. However, when there is provided another means for moving the coupling member 180, the photosensitive drum unit U1 and the cartridge B in the direction X11 of the axis L3, the inclination θ1 may be small. For example, in the non-driving side of the second frame unit 19, an urging member may be provided between the photosensitive drum unit U1 and the second frame unit 19, and an urging member may be provided between the cartridge B and the main assembly A of the apparatus. By the urging forces of such urging members, the photosensitive drum unit U1 is moved in the direction X11 of the axis L3.

In the state that the coupling member 180 receives the rotational force, the spherical surface of the portion-to-be-contacted 180*e* is kept in contact with the conical surface of the contact portion 150*g*, and therefore, the center of the spherical shape of the portion-to-be-guided 180*c* is kept on the axis L1. Thus, even if the coupling member 180 rotates in the inclined state, the center of the spherical shape of the portion-to-be-contacted 180*e* does not change. For this reason, the rotational force can be transmitted from the main assembly side engaging portion 100 to the driving side flange 150 with high accuracy.

Here, in order for the coupling member 180 to transmit the rotational force smoothly to the photosensitive drum 10 when the coupling member 180 receives the rotational force in the state that the axis L2 of the coupling member 180 is inclined (pivoted, swung, whirled), the inclining operation of the coupling member 180 is smooth. Therefore, it is effective for the purpose of the smooth inclining operation of the coupling member 180 that the urging force of the urging member 170 is minimized using the above-described structure for limiting the inclination amount of the coupling member 180.

Figure 32:
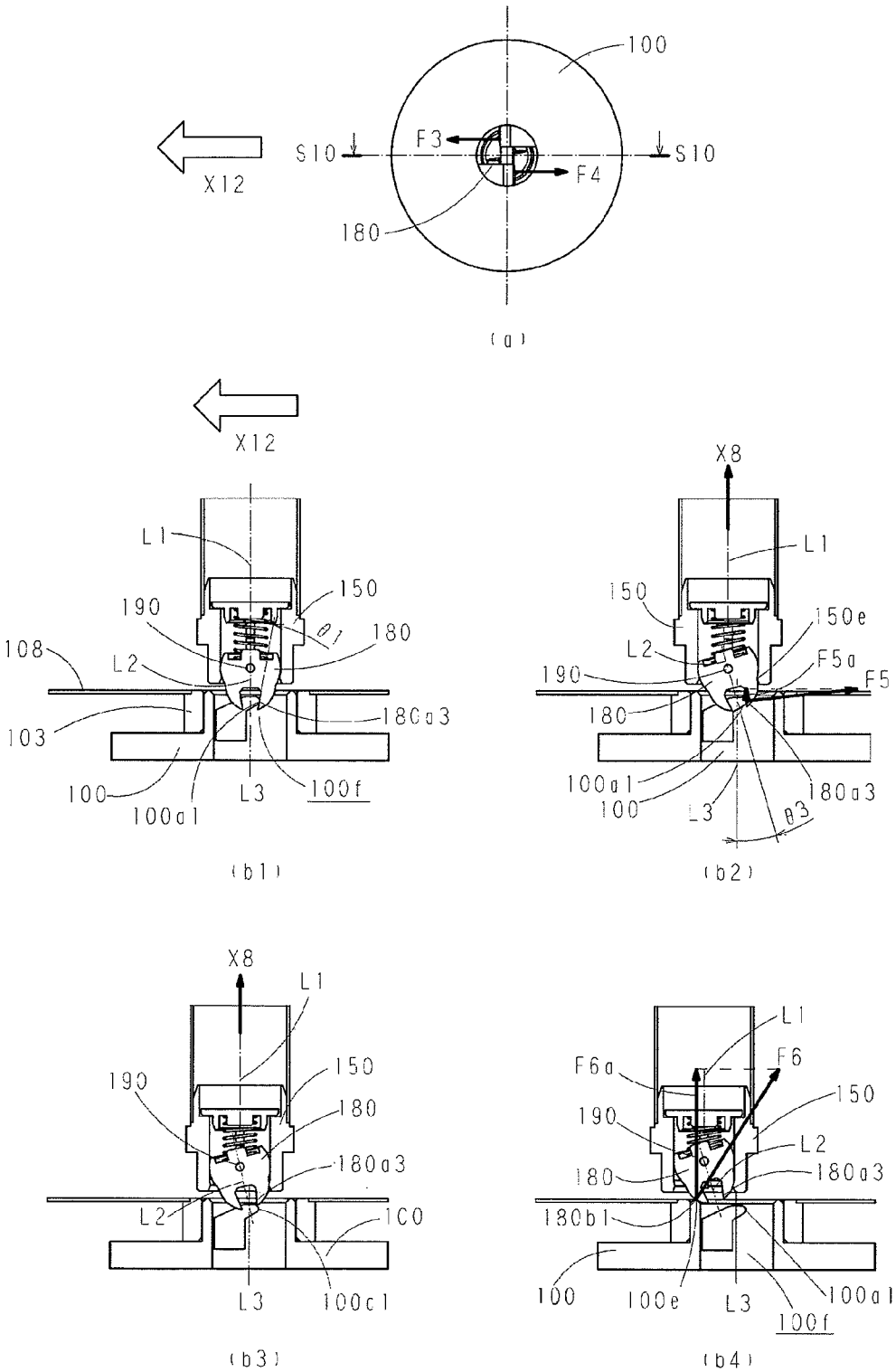
FIG. 32 is an illustration showing an operation state when the coupling member is disengaged from the main assembly side engaging portion, according to one embodiment of the present invention.
Figure 33:
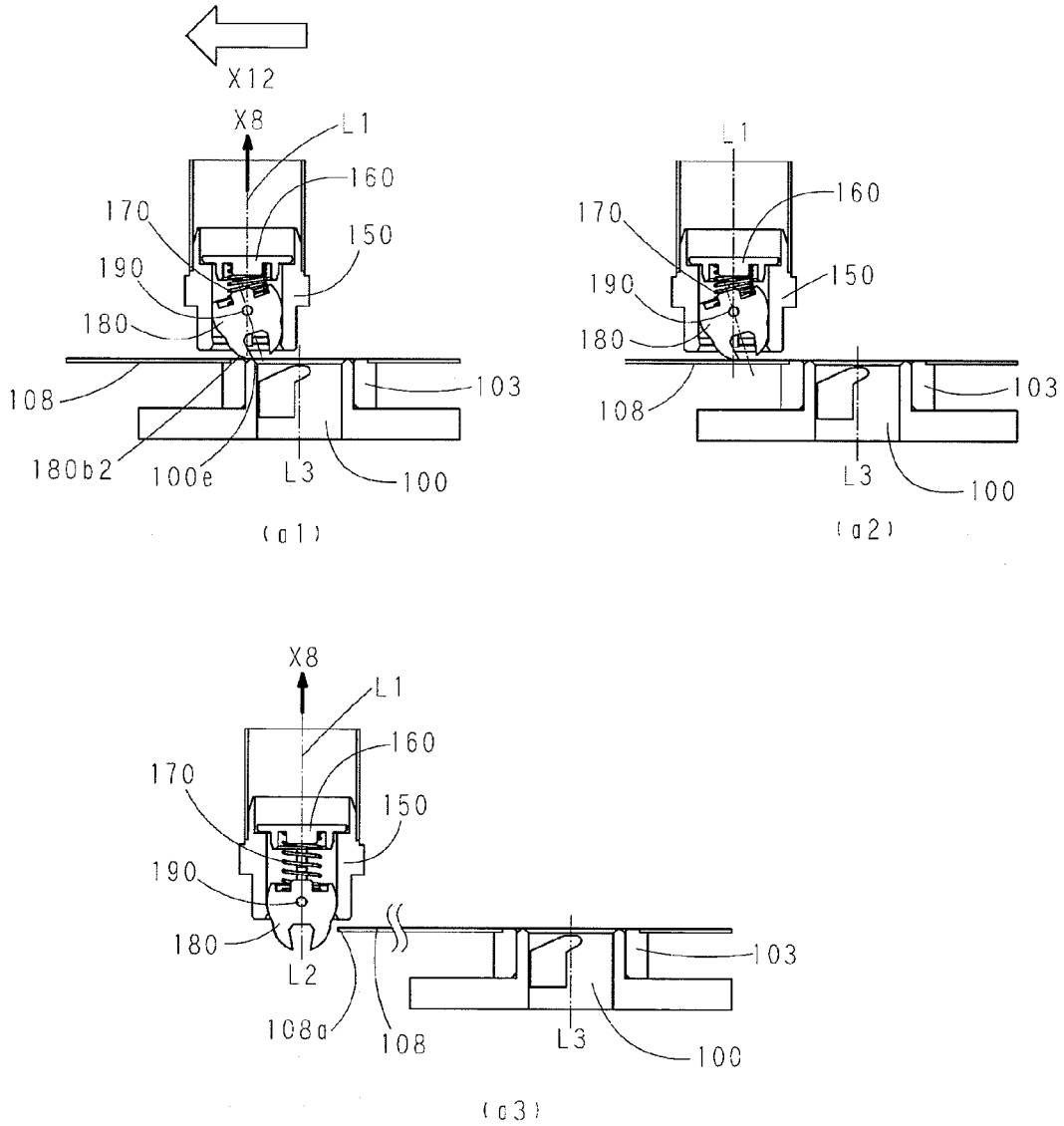
FIG. 33 is an illustration showing an operation state when the coupling member is disengaged from the main assembly side engaging portion, according to one embodiment of the present invention.
Figure 34:
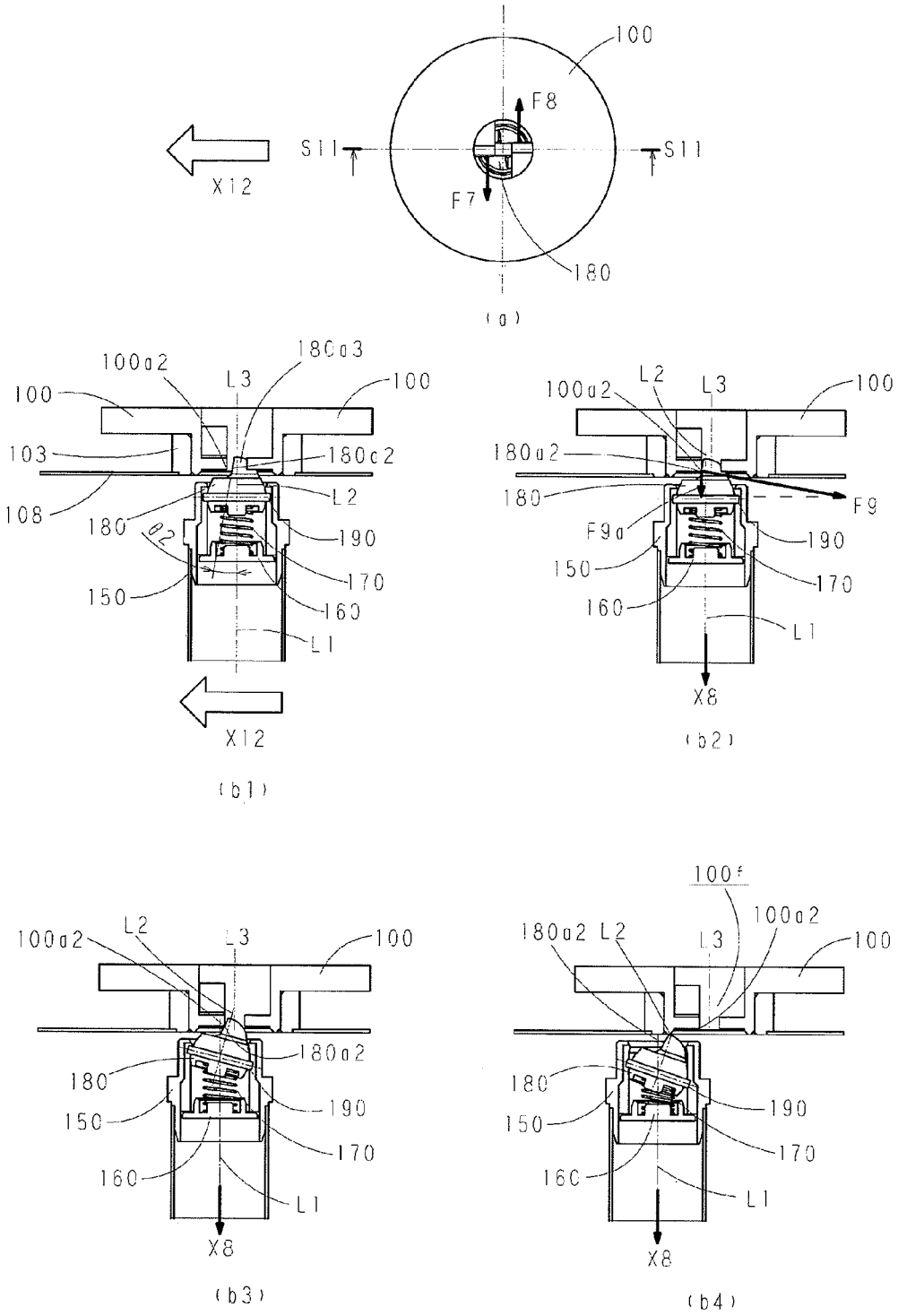
FIG. 34 is an illustration showing an operation state when the coupling member is disengaged from the main assembly side engaging portion, according to one embodiment of the present invention.

(10) Disengaging Operation of the Coupling with the Dismounting Operation of the Cartridge:

Referring to FIG. 32 to FIG. 34, the description will be made as to the operation of disengaging the coupling member 180 from the main assembly side engaging portion 100 when the cartridge B is dismounted from the main assembly A of the apparatus. Part (a) of FIG. 32 and part (a) of FIG. 34 are illustrations showing a removing direction of the cartridge B and cutting directions S10 and S11. Parts (b1)-(b4) and (a1)-(a3) of FIG. 32 are schematic sectional views taken along a line S10-S10 of the part (a) of FIG. 32 and showing a disengaging state of the coupling member 180 from the main assembly side engaging portion 100. Parts (b1)-(b4) of FIG. 34 are schematic sectional views taken along a line S11-S11 of the part (a) of FIG. 34 and showing a disengaging state of the coupling member 180 from the main assembly side engaging portion 100. The description will be made taking the views showing the rotational force receiving portion (180*a*3) side.

First, the description will be made as to the case in which directions of the rotational forces F3, F4 received from the rotational force applying portion 100*a*1 and 100*a*2 by the rotational force receiving portions 180*a*3, 180*b*3 are parallel with the removing direction (arrow X12) of the cartridge B, as shown in part (a) of FIG. 32.

As shown in (b1) of FIG. 32, the cartridge B is moved in the removing direction X12 which is substantially perpendicular to the rotational axis of the photosensitive drum 10 and substantially perpendicular to the axis L1 of the driving side flange 150, so that it is dismounted from the main assembly A of the apparatus. In the state that the image formation is completed and the rotation of the main assembly side engaging portion 100 stops, the rotational force applying portions 100*a*1, 100*a*2 are in contact with the rotational force receiving portion 180*a*3, 180*b*3, respectively. As seen in the direction opposite the removing direction X12 of the cartridge B, the rotational force receiving portion 180*a*3 is placed behind the rotational force applying portion 100*a*1. In this embodiment, the portions except for the rotational force receiving portions 180*a*3, 180*b*3 of the coupling member 180 are not in contact with the main assembly side engaging portion 100. More particularly, when the rotational force receiving portion 180*a*3 receives the rotational force from the rotational force applying portion 100*a*1, the driving side flange 150 positions the coupling member 180, by which a clearance exists between the portions of the coupling member 180 except for the rotational force receiving portion 180*a*3 and the portions of the main assembly side engaging portion 100 except for the rotational force applying portion 100*a*1.

Then, the cartridge B is moved in the removing direction X12. At this time, the rotational force receiving portion 180*a*3 which is upstream of the coupling member 180 with respect to the removing direction receives a force F5 from the rotational force applying portion 100*a*1 by the dismounting of the cartridge B. By doing so, the axis L2 of the coupling member 180 inclines toward the upstream relative to the axis L1 with respect to the removing direction X12. At this time, the portions of the coupling member 180 except for the rotational force receiving portions 180*a*3, 180*b*3 do not contact the main assembly side engaging portion 100. Therefore, the user can move the cartridge B in the removing direction X12 with a small force.

And, as shown in (b2) of FIG. 32, the coupling member 180 inclines until it contacts the opening 150*e* of the driving side flange 150. At this time, the coupling member 180 is inclined by an angle θ3. The angle θ3 is larger than the above-described inclination θ1 of the rotational force receiving portion 180*a*3, 180*b*3. By this, a component force F5*a* of the force F5 parallel with the axis L1 is in the direction of the arrow X8.

When the cartridge B is further moved in the removing direction X12, as shown in (b3) of FIG. 32, the coupling member 180 moves in the direction (arrow X8) parallel with the axis L1 against the urging force of the urging member 170 by the component force F5*a*. By doing so, rotational force receiving portion 180*a*3 passes by the rotational force applying portion 100*a*1.

When the cartridge B is moved further in the removing direction X12, as shown in (b4) of FIG. 32, the main assembly contact portion 180*b*1 of the coupling member 180 is brought into contact to the contact portion 100*e* of the inner surface of the main assembly side engaging portion 100. At this time, the main assembly contact portion 180*b*1 receives a force F6 from the inner surface contact portion 100*e* by the dismounting of the cartridge B. Here, the main assembly contact portion 180*b*1 is inclined relative to the removing direction X12 so that the component force F6*a* parallel with the axis L1 is in the direction arrow X8. Therefore, the coupling member 180 moves in the direction of the arrow X8 against the urging force of the urging member 170 while the main assembly contact portion 180*b*1 is in contact with the inner surface contact portion 100*e*. And, the rotational force receiving portion 180*a*3 disengages from the space portion 100*f* of the main assembly side engaging portion 100.

More particularly, as seen in the direction opposite the removing direction X12 of the cartridge B, the rotational force receiving portion 180*a*3 is retracted from behind the rotational force applying portion 100*a*1 to permit the coupling member 180 to disengage from the main assembly side engaging portion 100.

Thereafter, as shown in (a1) and (a2) of FIG. 33, the coupling member 180 passes by the inner surface contact portion 100*e* of the main assembly side engaging portion 100, and the coupling member 180 moves in the direction arrow X12 while being in contact with the side plate 108 by the urging force of the urging member 170. And the as shown in (a3) of FIG. 33, the coupling member 180 passes by the contact portion 108*a* of the side plate 108. As a result, the coupling member 180 moves in the direction opposite the direction arrow X8 by the urging force of the urging member 170, so that the cartridge B is dismounted from the main assembly A of the apparatus.

The description will be made as the case in which the directions of the rotational forces F7, F8 received from the rotational force applying portions 100*a*1 and 100*a*2 of the rotational force receiving portions 180*a*3, 180*b*3 and the removing direction X12 of the cartridge B are perpendicular, as shown in part (a) of FIG. 34.

As shown in (b1) of FIG. 34, the cartridge B is moved in the removing direction X12. At this time, the rotational force applying portions 100*a*1, 100*a*2 and the rotational force receiving portions 180*a*3, 180*b*3 are in contact with each other, but the rotational force receiving portion 180*a*3 do not receive a force of inclining the coupling member 180, from the rotational force applying portion 100*a*1. Therefore, the movement is made in the state that the axis L2 of the coupling member 180 does not incline relative to the axis L1. And, as shown in (b2) of FIG. 34, the other main assembly contact portion 180*a*2 in the rotational force receiving portion 180*a*3 side which is upstream of the coupling member 180 with respect to the removing direction X12 is contacted to the rotational force applying portion 100*a*2 of the main assembly side engaging portion 100. At this time, the other main assembly contact portion 180*a*2 receives a force F9 from the rotational force applying portion 100*a*2 by the dismounting of the cartridge B.

When the cartridge B is further moved in the removing direction X12, the axis L2 of the coupling member 180 is inclined toward the upstream relative to the axis L1 with respect to the removing direction X12 by the force F9. The other main assembly contact portion 180*a*2 is inclined by θ2 as described above. The inclination θ2 is set so that a component force F9*a* of the force F9 parallel with the axis L1 is in the direction of the arrow X8. Therefore, the coupling member 180 moves in the direction of arrow X8 while inclining the axis L2 relative to the axis L1. At this time, the coupling member 180 inclines until the end portion 190*a*2 of the drive pin 190 is brought into contact to the end portion 150*m* of the groove of the driving side flange 150.

When the cartridge B is further moved in the removing direction X12, the coupling member 180 moves in the direction of the arrow X8 while being inclined and while the other main assembly contact portion 180*a*2 and the rotational force applying portion 100*a*2 are in contact with each other ((b3) of FIG. 34).

Here, when the coupling member 180 moves in the direction of arrow X8, the moving operation of the coupling member 180 may be obstructed by the inclinations θ1 of the rotational force receiving portions 180*a*3, 180*b*3. In such a case, the axis L2 of the coupling member 180 inclines relative to the axis L1 so that the obstruction to the moving operation is avoided. And, the coupling member 180 moves in the direction of the arrow X8.

When the cartridge B is moved in the removing direction X12, the coupling member 180 continues moving in the direction of the arrow X8, and the rotational force receiving portions 180*a*3, 180*b*3 disengage from the space portion 100*f* of the main assembly side engaging portion 100 ((b4) of FIG. 34).

Thereafter, the coupling member 180 is moved similarly to the case of (a1)-(a3) of above-described so that the cartridge B is dismounted from the main assembly A of the apparatus.

In the foregoing description, the removing direction of the cartridge B is parallel with or perpendicular to the direction of the rotational force received from the rotational force applying portions 100*a*1, 100*a*2 by the rotational force receiving portions 180*a*3, 180*b*3. When the removing direction is different from these directions, the coupling member 180 can be disengaged from the main assembly side engaging portion 100. For example, the removing direction of the cartridge B is 45 degrees relative to the direction of the rotational force received from the rotational force applying portions 100*a*1 and 100*a*2 by the rotational force receiving portions 180*a*3, 180*b*3, the coupling member 180 can be disengaged from the main assembly side engaging portion 100 by combination of the inclining operation of the axis L2 of the coupling member 180 relative to the axis L1 and the moving operation in the direction of the axis L1.

Therefore, as described above, irrespective of the phase relation in the rotational moving direction between the coupling member 180 and the main assembly side engaging portion 100 upon dismounting of the cartridge B from the main assembly A of the apparatus, the cartridge B can be dismounted from the main assembly A of the apparatus by the above-described structure.

Figure 35:
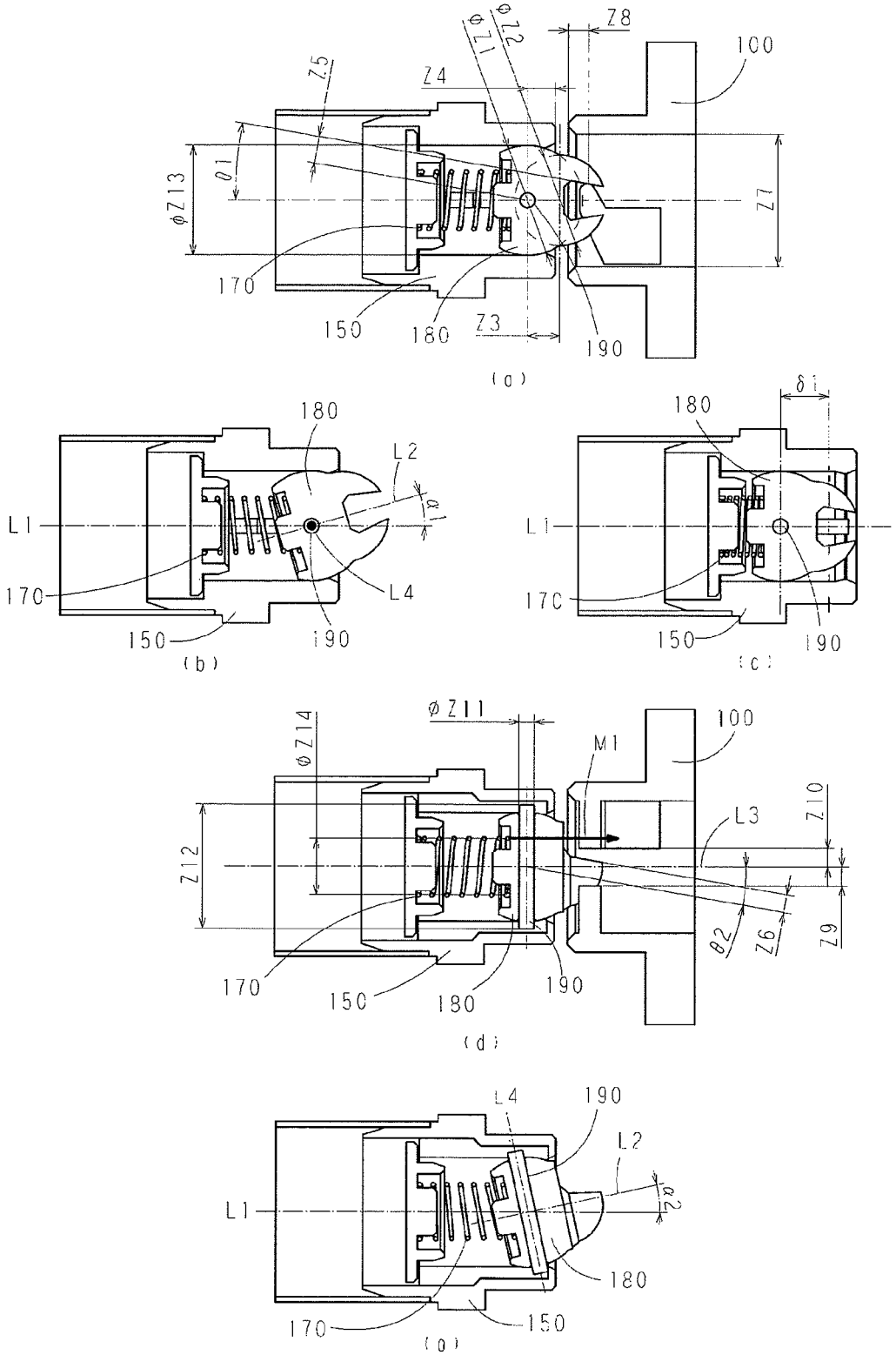
FIG. 35 is an illustration showing dimensions of the driving side flange unit according to one embodiment of the present invention.

Referring to FIG. 35, an example of this embodiment will be described.

Here, a sphere diameter of the portion-to-be-guided 180*c* of the coupling member 180 is ϕZ1; sphere diameters of the first projected portion 180*a* and the second projected portion 180*b* are ϕZ2; distances between a center of the sphere of the portion-to-be-guided 180*c* and the centers of the spheres of the first projected portion 180*a* and the second projected portion 180*b* Z3; and a distance between the center of the sphere of the portion-to-be-guided 180*c* and the end portion of the opening of the driving side flange 150 is Z4. Inclinations of the rotational force applying portions 180*a*3, 180*b*3 are θ1; a distance of the portion-to-be-guided 180*c* from the center of the sphere is Z5; inclinations of the other main assembly contact portions 180*a*2, 180*b*2 are θ2; and a distance of the portion-to-be-guided 180*c* from the center of the sphere is Z6. A maximum inclination angle of the axis L4 of the coupling member 180 is α1; a maximum inclination angle of the axis perpendicular to the axis L4 and the axis L2 is α2; and a movement distance in the direction of the axis L2 is δ1. A diameter of the inner wall 100*b* of the main assembly side engaging portion 100 is ϕZ7; distances of the rotational force applying portions 100*a*1, 100*b*1 from the end portion of the opening is Z8; and distances of the rotational force applying portions 100*a*1 and 100*b*1 from the axis L3 are Z9, Z10, respectively. A diameter of the drive pin 190 is ϕZ11, and the length thereof is Z12. A diameter of the inner wall 150*h* of the driving side flange 150 is ϕZ13. A diameter of the coil spring of the urging member 170 is ϕZ14; and a spring pressure of the urging member 170 in the state that the portion-to-be-contacted 180*e* of the coupling member 180 is in contact with the contact portion 150 *g* of the flange 150 is M1. In the specific example, Z1=14.6 mm, Z2=12 mm, Z3=4.3 mm, Z4=3.7 mm, Z5=3.6 mm, Z6=1.9 mm, Z7=17.6 mm, Z8=2.7 mm, L9=L10=1.75 mm, Z11=2 mm, Z12=16.5, Z13=14.64 mm, Z14=8.6 mm, θ1=10 degrees, θ2=10 degrees, α1=16.2 degrees, α2=12.18 degrees, δ1=6.4 mm, M1=1N. In these conditions, it has been confirmed that the coupling member 180 can engage with the main assembly side engaging portion 100. It has been confirmed that the coupling member 180 can transmit the rotational force smoothly to the photosensitive drum 10. Furthermore, it has been confirmed that the coupling member 180 can disengage from the main assembly side engaging portion 100.

These values are examples, and are not inevitable, and other values are usable.

As described in the foregoing, in accordance with the dismounting operation of the cartridge B, the coupling member 180 (axis L2) inclines relative to the axis L1 and makes translational movement extended along axis L1 by which the coupling member 180 which is in the space portion 100*f* of the main assembly side engaging portion 100 can be disengaged to the outside of the space portion 100*f*. Therefore, the cartridge B can be dismounted in the direction substantially perpendicular to the rotational axis of the photosensitive drum 10.

When the cartridge B is dismounted, the coupling member 180 is inclined not less than θ1 of the inclination of the rotational force receiving portion, and then the coupling member 180 is moved in the direction of X8 parallel with the axis L1. By this, the operation of dismounting is cartridge B by the user can be made smooth, so that the dismounting operation of the cartridge B by the user can be made easier.

According to the foregoing embodiment of the present invention, the coupling member 180 is guided so that the axis L2 thereof can incline (pivot, swing and/or whirl) in any direction relative to the axis L1 of the driving side flange 150. Furthermore, the coupling member 180 is guided movably along the axis L1 of the driving side flange 150. By doing so, when the cartridge B is moved in the direction substantially perpendicular to the rotational axis of the photosensitive drum 10 to mount the cartridge B to the main assembly A of the apparatus, the axis L2 of the coupling member 180 inclines relative to the axis L1, and moves along the axis L1 so that the coupling member 180 and the main assembly side engaging portion 100 can engage with each other. When the cartridge B is moved in the direction substantially perpendicular to the rotational axis of the photosensitive drum 10 to dismount is cartridge B from the main assembly A of the apparatus, the axis L2 of the coupling member 180 inclines with respect to axis L1, and moves along the axis L1, and the coupling member 180 can disengage from the main assembly side engaging portion 100. In addition, the cartridge B dismounting load when the cartridge B is dismounted from the main assembly A of the apparatus, and the usability performance when the cartridge B is mounted to the main assembly A of the apparatus can be improved.

According to the embodiment of the present invention, for the purpose of the rotational force transmission, the coupling member 180 enters the space portion 100*f* which is a cylindrical recess of the main assembly side engaging portion 100 to receive the rotational force. In addition, the first projected portion 180*a* and the second projected portion 180*b* of the coupling member 180 is smaller beyond opening 150*e* of the driving side flange 150. Therefore, the coupling member 180 can move into the driving side flange 150 with the mounting operation and the dismounting operation of the cartridge B. Thus, for the mounting and dismounting of the cartridge B, it is unnecessary to provide a space for the movement of the coupling member 180, and therefore, the cartridge B and/or the main assembly A of the apparatus can be downsized.

In the embodiment of the present invention, for the purpose of movement of the coupling member 180 into the limited space in the space portion 150*f* of the driving side flange 150, the coupling member 180 enters the space portion 100*f* of the recess of the main assembly side engaging portion 100. By this, a radius of the rotational force transmission from the main assembly side engaging portion 100 to the coupling member 180 can be maximized, and the coupling member 180 can transmit the rotational force from the main assembly side engaging portion 100 to the driving side flange 150 with high accuracy. In other words, the coupling member 180 can be downsized to the maximum, relative to the predetermined rotational force transmission radius for rotating the photosensitive drum 10. Then, the cartridge B and/or the main assembly A of the apparatus can be downsized to the maximum. In other words, structure of the embodiment of the present invention is effective in the case that a smooth rotation with high accuracy is required together with large load of the cartridge B such as the case of transmitting the rotational force to the rotatable member or the like the photosensitive drum 10.

According to the embodiment of the present invention, the portion-to-be-guided 180*c* of the coupling member 180 has a spherical shape, and the inner wall 150*h* of the driving side flange 150 has a hollow cylindrical shape, and the portion-to-be-guided 180*c* is guided by the inner wall 150*h*. Therefore, a radius of rotational force transmission from the coupling member 180 into driving side flange 150 can be maximized in the limited space in the cartridge B (photosensitive drum 10). Therefore, the coupling member 180 can transmit the rotational force from the main assembly side engaging portion 100 to the driving side flange 150 with high accuracy. In other words, the coupling member 180 can be downsized to the maximum, within the limit of the required predetermined rotational force transmission radius for rotating the photosensitive drum 10 with high accuracy. Then, the cartridge B and/or the main assembly A of the apparatus can be downsized to the maximum. In other words, the structure of the embodiment of the present invention is effective for the case of transmitting the rotational force to the rotatable member or the like photosensitive drum 10 in which the smooth rotation with high accuracy is required together with the large load of the cartridge B.

These apply to the other embodiments which will be described hereinafter.

(Embodiment 2)

Referring to FIG. 36 to FIG. 42, a second embodiment of the present invention will be described.

In the description of this embodiment, the same reference numerals as in Embodiment 1 are assigned to the elements having the corresponding functions in this embodiment, and the detailed description thereof is omitted for simplicity. This applies to the other embodiments which will be described hereinafter.

Figure 36:
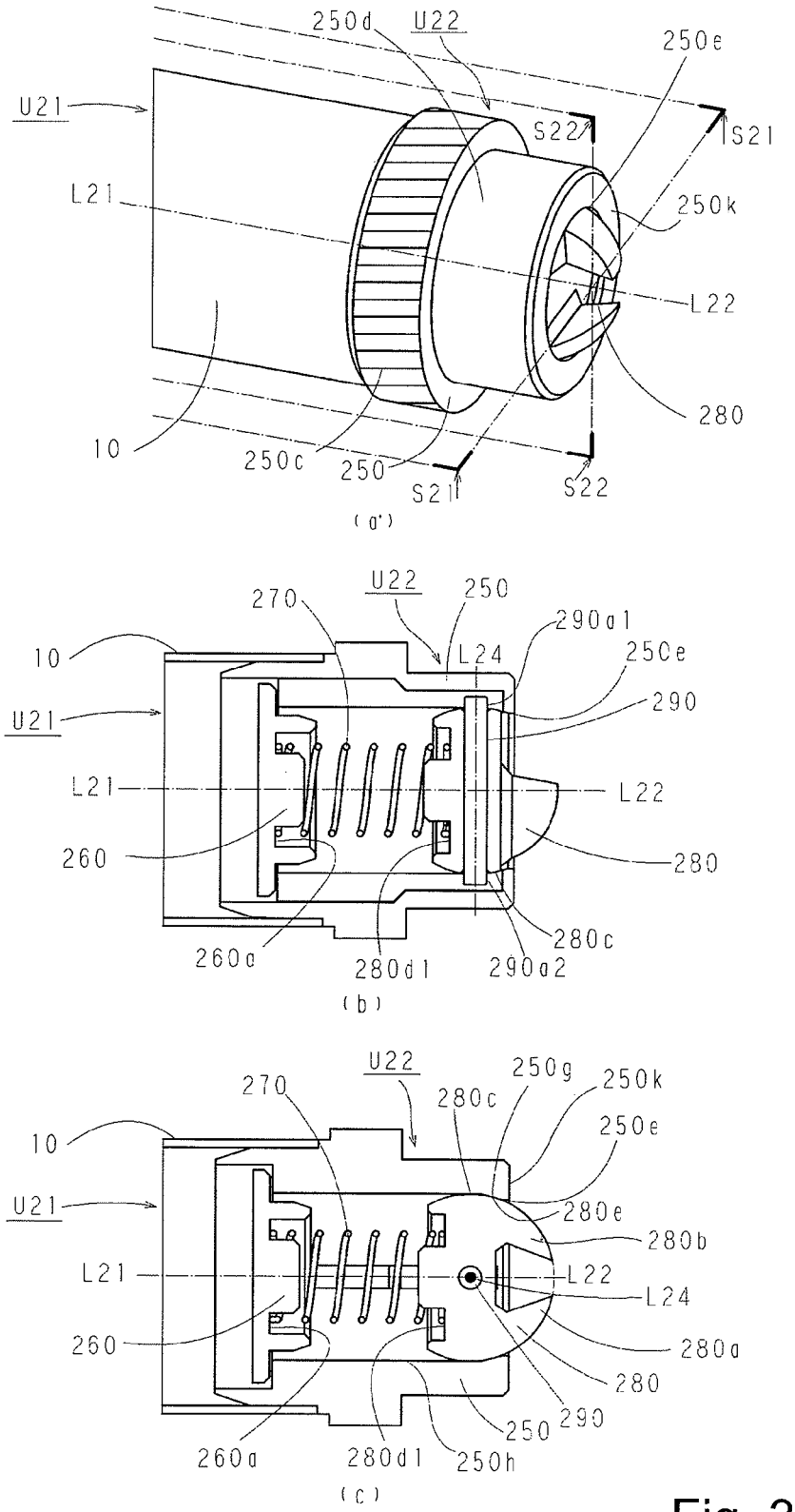
FIG. 36 is a schematic perspective view and a schematic sectional view of the photosensitive drum unit according to one embodiment of the present invention.

Referring to FIG. 36, the structure of driving side flange unit U22 used in this embodiment will be described. Part (a)

of FIG. 36 is a schematic perspective view of the photosensitive drum unit U1 having the driving side flange unit U2 mounted thereto, as seen from the driving side. Part (b) of FIG. 36 is a schematic sectional view taken along a plane S21 of the part (a) of FIG. 36, part (c) of FIG. 36 is a schematic sectional view taken along a plane S22 part (a) of FIG. 36.

Similarly to Embodiment 1, rotational axes of a driving side flange (rotational force transmitted member) 250, a coupling member 280 and a main assembly side engaging portion 200 are called "axes". This applies to the other embodiments which will be described hereinafter.

In this embodiment, a mounting direction of a cartridge B to a main assembly A of the apparatus and the removing direction of the cartridge B from the main assembly A of the apparatus are the same as in Embodiment 1. This applies to the other embodiments which will be described hereinafter.

As shown in FIG. 36, the driving side flange unit U22 comprises a driving side flange 250, a coupling member 280, a drive pin 290, an urging member 270 and a covering member 260, similarly to the embodiment 1. In the coupling member 280, similarly to the Embodiment 1, a spherical portion-to-be-guided (portion-to-be-supported) 280*c* is guided by an inner wall 250*h* which is an inner surface of the driving side flange 250. Therefore, the coupling member 280 can move along the axis L21 of the driving side flange 250, and an axis L22 of the coupling member 280 can incline relative to the axis L21.

The structure in which the coupling member 280 inclines about an axis perpendicular to the axis L22 of the coupling member 280 and an axis L24 of the drive pin 290 is similar to the embodiment 1. That is, the coupling member 280 can incline until the drive pin 290 is brought into contact to the driving side flange 250.

On the other hand, a structure for inclination about an axis co-axial with the axis L24 of the drive pin 290. With the structure of Embodiment 1, the coupling member 180 can incline until the first projected portion 180*a* or the second projected portion 180*b* contacts to the opening 250*e* of the driving side flange 250. With the structure of this embodiment the as shown in part (b) of FIG. 36, a first projected portion 280*a* and a second projected portion 280*b* are constituted by the same spherical surface as the portion-to-be-guided 280*c*, and therefore, the first projected portion 280*a* and the second projected portion 280*b* do not contact to the opening 250*e* despite the inclination.

At this time, an amount inclination of the coupling member 280 is limited by an urging force of the urging member 270. That is, the urging force of the urging member 270 tends to keep an axis L22 of the coupling member 280 co-axial with the axis L21 of the driving side flange 250. As a result, the urging force of the urging member 270 is a drag against the inclination of the coupling member 280. Therefore, the inclination amount of the coupling member 280 is limited.

The fixing method of the drive pin 290 relative to the coupling member 280, the fixing method of the covering member 260 relative to the driving side flange 250 and the structure of the urging member 270 are similar to those in Embodiment 1, and therefore, the description is omitted. Embodiment 1 applies with respect to the axis of the drive pin 290. This applies to the other embodiments which will be described hereinafter.

Figure 37:
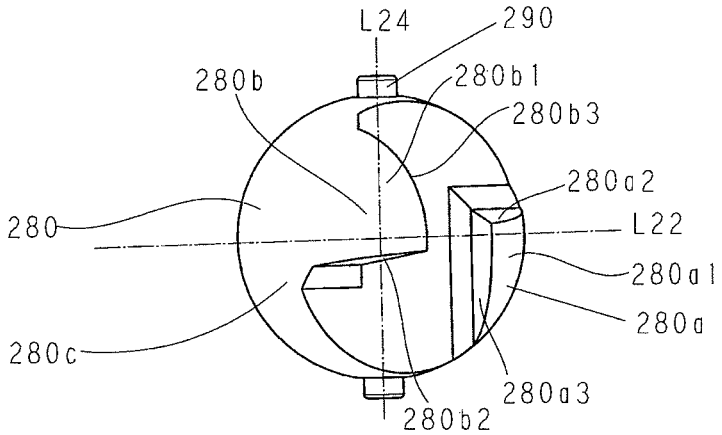
FIG. 37 is a schematic perspective view of a coupling member according to one embodiment of the present invention.
Figure 37:
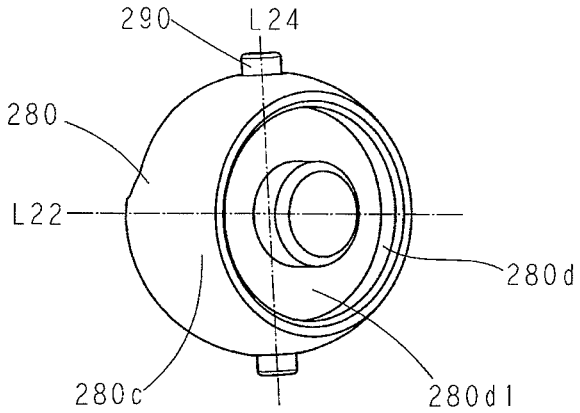
Figure 38:
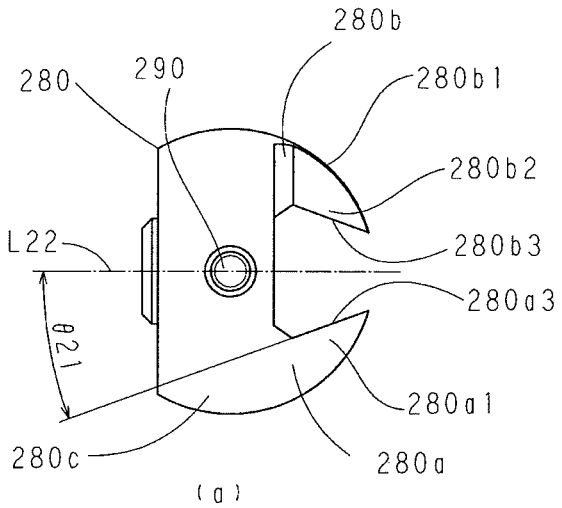
FIG. 38 is an illustration of the coupling member according to one embodiment of the present invention.
Figure 38:
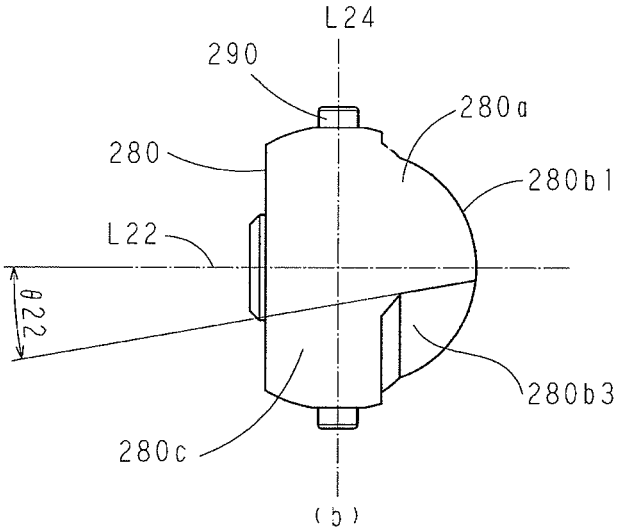
Figure 39:
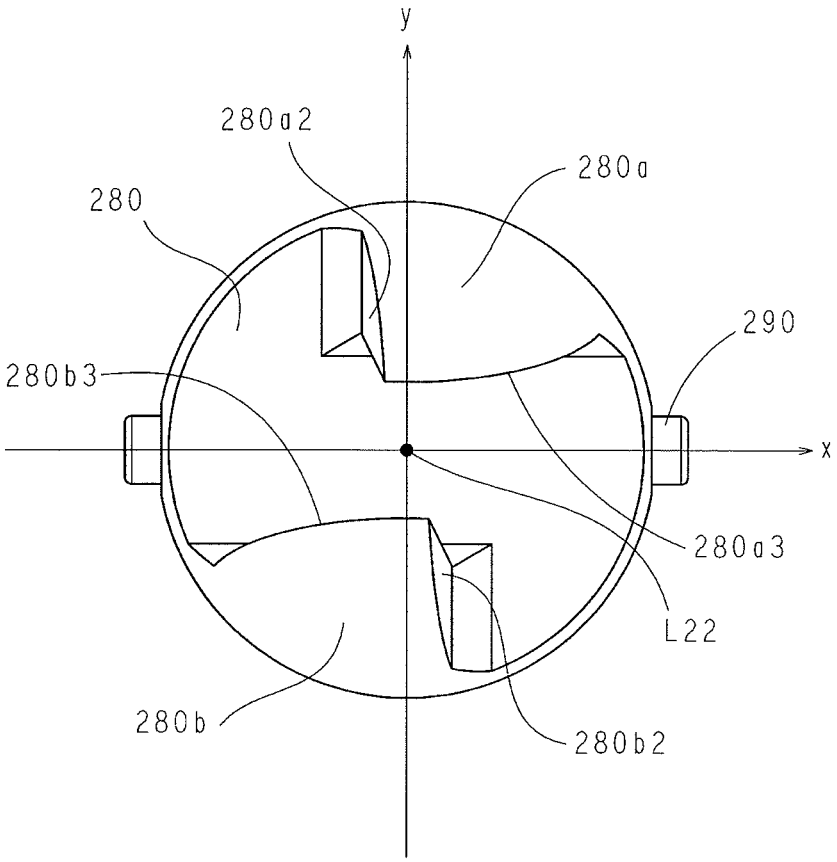
FIG. 39 is an illustration of the coupling member according to one embodiment of the present invention.

Referring to FIG. 37 to FIG. 39, the coupling member 280 of this embodiment will be described. FIG. 37 is a schematic perspective view of the coupling member 280 and the drive pin 290. Part (a) of FIG. 38 is an illustration of the coupling member 280 as seen in the direction the axis L24 of the drive pin 290, and part (b) of FIG. 38 is an illustration of the coupling member 280 as seen in the direction perpendicular to the axis L22 and the axis L24. FIG. 39 is an illustration the coupling member 280 as seen in the direction of the axis L22 from the driving side.

As shown in FIGS. 37 and 38, the coupling member 280 comprises mainly the portion-to-be-guided 280*c*, the first projected portion 280*a*, the second projected portion 280*b* and a spring mounting portion 280*d*. Further, the first projected portion 280*a* and the second projected portion 280*b* each comprises a main assembly contact portion 280*a*1, 280*b*1, another main assembly contact portion 280*a*2, 280*b*2 and a rotational force receiving portion 280*a*3, 280*b*3. The configurations of the other main assembly contact portions 280*a*2, 280*b*2 and rotational force receiving portions 280*a*3, 280*b*3 are inclined surfaces inclined by angles θ21 and θ22 relative to the axis L22, similarly to the embodiment 1.

The coupling member 280 of this embodiment is different from the coupling member 180 of Embodiment 1 in the configurations of the first projected portion 280*a* and the second projected portion 280*b*. In this embodiment, the first projected portion 280*a* and the second projected portion 280*b* are a part of the sphere forming the portion-to-be-guided 280*c*. And, main assembly contact portions 280*a*1, 280*b*2 are also a part of the spherical surface of the portion-to-be-guided 280*c*.

On the other hand, the arrangements of the rotational force receiving portions 280*a*3, 280*b*3 and the other main assembly contact portions 280*a*2, 280*b*2 are similar to those of Embodiment 1, as shown in FIG. 39. In this embodiment, the other main assembly contact portion 280*a*2 is in the second quadrant, and the other main assembly contact portion 280*b*2 is in the fourth quadrant, respectively, but this is not inevitable. Nevertheless, if the main assembly contact portion 280*a*2 enters the second quadrant, and the main assembly contact portion 280*b*2 enters the fourth quadrant, the rigidities of the first projected portion 280*a* and the second projected portion 280*b* can be enhanced. This enhances the strengths of the rotational force receiving portions 280*a*3, 280*b*3, so that the rotational force can be transmitted from the main assembly side engaging portion 200 to the coupling member 280 with high accuracy.

Figure 40:
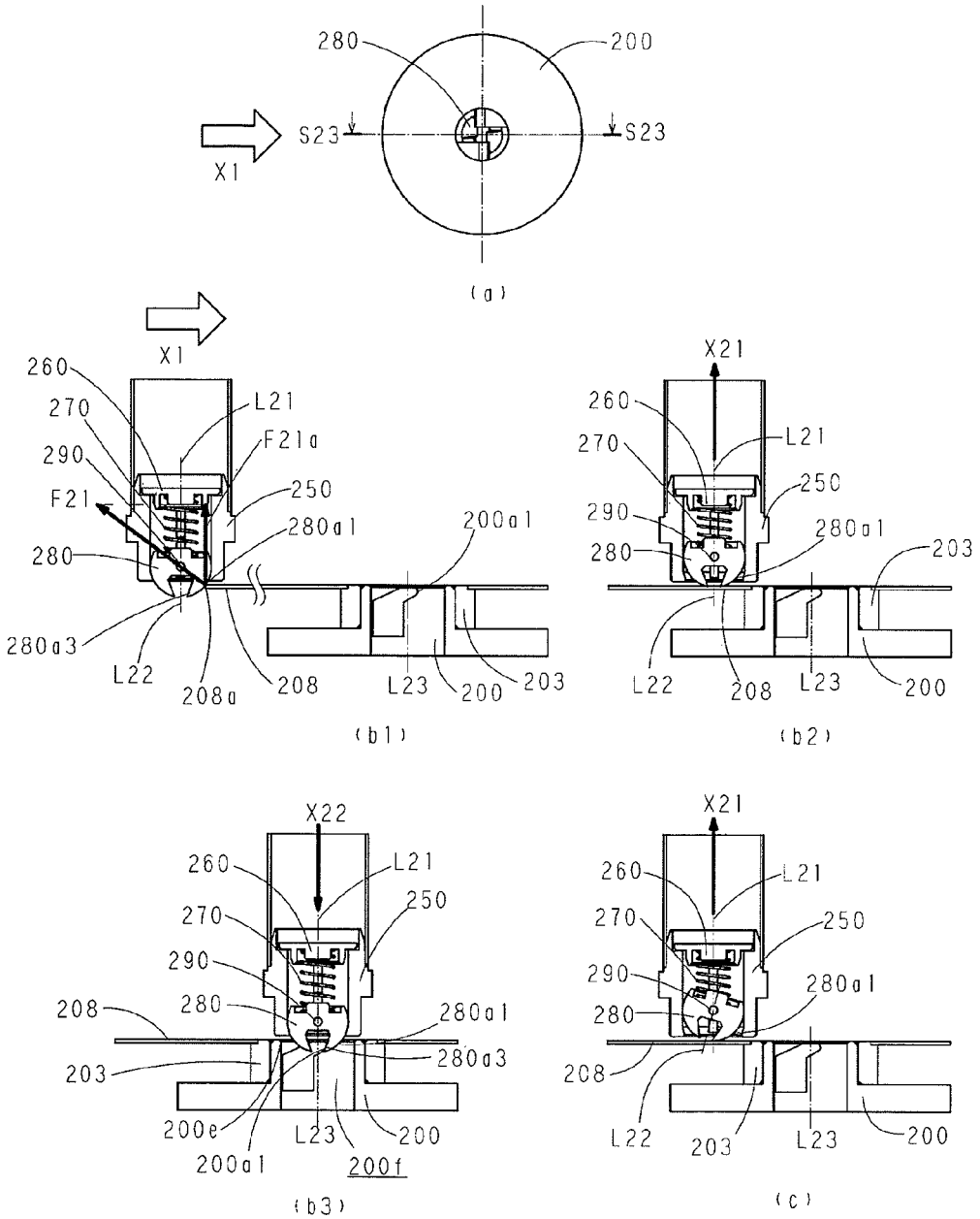
FIG. 40 is an illustration showing an operation state when coupling member is brought into engagement with the main assembly side engaging portion according to one embodiment of the present invention.

Referring to FIG. 40, an engaging operation the coupling member 280 in this embodiment will be described. FIG. 40 is an illustration of a state when the coupling member 280 is engaged with the main assembly side engaging portion 200. Part (a) of FIG. 40 is an illustration showing mounting direction and the cutting direction of the S23 sectional view. Parts (b1)-(b3) of FIG. 40 are schematic sectional views taken along a line S23 of the part (a) of FIG. 40 in which the coupling member 280 is engaged with the main assembly side engaging portion 200. Part (c) of FIG. 40 is an illustration taken along a line S23 of the part (a) of FIG. 40 in which the coupling member 280 moves while inclining. Referring to the drawing showing the state in which the rotational force applying portion 200*a*1 and the rotational force receiving portion 280*a*3 are contacted to each other, and the engagement between the main assembly side engaging portion 200 and the coupling member 280 is completed.

As shown in (b1) of FIG. 40, similarly to the Embodiment 1, when the cartridge B starts to mount to the main assembly A of the apparatus, the coupling member 280 is urged toward the driving side of the driving side flange 250 by the urging force of the urging member 270. In addition, the axis L22 of the coupling member 280 is substantially co-axial with the axis L21 of the driving side flange 150. When the cartridge B is moved in the direction of an arrow X1 which is the mounting direction of the cartridge B in this state, the main assembly contact portion 280*a*1 of the coupling member 280 contacts to a contact portion 208*a* of a side plate 208 of the main assembly A of the apparatus. At this time, a mounting force F21 of the cartridge B is applied to the main assembly contact portion 280*a*1.

When the cartridge B is further moved in the direction of the arrow X1, as shown in (b2) of FIG. 40, the coupling member 280 is moved in the direction (arrow X21) parallel with the axis L21 by a component force F21*a* of the force F21 parallel with the axis L21. Here, the force F21 is directed substantially toward the center of the sphere of the portion-to-be-guided 280*c*, and therefore, the force F21 hardly inclines the coupling member 280. On the other hand, a frictional force between the main assembly contact portion 280*a*1 of the coupling member 280 and between contact portion 208*a* of the side plate 208 contacted thereto is effective to incline the coupling member 280. However, the urging force of the urging member 270 is a drag against the inclination of the coupling member 280, and therefore, when the drag is larger than the frictional force, the coupling member 280 hardly inclines. Thus, the axis L22 of the coupling member 280 and the axis L21 of the driving side flange 250 are kept substantially co-axial with each other. In addition, in the movement of the coupling member 280 in the direction of the arrow X1, the frictional force between the coupling member 280 and the side plate 208 contacted thereto tends to incline the coupling member 280, but similarly the coupling member 280 hardly inclines by the above-described function of the urging member 270.

As shown in (b3) of FIG. 40, when the cartridge B is moved to a mounting completion position, the coupling member 280 moves in the direction of an arrow X22 parallel with the axis L21 by the urging force of the urging member 270 and enters a space portion 200*f* of the main assembly side engaging portion 200. Therefore, the coupling member 280 and the main assembly side engaging portion 200 are engaged with each other.

Depending on the frictional force between the coupling member 280 and the side plate 208 and/or the urging force of the urging member 270, the coupling member 280 may move in the direction of the arrow X21 with the inclination of the axis L22 relative to the axis L21 (part (c) of FIG. 40). In such a case, too, the urging force of the urging member 270 is against the inclination of the coupling member 280, and therefore, by setting the urging force of the urging member 270 at a proper level, the amount of the inclination of the coupling member 280 can be limited. Therefore, it can be avoided that the coupling member 280 is not opposed to the main assembly side engaging portion 200 (unengageable state).

By doing so, it is unnecessary in order to limit the inclination amount of the coupling member 280 to provide a configuration for contacting the coupling member 280 to the driving side flange 250. As a result, the latitude for the configurations of the coupling member 280 and the driving side flange 250 increases. In addition, the inclinable amount of the coupling member 280 particularly in the inclining direction about the axis co-axial with the axis L24 of the drive pin 290 or the inclining direction close thereto can be increased.

The urging force of the urging member 270 may be properly selected so as to satisfy the urging force necessitated to limit the inclination amount of the coupling member 280 and the urging force necessitated to incline the coupling member 270 smoothly and to transmit the rotational force smoothly.

In addition, the structure for limiting the inclination amount of the coupling member 280 by the urging force of the urging member 270 in this embodiment can be used in embodiment 1. On the contrary, the structure for limiting the inclination amount of Embodiment 1 may be used for the coupling member 280 of this embodiment. That is, a part of the coupling member 280 may be contacted to the driving side flange 250 to limit the inclination amount of the coupling member 280.

In addition, in the structure for moving the coupling member 280 in the direction of the arrow X21, the coupling member 280 may be contacted to the driving side guiding member 120 similarly to the embodiment 1. Furthermore, the coupling member 280 may be contacted to the main assembly side engaging portion 200. Furthermore, the above-described structure of moving coupling member 280 in the direction of the arrow X21 may be combined.

As to the state in which the coupling member 280 receives the rotational force from the main assembly side engaging portion 200 and the disengaging operation of the coupling member 280 from the main assembly side engaging portion 200, the description of Embodiment 1 applies, and therefore, the description is omitted.

As described in the foregoing, since the portion-to-be-guided 280*c* of the coupling member 280, the first projected portion 280*a* and the second projected portion 280*b* have the same spherical shape, a space for inclining the coupling member 280 can be saved. Therefore, the space required to engage the coupling member 280 with the main assembly side engaging portion 200, and the space required for the dismounting can be minimized. By this, the cartridge B and/or the main assembly A of the apparatus can be downsized.

With respect to the configuration of the coupling member 280 of this embodiment, if it is necessary to reduce the diameter of the photosensitive drum 10 and/or the driving side flange 250 and so on, the diameter of the spherical shape of the portion-to-be-guided 280*c* has to be small. This leads t reduction of the projection amount of the coupling member 280 from the end portion 250*k* of the opening of the driving side flange 250 in the direction of the axis L21 with the result of difficulty in assuring the engagement amount between the coupling member 280 and the main assembly side engaging portion 200. Therefore, the configuration of the coupling member 180 of Embodiment 1 is effective to increase the engagement amount between the coupling member 180 and the main assembly side engaging portion 100. On the other hand, the coupling member 280 of this embodiment is short in the direction of the axis L22, and therefore, an amount of twisting of the coupling member 280 by the load torque or the like of the cartridge B when the coupling member 280 transmits the rotational force is small. Therefore, the coupling member 280 can transmit the rotational force from the main assembly side engaging portion 200 of the main assembly A of the apparatus to the driving side flange 250 with high accuracy.

The configuration of the coupling member 180 of Embodiment 1 and the configuration of the coupling member 280 of this embodiment may be selected properly in accordance with the load torque of the cartridge B and/or the diameter of the photosensitive drum 10.

Figure 41:
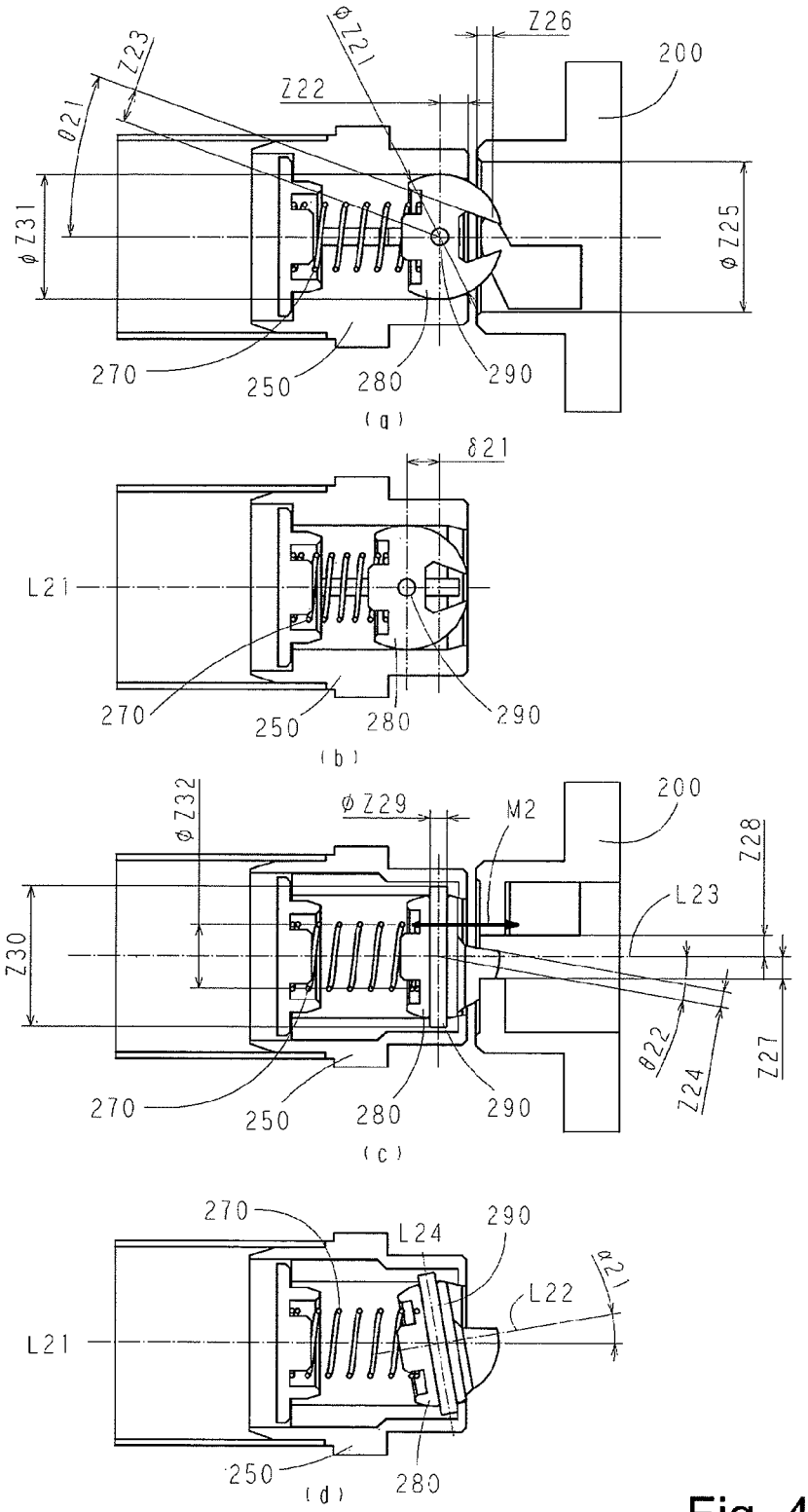
FIG. 41 is an illustration showing dimensions of the driving side flange unit according to one embodiment of the present invention.

Referring to FIG. 41, an example of this embodiment will be described.

Here, a sphere diameter of the portion-to-be-guided 280*c* of the coupling member 280 is $\phi$z21; and a distance of the center of the sphere of the portion-to-be-guided 280*c* from the end portion of the opening of the driving side flange 250 is Z22. Inclinations of the rotational force applying portions 280*a*3, 280*b*3 are $\theta$21; a distance of the portion-to-be-guided 280*c* from the center of the sphere is Z23; inclinations of the other main assembly contact portions 280*a*2, 280*b*2 are $\theta$22; and a distance of the portion-to-be-guided 280*c* from the center of the sphere is Z24. A maximum inclination angle of the shaft perpendicular to the axis L24 and the axis L22 of the coupling member 280 is α21; and a movement distance in the direction of the axis L22 is δ21. A diameter of the inner wall 200*b* of the main assembly side engaging portion 200 is ϕZ25; distances of the rotational force applying portions 200*a*1, 200*b*1 from the end portion of the opening is Z26; and distances of the rotational force applying portions 200*a*1 and 200*b*1 from the axis L3 are Z27, Z28, respectively. A diameter of the drive pin 290 is ϕZ29, and the length thereof is Z30. A diameter of the inner wall 150*h* of the driving side flange 150 is ϕZ31. A diameter of the coil spring of the urging member 270 is ϕZ32; and a spring pressure of the urging member 270 in the state that the portion-to-be-contacted 280*e* of the coupling member 280 is in contact with the contact portion 250 *g* of the flange 250 is M2. In the specific example, Z21=14.6 mm, Z22=3.3 mm, Z23=3.8 mm, Z24=1.9 mm, Z25=17.6 mm, Z26=1.8 mm, Z27=Z28=1.75 mm, Z29=2 mm, Z30=16.5 mm, Z31=14.64 mm, Z32=8.6 mm, θ21=20 degrees, θ22=10 degrees, α21=9.74 degrees, δ21=3.8 mm, M2=1N. In these conditions, it has been confirmed that the coupling member 280 can engage with the main assembly side engaging portion 200. It has been confirmed that the coupling member 280 can transmit the rotational force smoothly to the photosensitive drum 10. Furthermore, it has been confirmed that the coupling member 280 can disengage from the main assembly side engaging portion 200.

These values are examples, and are not inevitable, and other values are usable.

(Embodiment 3)

Figure 42:
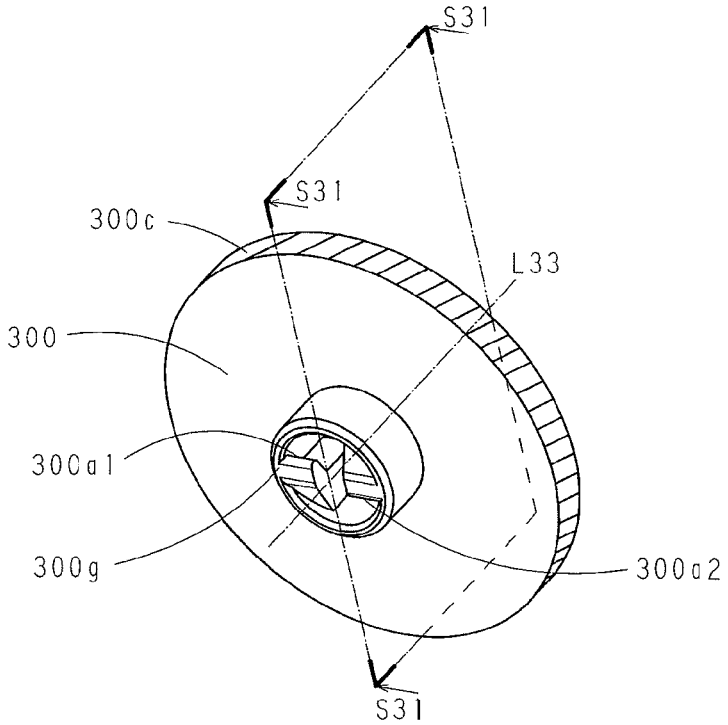
FIG. 42 is a schematic perspective view and a schematic sectional view showing the main assembly side engaging portion according to one embodiment of the present invention.
Figure 42:
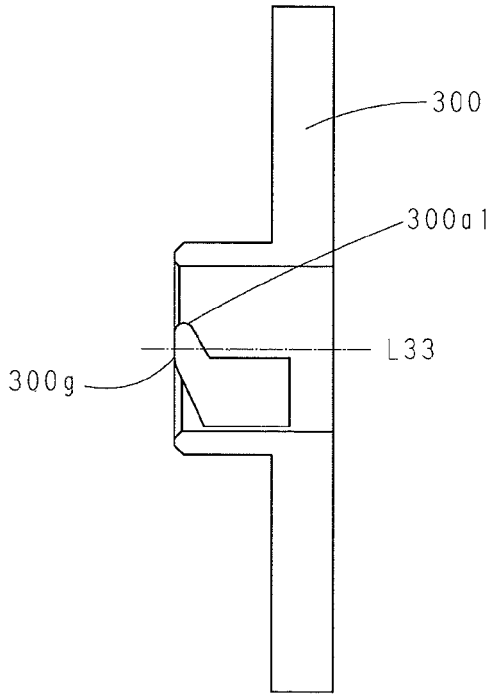
Figure 43:
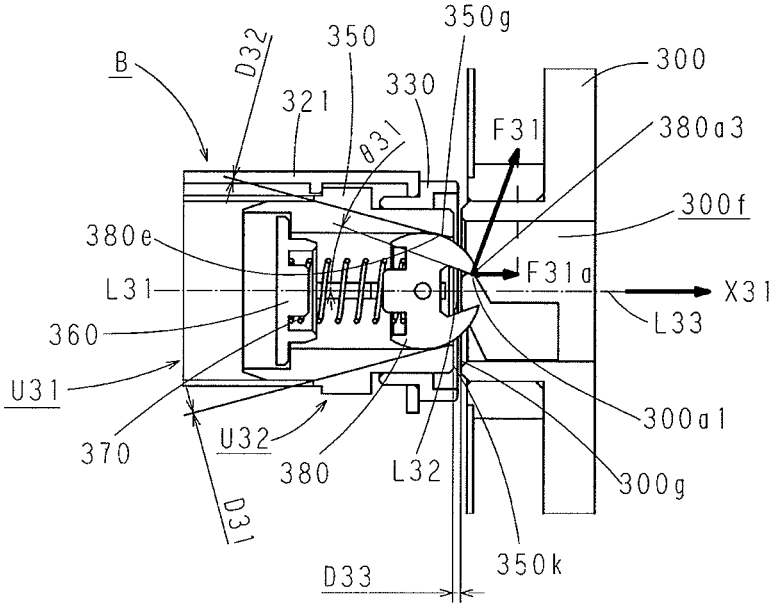
FIG. 43 is an illustration showing a positioning state of the photosensitive drum unit relative to the main assembly side engaging portion according to one embodiment of the present invention.
Figure 43:
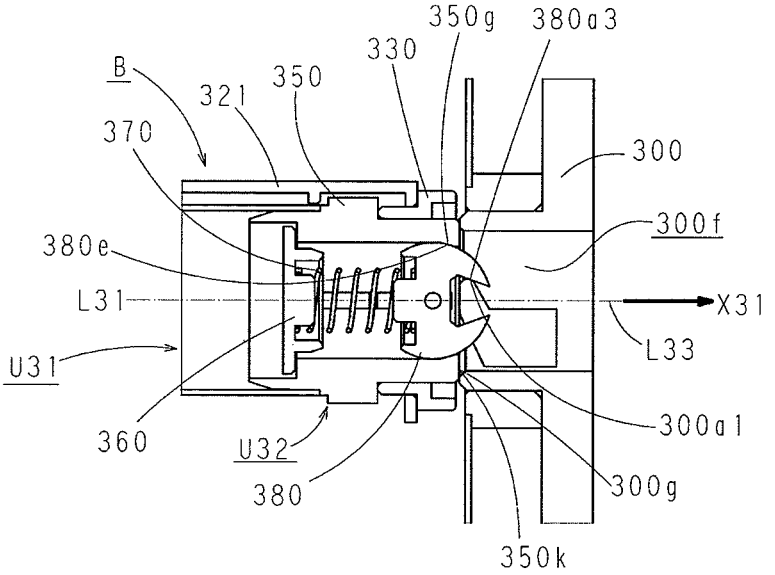
Figure 44:
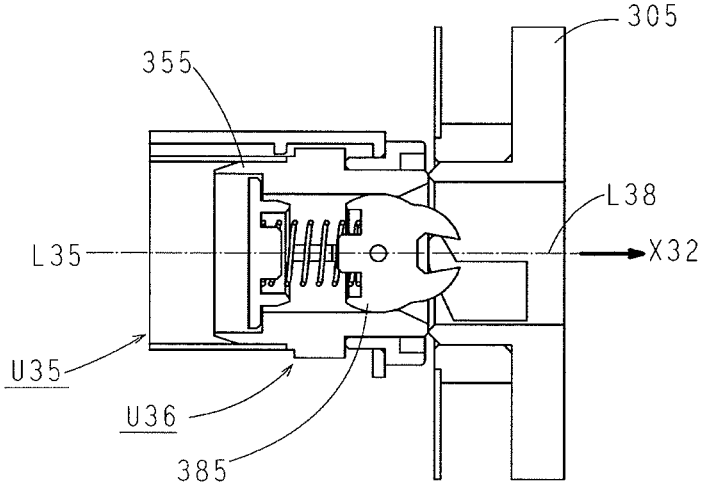
FIG. 44 is an illustration showing a positioning state of the photosensitive drum unit relative to the main assembly side engaging portion according to one embodiment of the present invention.

Referring to FIG. 42 to FIG. 44, a third embodiment of the present invention will be described. FIG. 42 is an illustration of the configuration of the main assembly side engaging portion 300. Part (a) of FIG. 42 is a schematic perspective view of the main assembly side engaging portion 300, part (b) of FIG. 42 is a schematic sectional view taken along a flat surface S31 of the part (a) of FIG. 42. FIGS. 43 and 44 are illustrations showing positioning of a photosensitive drum unit U31 and the photosensitive drum unit U35. The description will be made with an example in which a rotational force applying portion 300*a*1 and a rotational force receiving portion 380*a*3 are contacted each other, or a rotational force applying portion 305*a*1 and a rotational force receiving portion 385*a*3 are contacted each other, so that rotational forces can be transmitted.

In this embodiment, positioning methods for the photosensitive drum unit U31 and the photosensitive drum unit U35 relative to a main assembly A of the apparatus are different from those of the foregoing embodiments. First, the description will be made as to the example of the configuration of the coupling member 280 described with the embodiment 2.

Referring to FIG. 42, the main assembly side engaging portion 300 in this embodiment will be described. As shown in parts (a) and (b) of FIG. 42, in the main assembly side engaging portion 300 of this embodiment, a station forming rotational force applying portions 300*a*1, 300*a*2 is close to an end portion 300 *g* of the opening of the main assembly side engaging portion 300. By doing so, as compared with the above-described embodiments, the rotational force applying portions 300*a*1, 300*a*2 are made closer to the cartridge B in the direction of the axis L33 of the main assembly side engaging portion 300. As to arrangement of the rotational force applying portions 300*a*1, 300*a*2 in the circumferential direction of the axis L43 and the drive gear portion 300*c*, the description in the foregoing embodiment applies, and therefore, the description is omitted.

Referring to FIG. 43, the description will be made as to a position of the photosensitive drum unit U31 relative to the main assembly side engaging portion 300 in a rotational force transmission state.

Part (a) of FIG. 43 shows an example of the state when the cartridge B is placed in the mounting completion position. In the state of part (a) of FIG. 43, a clearance D33 is provided between an end portion 350*k* of the opening of a driving side flange (rotational force transmitted member) 350 and the end portion 300 *g* of the opening of the main assembly side engaging portion 300. The size of the clearance D33 is determined depending on the positions, in the longitudinal direction, of the cartridge B and the photosensitive drum unit U31 relative to the main assembly A of the apparatus when the cartridge B is inserted into the main assembly A of the apparatus.

Also, clearances D31 and D32 are provided between a portion-to-be-contacted 380*e* of a coupling member 380 and a contact portion 350 *g* of a driving side flange 350. The sizes of the clearances D31, D32 is determined by the position, in the direction of the axis L31 of the driving side flange 350, of the photosensitive drum unit U31 and an amount of entrance of the coupling member 380 into the space portion 300*f* when the cartridge B is in the mounting completion position. The amount of the entrance of the coupling member 380 into the space portion 300*f* is determined by the way of contact between the rotational force applying portions 300*a*1 300*a*2 and the rotational force receiving portions 380*a*1, 380*a*2 and an urging force of an urging member 370 or the like.

Here, as shown in part (a) of FIG. 43, similarly to the Embodiment 2, rotational force receiving portions 380*a*1 380*a*2 of the coupling member 380 are inclined by θ31 relative to an axis L32 of the coupling member 380. The inclination θ31 is selected such that a direction of a component force F33*a*, parallel with the axis L33, of the rotational force F31 applied to the rotational force receiving portions 380*a*1, 380*a*2 is parallel (arrow X31) with the axis L33.

When the coupling member 380 and the main assembly side engaging portion 300 are engaged with each other, and the rotational force F31 is applied to the rotational force receiving portions 380*a*1, 380*a*2, the coupling member 380 moves in the direction of the arrow X31 by the function of the component force F31*a* and the urging force of the urging member 370. As shown in part (b) of FIG. 43, the portion-to-be-contacted 380*e* the coupling member 380 contacts the contact portion 350 *g* of the driving side flange 350 (D31, D32 become zero) to move the driving side flange unit U32 and the photosensitive drum unit U31 in the direction of the arrow X31.

Then, the end portion 300 *g* of the opening of the main assembly side engaging portion 300 and the end portion 350*k* of the opening of the driving side flange 350 are contacted (D33 becomes zero), by which the positions of the coupling member 380 and the photosensitive drum unit U31 relative to the main assembly A of the apparatus in the direction of the axis L33.

As described in the foregoing, according to the structure of this embodiment, as compared with the photosensitive drum unit positioning structure of the foregoing embodiments, the photosensitive drum unit U31 can be positioned with respect to main assembly A of the apparatus with respect to direction of the axis L33 with high accuracy. Therefore, the positional relation, in the longitudinal direction, is correct between the photosensitive drum unit U31 and a laser beam projected from an optical means 1 provided in the main assembly A of the apparatus or the recording material 2 or the like. Then, an image can be outputted at the correct position on the recording material 2.

With the structure of this embodiment, the number parts required to determine the position of the coupling member 380 relative to the main assembly side engaging portion 300 in the direction of the axis L33. Therefore, the variation in the amount of engagement between the coupling member 380 and the main assembly side engaging portion 300 can be reduced irrespective of the size of the clearance D33 in the mounting completion position. Therefore, the rotational force can be transmitted more stably at main assembly side engaging portion 300 to the coupling member 380.

With the structure of this embodiment, the axis L31 of the driving side flange 350 and the axis L33 of the main assembly side engaging portion 300 can be made parallel with each other. Therefore, the rotational force can be transmitted more stably from main assembly side engaging portion 300 to the coupling member 380.

With the structure of this embodiment, the engagement amount between the coupling member 380 and the main assembly side engaging portion 300 can be maximized. Therefore, the rotational force can be transmitted more stably at main assembly side engaging portion 300 to the coupling member 380.

The inclination 831 is selected such that the rotational force F31 can move the coupling member 380 and the photosensitive drum unit U31 in the direction of the arrow X31. However, another means for moving the coupling member 380 and the photosensitive drum unit U31 in the direction of the arrow X31 is provided, the inclination 831 may be small. For example, in a non-driving side of the photosensitive drum unit U31, an urging member for urging the photosensitive drum unit U31 toward the driving side is provided. By the urging force of the urging member, the end portion 300*g* of the opening of the main assembly side engaging portion 300 and the end portion 350*k* of the opening of the driving side flange 350 may be contacted in the state that the rotational force is received.

With respect to the positioning of the photosensitive drum unit U31 relative to the main assembly A of the apparatus in the direction of the axis L33, the end portion 350*k* of the opening of the driving side flange 350 and the contact portion 300 *g* of the main assembly side engaging portion 300 may be contacted to each other. By doing so, the regulating portion 21*h* for the cleaning frame 21 and/or the cartridge longitudinal direction regulating portion 9 of the main assembly A of the apparatus described with respect to Embodiment 1 may be omitted. Therefore, the latitude of the configuration of the cleaning frame 321 and/or main assembly A of the apparatus or the like is improved.

In addition, in this embodiment, the description has been made using the configuration of the coupling member 280 of the Embodiment 2, but the configuration of the coupling member 180 of Embodiment 1 may be used. That is, as shown in FIG. 44, in the rotational force transmission, a coupling member 385 contacts the driving side flange 355 in the direction of an axis L35 of the driving side flange 355. And, the driving side flange unit U36 and the photosensitive drum unit U35 moves in the direction of an arrow X32 parallel with an axis L38 of a main assembly side engaging portion 305 so that the driving side flange 355 contacts the main assembly side engaging portion 305 in the direction of the axis L38. By doing so, the positions, in the direction of the axis L38, of the coupling member 385 and the photosensitive drum unit U35 relative to the main assembly A of the apparatus can be determined, and therefore, above-described the similar effects can be provided.

(Embodiment 4)

Figure 45:
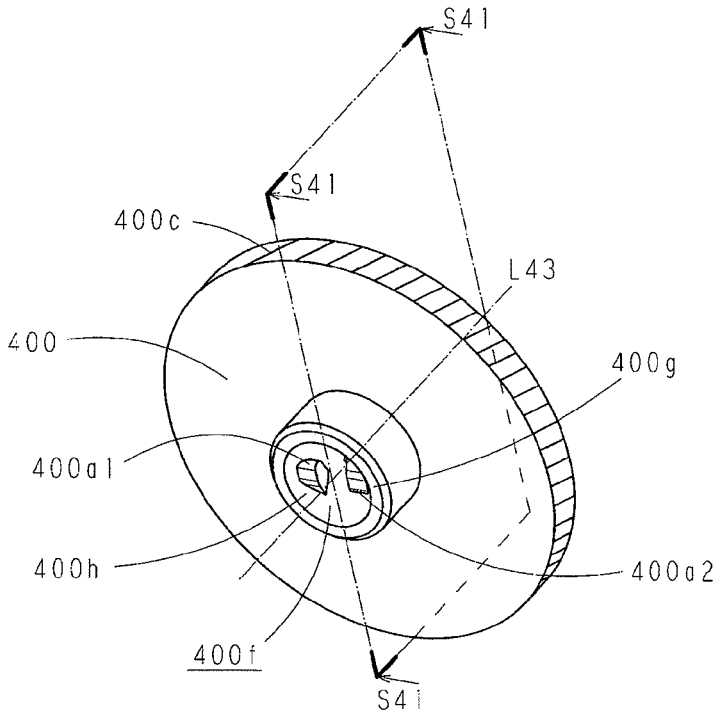
FIG. 45 is a schematic perspective view and a schematic sectional view showing the main assembly side engaging portion according to one embodiment of the present invention.
Figure 45:
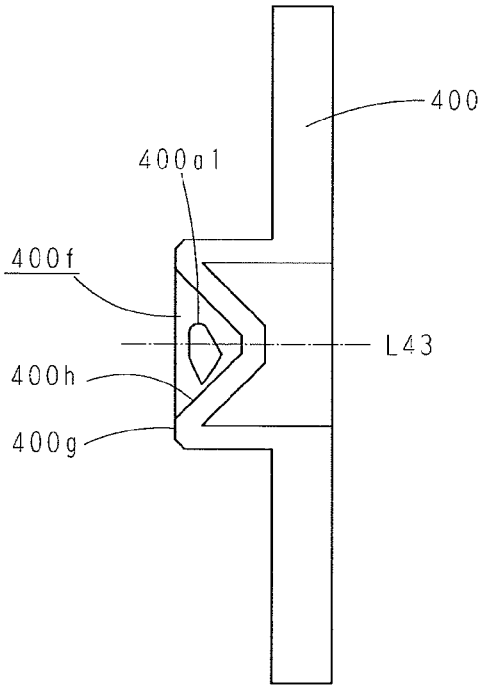
Figure 46:
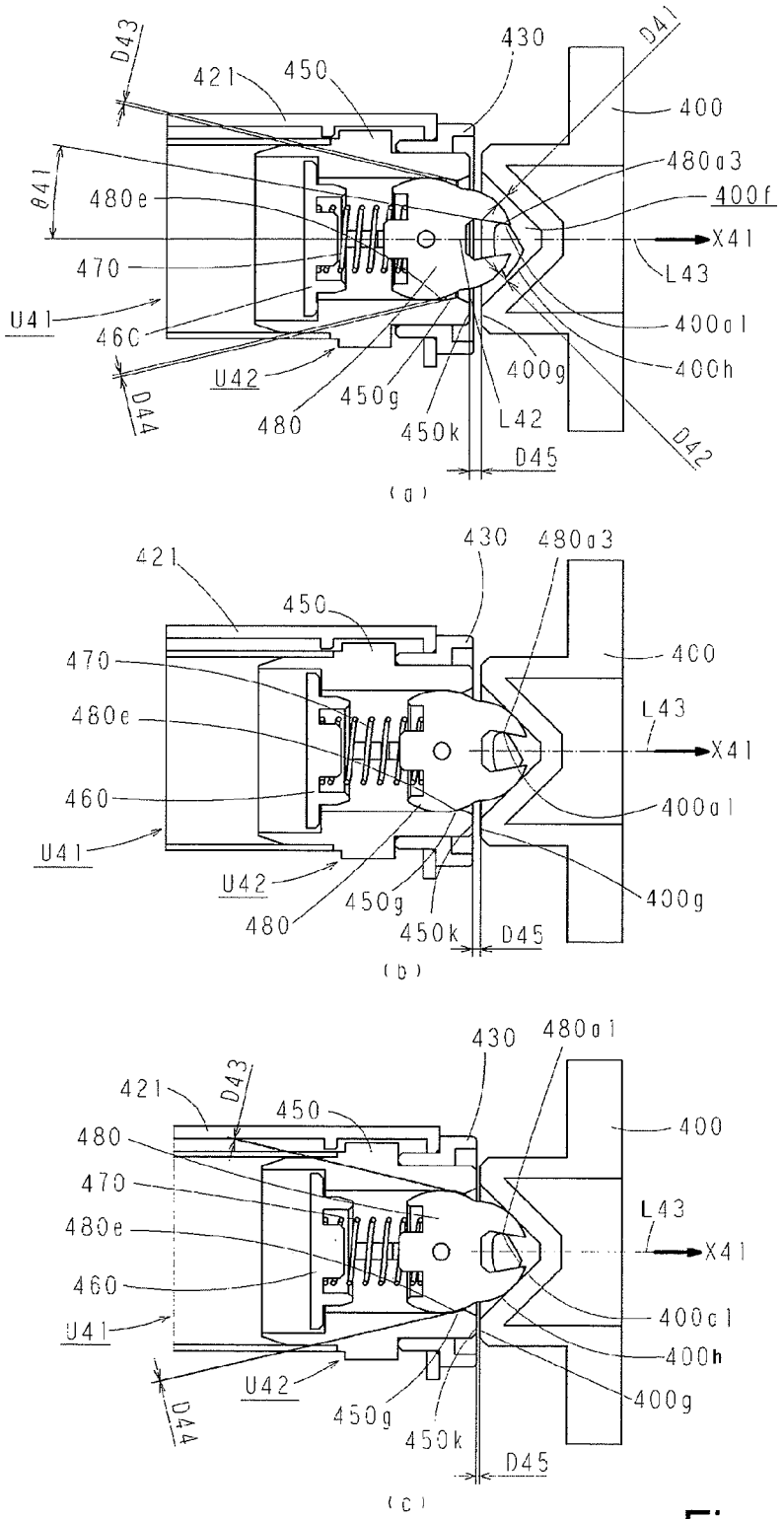
FIG. 46 is an illustration showing a positioning state of the photosensitive drum unit relative to the main assembly side engaging portion according to one embodiment of the present invention.
Figure 47:
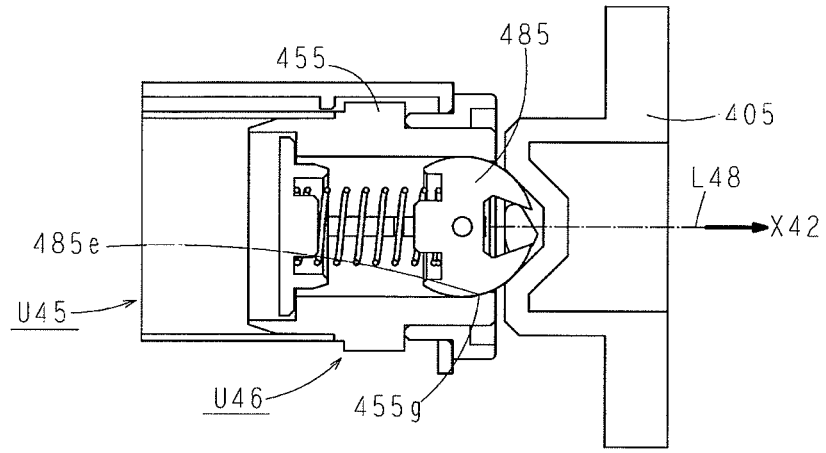
FIG. 47 is an illustration showing a positioning state of the photosensitive drum unit relative to the main assembly side engaging portion according to one embodiment of the present invention.
Figure 47:
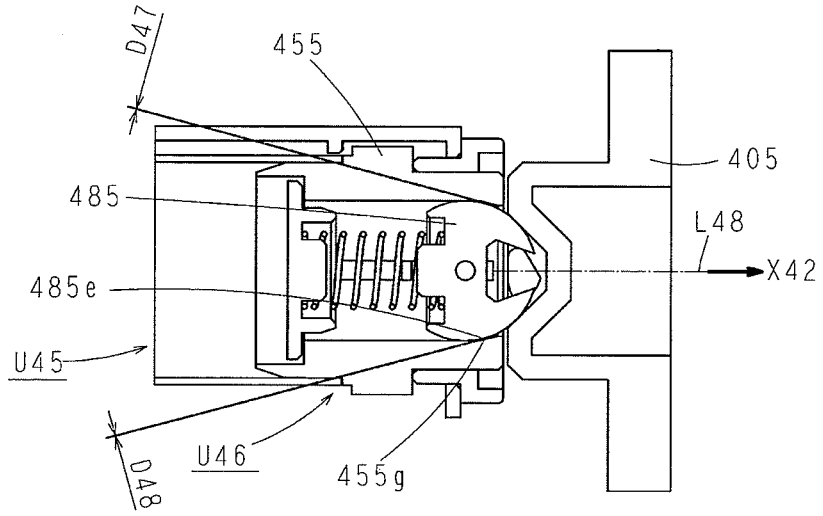

Referring to FIG. 45 to FIG. 47, a fourth embodiment of the present invention will be described. FIG. 45 is an illustration of a main assembly side engaging portion 400. Part (a) of FIG. 45 is a schematic perspective view of the main assembly side engaging portion 400, part (b) of FIG. 45 is a schematic sectional view taken along a flat surface S41 of the part (a) of FIG. 45. FIGS. 46 and 47 are illustrations of positioning of the photosensitive drum units U41 and U45. The description will be made with an example in which a rotational force applying portion 400*a*1 and a rotational force receiving portion 480*a*3 are contacted each other, or a rotational force applying portion 405*a*1 and a rotational force receiving portion 485*a*3 are contacted each other, so that rotational forces can be transmitted.

In this embodiment, a positioning method of the coupling members 480 and 485 relative to main assembly A of the apparatus is different from the foregoing embodiment. First, the description will be made as to the example of the configuration of the coupling member 280 described with Embodiment 1.

Referring to FIG. 45, the main assembly side engaging portion 400 in this embodiment will be described. As shown in part (a) of FIG. 45, a portion of the main assembly side engaging portion 400 opposing the cartridge B is provided with a contact portion 400*h* in the form of a conical recess expanding toward the cartridge B. In this embodiment, an inside space of the conical shape of the contact portion 400*h* is called "space portion 400*f*". The space portion 400*f* covers the coupling member 480 during the rotational force transmission. The contact portion 400*h* is provided with rotational force applying portions 400*a*1, 400*a*2 arranged along a circumferential direction of an axis L43 of the main assembly side engaging portion 400. By the rotational force applying portions 400*a*1, 400*a*2, the rotational force is transmitted to the coupling member 480.

By providing the contact portion 400*h* with the rotational force applying portions 400*a*1, 400*a*2, the rotational force applying portions 400*a*1 and 400*a*2 are connected by the contact portion 400*h*, so that the strength rotational force applying portions 400*a*1, 400*a*2 can be enhanced. Therefore, the main assembly side engaging portion 400 can transmit the rotational force smoothly to the coupling member 480.

As to the drive gear portion 400*c* of the main assembly side engaging portion 400, the description of the foregoing embodiments applies.

Referring to FIG. 46, the description will be made as to a position of the coupling member 480 relative to the main assembly side engaging portion 400 in the rotational force transmission state.

As shown in part (a) of FIG. 46, when the cartridge B is placed in the mounting completion position, the coupling member 480 does not enter to the end into the space portion 400*f*, depending on the way of the contact between the rotational force applying portions 400*a*1, 400*a*2 and rotational force receiving portions 480*a*1, 480*a*2. At this time, clearances D41, D42 are formed between the contact portion 400*h* of the main assembly side engaging portion 400 and the main assembly contact portions 480*a*1, 480*b*1 of the coupling member 480. In addition, clearances D43, D44 are provided between a portion-to-be-contacted 480*e* of the coupling member 480 and a contact portion 450 *g* of a driving side flange (rotational force transmitted member) 450. Furthermore, depending on the positions, in a longitudinal direction, of the cartridge B and the photosensitive drum unit U41 relative to the main assembly A of the apparatus when the cartridge B is inserted into the main assembly A of the apparatus, a clearance D45 is formed between a end portion 450*k* of the opening of the driving side flange 450 and a end portion 400 *g* of the opening of the main assembly side engaging portion 400.

Also in this embodiment, rotational force receiving portions 480*a*3, 480*b*3 are inclined relative to an axis L42 of the coupling member 480 by θ41. When the rotational force is applied to the rotational force receiving portions 480*a*3, 480*b*3 from the main assembly side engaging portion 400, the coupling member 180 is moved in the direction of X41 of the axis L43 by the functions of the rotational force and an urging force of an urging member 170. As shown in part (b) of FIG. 46, the contact portion 400*h* of the main assembly side engaging portion 400 and the main assembly contact portions 480*a*1, 480*b*1 of the coupling member 480 are contacted to each other, by which the position of the coupling member 480 relative to the main assembly A of the apparatus in the direction of the axis L43 is determined.

In the state that the cartridge B is placed in the mounting completion position, the portion-to-be-contacted 480*e* of the coupling member 480 and the contact portion 450 *g* of the driving side flange 450 are contacted (part (b) of FIG. 46) to each other or not contacted to each other (clearances D43 and D44, part (c) of FIG. 46), depending on the positions of the cartridge B and the driving side flange 450 relative to the main assembly A of the apparatus in the direction of the axis L43. More particularly, in the part (b) and the part (c) of FIG. 46, the positions of the photosensitive drum unit U41 relative to the main assembly A of the apparatus are different, but one of them can be selected properly. Or, both may be permitted.

As described in the foregoing, with the structure of this embodiment, the number parts required to determine the position of the coupling member 480 relative to the main assembly side engaging portion 400 in the direction of the axis L43 can be reduced. Therefore, the variation in the amount of engagement between the coupling member 480 and the main assembly side engaging portion 400 can be reduced irrespective of the size of the clearance D45 in the mounting completion position.

The main assembly contact portions 480*a*1, 480*b*1 of the coupling member 480 have a part spherical shape, and the contact portion 400*h* of the main assembly side engaging portion 400 has a conical shape. Therefore, during the rotational force transmission, the center of the sphere portion of the main assembly contact portions 480*a*1, 480*b*1 of the coupling member 480 can be kept on the axis L43 of the main assembly side engaging portion 400. Therefore, the rotational force can be transmitted more stably at main assembly side engaging portion 400 to the coupling member 480.

The inclination 641 may be selected such that the rotational force can produce the effective to move the coupling member 480 or the photosensitive drum unit U41 in the direction of the X41 of the axis L43. However, when another means is provided to move the coupling member 480 or the photosensitive drum unit U41 in the direction of X41 of the axis L43, the inclination θ41 may be small. As shown in FIG. 47, in the rotational force transmission, the coupling member 485 moves in the direction of an arrow X42 parallel with the axis L48 of the main assembly side engaging portion 405, the coupling member 485 contacts the main assembly side engaging portion 405 in the direction of the axis L47 of the main assembly side engaging portion 405. By this, the position of the coupling member 485 can be determined in the direction of the axis L48 relative to the main assembly A of the apparatus, and therefore, the effects similar to the above-described effects can be provided. With such an example, a portion-to-be-contacted 485*e* of the coupling member 485 and a contact portion 455 *g* of the driving side flange 455 may be or may not be contacted to each other (part (a) and part (b) of FIG. 47), wherein the position of the photosensitive drum unit U45 relative to main assembly A of the apparatus are different. In such a case, a proper selection can be made similarly to the foregoing examples. Or, both may be permitted.

(Embodiment 5)

Figure 48:
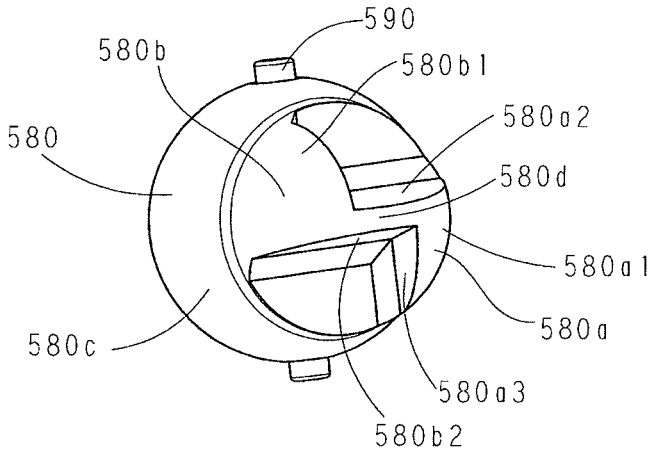
FIG. 48 is a schematic perspective view of a coupling member according to one embodiment of the present invention.
Figure 48:
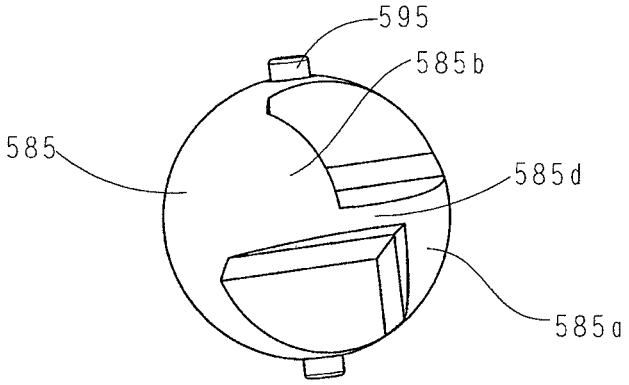

Referring to FIG. 48, a fifth embodiment of the present invention will be described. FIG. 48 is a schematic perspective view of coupling members 580 and 585.

In this embodiment, as shown in part (a) of FIG. 48, in the configuration of the coupling member 180 of Embodiment 1, a first projected portion 580*a* of the coupling member 580 and a second projected portion 580*b* thereof are connected with each other by a connecting portion 580*d*. As to the configurations and the arrangements of a main assembly contact portions 580*a*1, 580*b*1 constituting the first projected portion 580*a* and the second projected portion 580*b*, other main assembly contact portions 580*a*2, 580*b*2 and a rotational force receiving portions 580*a*3, 580*b*3, foregoing descriptions apply, and therefore, the description thereof will be omitted.

With such a structure of this embodiment, a rotational force receiving portion 580*a*3 of the first projected portion 580*a* and a rotational force receiving portion 580*b*3 of the second projected portion 580*b* are connected with each other. For this reason, the strengths of the rotational force receiving portion 580*a*3, 580*b*3 can be enhanced. The coupling member 580 can transmit a rotational force to the photosensitive drum 10 further smoothly.

As shown in part (b) of FIG. 48, also as to the configuration of the coupling member 280 of Embodiment 2, the first projected portion 585*a* of the coupling member 585 and the second projected portion 585*b* thereof may be connected by a connecting portion 585*d*. In this case, the same effects can be provided.

As to the engaging operation of the coupling member 580, 585 to the main assembly side engaging portion, the disengaging operation from the main assembly side engaging portion, and the state of receiving the rotational force from the main assembly side engaging portion, the foregoing descriptions apply, and therefore, the description thereof is omitted.

(Embodiment 6)

Figure 49:
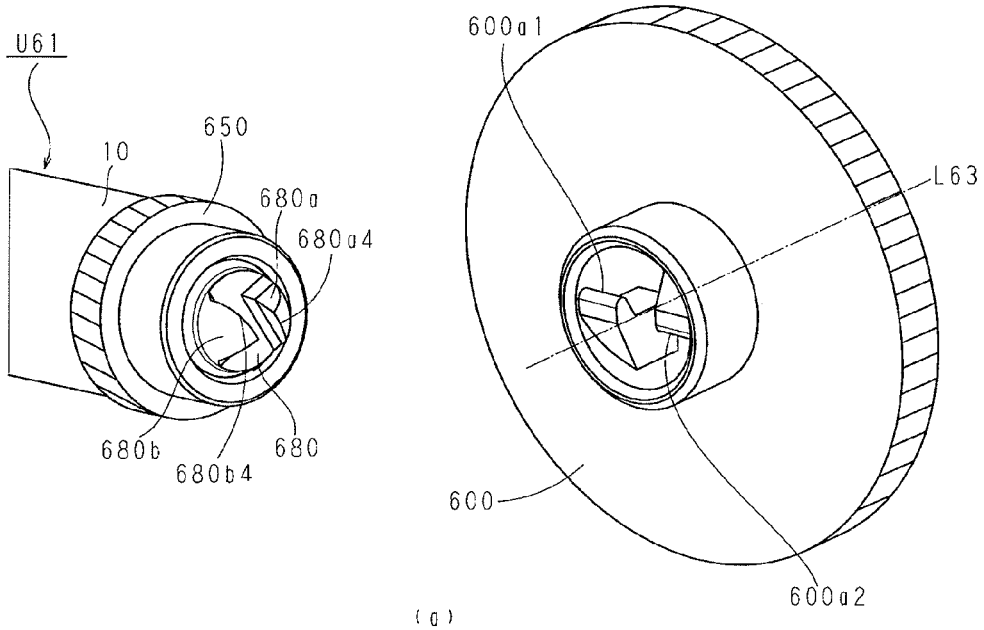
FIG. 49 is a schematic perspective view of the photosensitive drum unit and the main assembly side engaging portion, and an illustration of a state in which the coupling member is engaged with the main assembly side engaging portion, according to one embodiment of the present invention.
Figure 49:
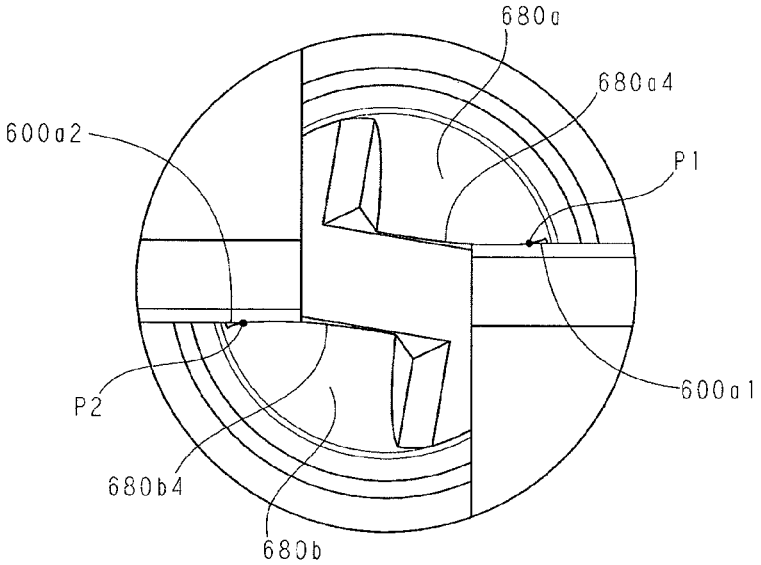
Figure 50:
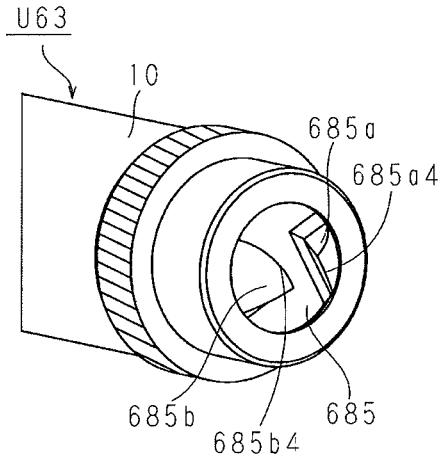
FIG. 50 is a schematic perspective view of the photosensitive drum unit and an illustration of a state in which the coupling member is engaged with the main assembly side engaging portion, according to one embodiment of the present invention.
Figure 50:
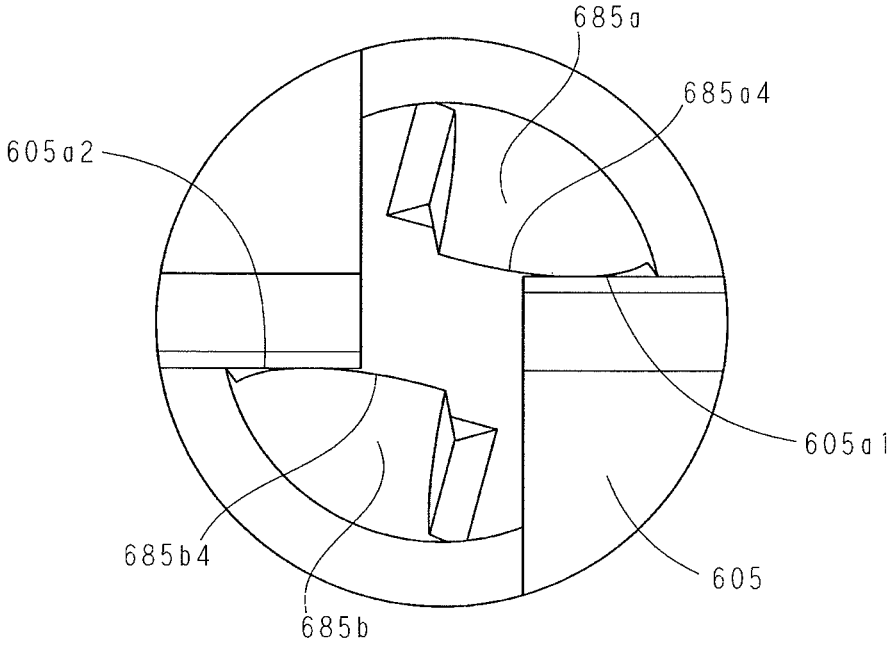

Referring to FIGS. 49 and 50, a sixth embodiment of the present invention will be described. Part (a) of FIG. 49 is a schematic perspective view of a photosensitive drum unit U61 and a main assembly side engaging portion 600, part (b) of FIG. 49 is an illustration of a coupling member 680 and the main assembly side engaging portion 600 in the rotational force transmitting state as seen from a driving side along an axis L63 of the main assembly side engaging portion 600. Part (a) of FIG. 50 is a schematic perspective view of a photosensitive drum unit U63, and part (b) of FIG. 50 is an illustration of the coupling member 685 and a main assembly side engaging portion 605 in the rotational force transmitting state seen from the driving side.

This embodiment is different from the foregoing embodiments in the contact portion for transmitting the rotational force from the main assembly side engaging portion 600 to the coupling member 680. The description will be made as to the example of the configuration of the coupling member 180 described with Embodiment 1.

As shown in FIG. 49, in the coupling member 680 of this embodiment, ridges 680*a*4, 680*b*4 constituting a first projected portion 680*a* and a second projected portion 680*b* contacts rotational force applying portions 600*a*1, 600*a*2 of the main assembly side engaging portion 600 to receive the rotational force. Therefore, the rotational force applying portions 600*a*1, 600*a*2 and the ridges 680*a*4, 680*b*4 contact to each other at points P1, P2 depicted in the part (b) of FIG. 49, respectively. From the standpoint of the strength of the coupling member 180, it is preferable that the contact points P1, P2 are selected such that a radius of the rotational force transmission from the main assembly side engaging portion 600 to the coupling member 680 is large.

With such a structure of this embodiment, a positional change of the contact points P1, P2 attributable to a variation of the dimensions of the coupling member 680 and the main assembly side engaging portion 600 can be suppressed. Therefore, the rotational force can be transmitted with high accuracy and with small change of the rotational force transmission radius.

In this embodiment, the ridges 680*a*4, 680*b*4 as a rotational force receiving portion have shapes of edge, but this is not inevitable, and the ridges 680*a*4, 680*b*4 may be beveled or rounded. For this reason, the strengths of the rotational force receiving portion 680*a*3, 680*b*3 can be enhanced.

In this embodiment, the description has been made taking the configuration of the coupling member 180 of Embodiment 1 for instance. However, as shown in FIG. 50, the configuration of the coupling member 280 of Embodiment 2 may be used, and in such a case, ridges 685*a*4, 685*b*4 constituting the first projected portion 685*a* and the second projected portion 685*b* of the coupling member 685 contact the rotational force applying portions 605*a*1, 605*a*2 of the main assembly side engaging portion 605 to receive the rotational force. In this case, the same effects can be provided.

(Embodiment 7)

Figure 51:
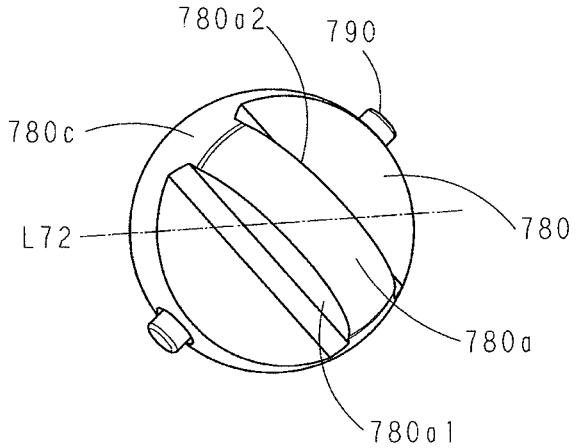
FIG. 51 is a schematic perspective view of the coupling member and the main assembly side engaging portion according to one embodiment of the present invention.
Figure 51:
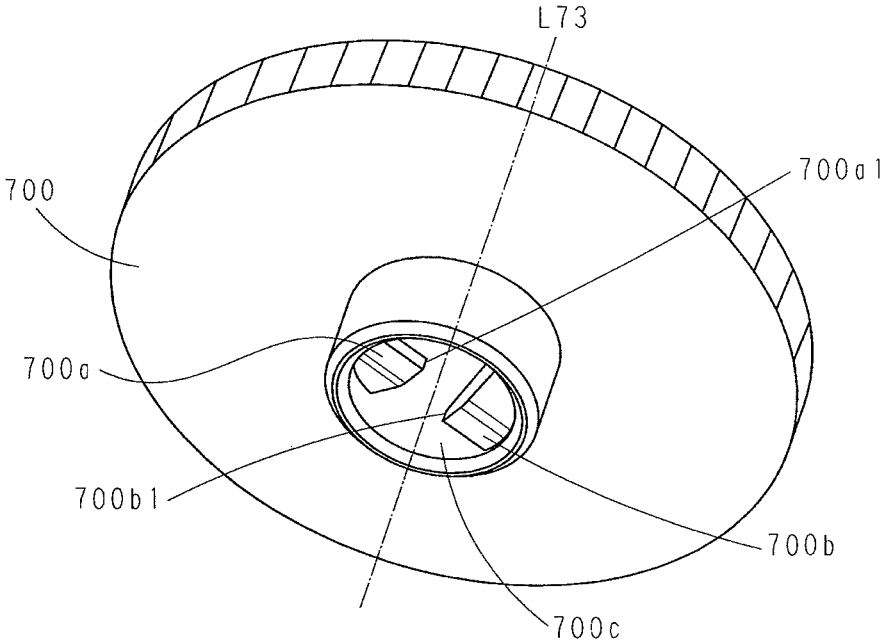
Figure 52:
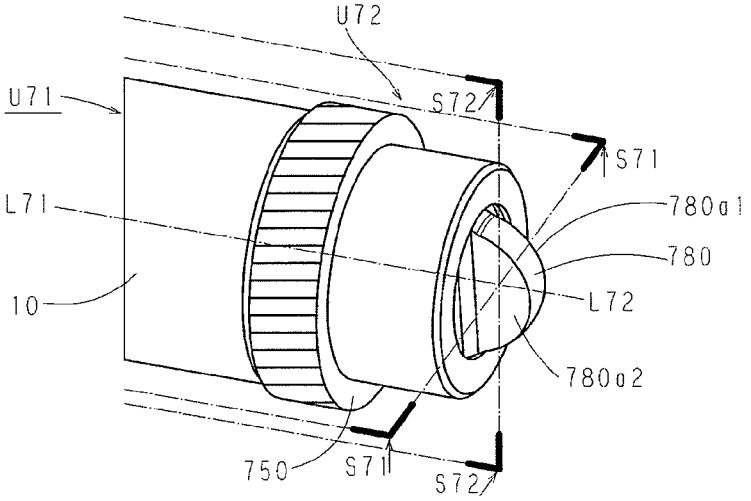
FIG. 52 is a schematic perspective view and a schematic sectional view of the photosensitive drum unit according to one embodiment of the present invention.
Figure 52:
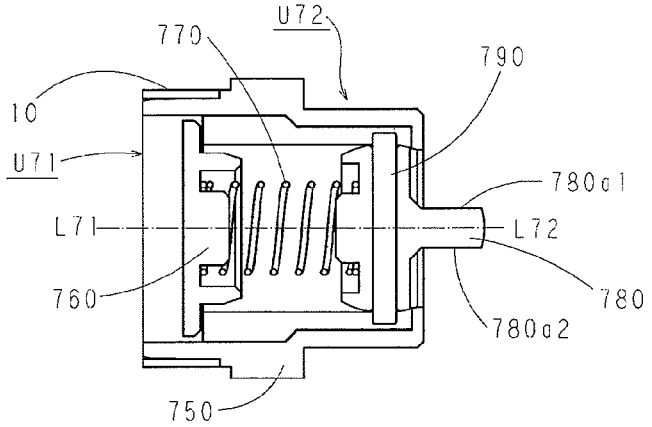
Figure 52:
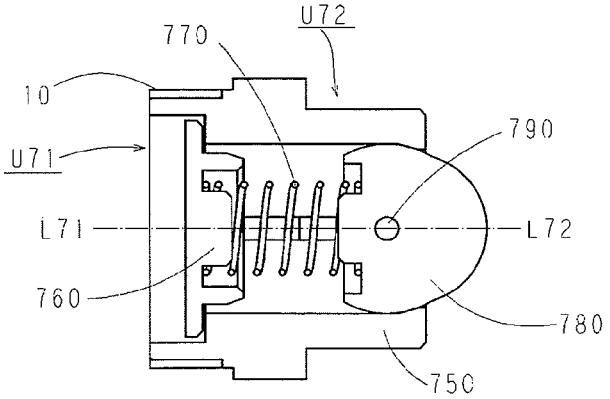
Figure 53:
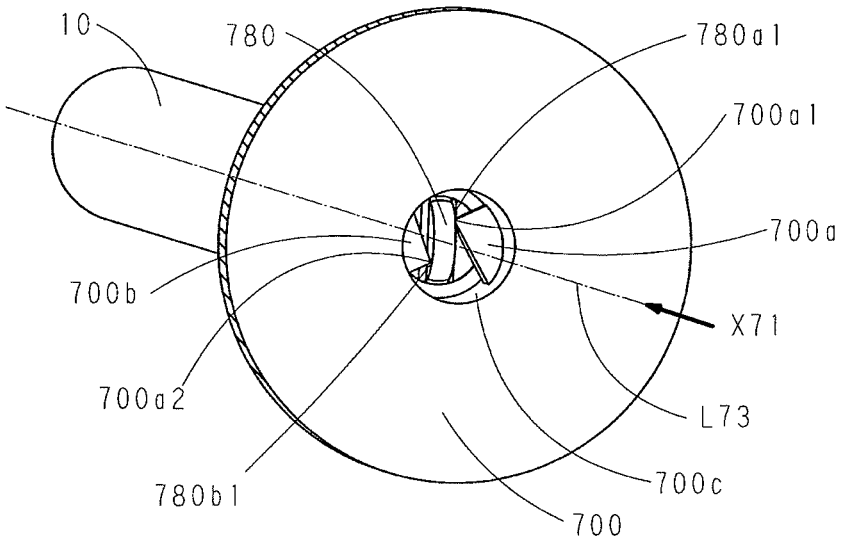
FIG. 53 is an illustration showing a state in which the coupling member is engaged with the main assembly side engaging portion, according to one embodiment of the present invention.
Figure 53:
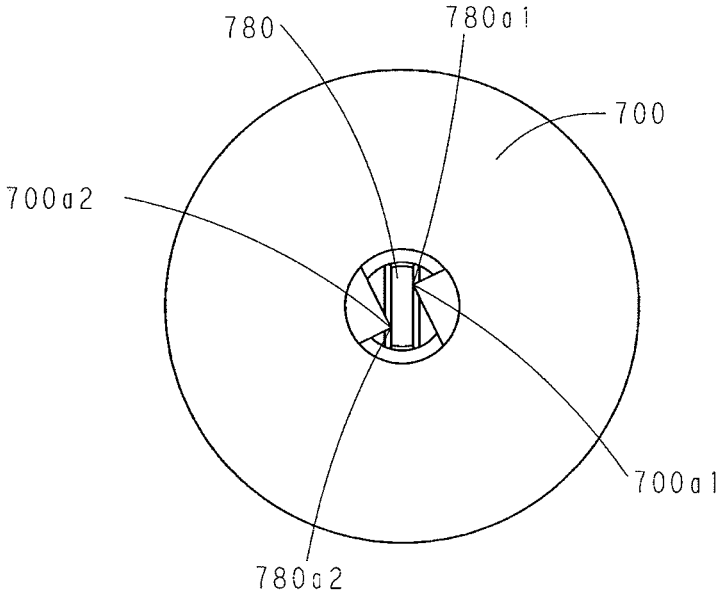

Referring to FIGS. 51 to 53, a seventh embodiment of the present invention will be described. Part (a) of FIG. 51 is a schematic perspective view of a coupling member 780, and part (b) of FIG. 51 is a schematic perspective view of an engaging portion 700. Part (a) of FIG. 52 is a schematic perspective view of the photosensitive drum unit U71 having incorporated the coupling member 780, as seen from a driving side. Part (b) of FIG. 52 is a schematic sectional view taken along a plane S71 of the part (a) of FIG. 52, part (c) of FIG. 52 is a schematic sectional view taken along a plane S72 of part (a) of FIG. 52. Part (a) of FIG. 53 is a schematic perspective view of the coupling member 780 and the main assembly side engaging portion 700 which are coupled with each other, and part (b) of FIG. 53 is an illustration thereof as seen in a direction of an arrow X71 of the part (a) of FIG. 53.

This embodiment is different from Embodiment 6 in the contact portion for transmitting the rotational force from the main assembly side engaging portion 700 to the coupling member 780. The description will be made as to the example of the configuration of the coupling member 180 described with Embodiment 1.

As shown in part (a) of FIG. 51, the spherical shape constituting a portion-to-be-guided 780*c* of the coupling member 780 is directly provided with a projection 780*a* of a flat plate shape, and front and back sides of the projection 780*a* have rotational force receiving portions 780*a*1 and 780*a*2.

Rotational force receiving portions 780*a*1, 780*a*2 may be formed such that they are inclined surfaces relative to an axis L72 of the coupling member 780 similarly to the above-described embodiments.

As to the structure or the like in which the coupling member 780 is guided by a driving side flange (rotational force transmitted member) 750, the coupling member 780 moves in the direction of an axis L71 of the driving side flange 750, and the axis L72 of the coupling member 780 inclines relative to the axis L71, the description in the above-described embodiments applies, and therefore, the description thereof is omitted.

As shown in part (b) of FIG. 51, a first projected portion 700*a* and a second projected portions 700*b* which constitute a rotational force applying portion are formed extending from an inner wall 700*c* of the main assembly side engaging portion 700. The sides of the first projected portion 700*a* and the second projected portion 700*b* closer to an axis L73, there are provided ridges 700*a*1, 700*b*1 constituting the rotational force applying portion. As shown in FIG. 53, the ridges 700*a*1, 700*b*1 contact the rotational force receiving portions 780*a*1 and 780*a*2 of the coupling member 780 to transmit the rotational force.

With the structure of this embodiment described above, the positions of the contact portions (rotational force transmitting portion) for transmitting the rotational force can be determined definitely. Therefore, a variation of the position of the rotational force transmitting portion can be suppressed, so that the rotational force can be transmitted with high accuracy.

In this embodiment, the contact portions between the rotational force applying portions 700*a*1, 700*a*2 and the rotational force receiving portions 780*a*1, 780*a*2 have edge configuration of the ridges. However, the ridges may be beveled or rounded. By doing so, strength of the rotational force applying portions 700*a*1, 700*a*2 can be enhanced.

In this embodiment, the configuration of the coupling member 180 of Embodiment 1 is used, but the configuration of the coupling member 280 of the Embodiment 2 may be used with the similar effect.

(Embodiment 8)

Figure 54:
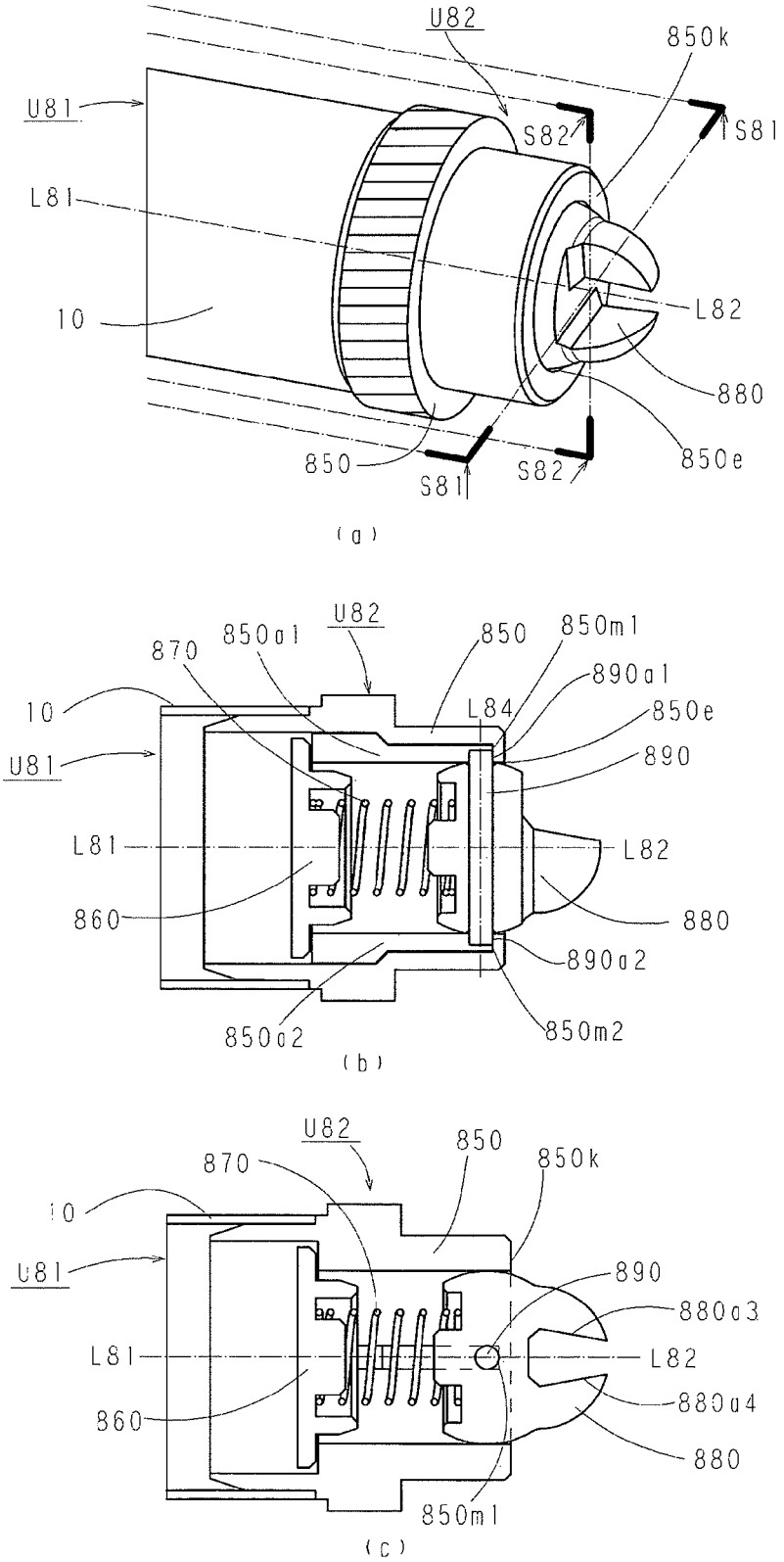
FIG. 54 is a schematic perspective view and a schematic sectional view of the photosensitive drum unit according to one embodiment of the present invention.
Figure 55:
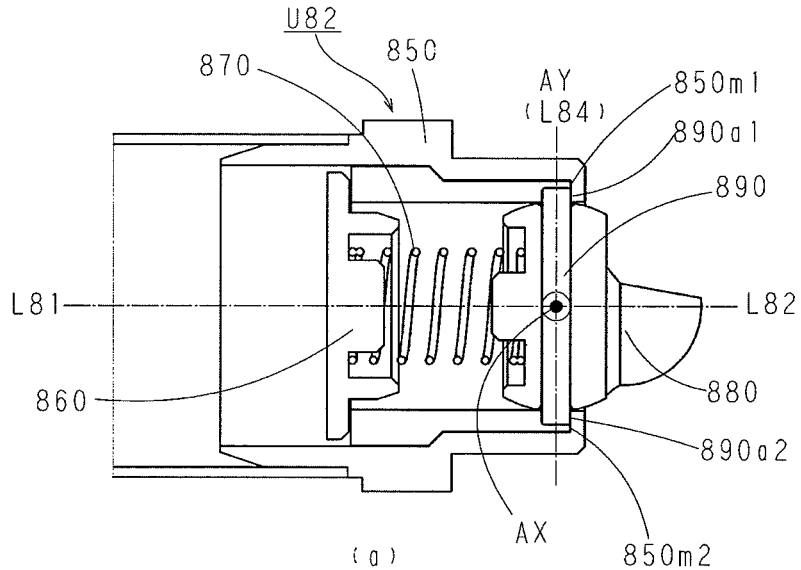
FIG. 55 is a schematic sectional view showing a state in which the coupling member is inclined relative to the driving side flange according to one embodiment of the present invention.
Figure 55:
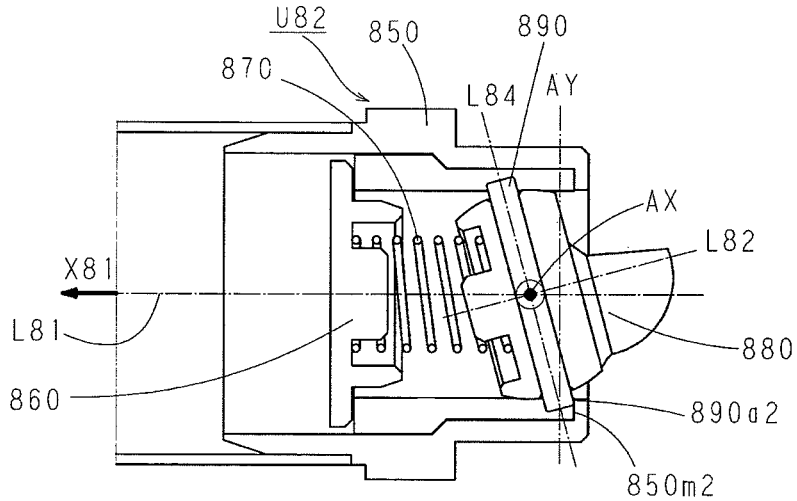
Figure 56:
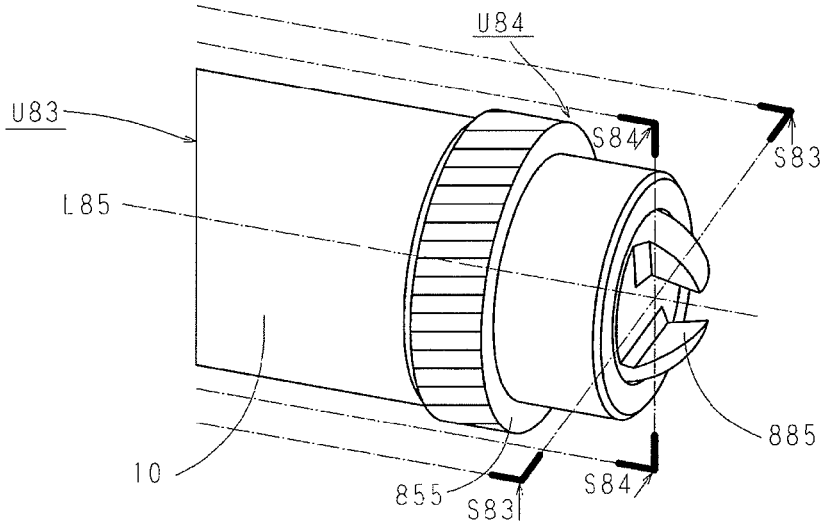
FIG. 56 is a schematic perspective view and a schematic sectional view of the photosensitive drum unit according to one embodiment of the present invention.
Figure 56:
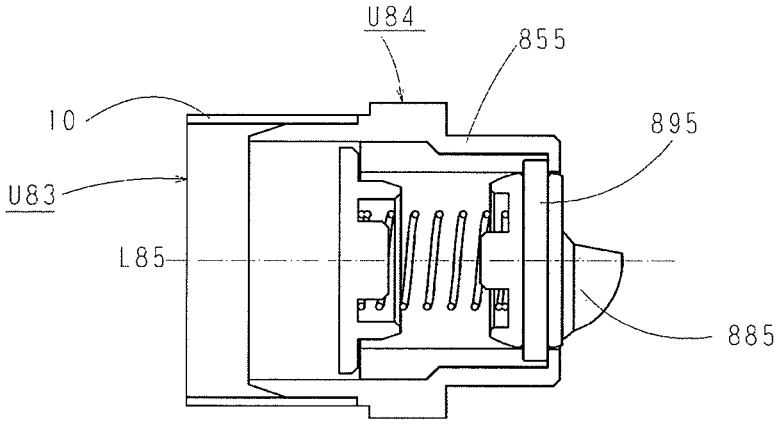
Figure 56:
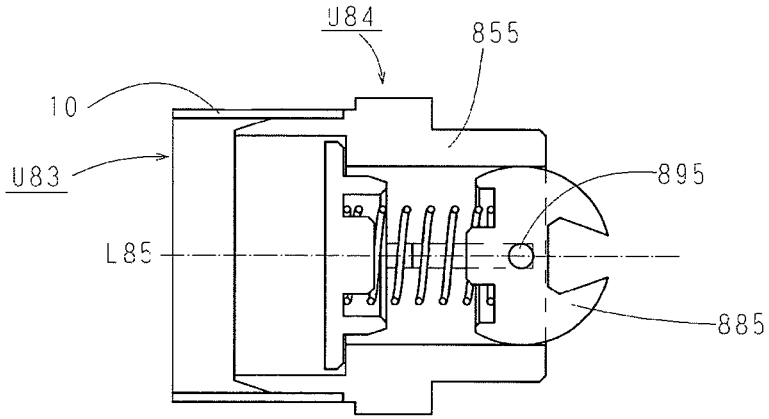

Referring to FIGS. 54 to 56, an eighth embodiment of the present invention will be described. Part (a) of FIG. 54 is a schematic perspective view of the photosensitive drum unit U81 having incorporated the coupling member 880, as seen from a driving side. Part (b) of FIG. 54 is a schematic sectional view taken along a plane S81 of the part (a) of FIG. 54, part (c) of FIG. 54 is a schematic sectional view taken along a plane S82 of part (a) of FIG. 54. FIG. 55 is a schematic sectional view showing an inclined state of the coupling member 880. Part (a) of FIG. 56 is a schematic perspective view of the photosensitive drum unit U83 having incorporated the coupling member 885, as seen from a driving side. Part (b) of FIG. 56 is a schematic sectional view taken along a plane S83 of the part (a) of FIG. 56, part (c) of FIG. 56 is a schematic sectional view taken along a plane S84 part (a) of FIG. 56.

The embodiment is different from the above-described embodiments in the positioning (retention) of the coupling member 880 relative to a driving side flange (rotational force transmitted member) 850. As shown in part (a) of FIG. 54, the description will be made taking the configuration of the coupling member 180 of Embodiment 1 for instance.

As shown in parts (b) and (c) of FIG. 54, in the direction of the axis L81 of the driving side flange 850, the coupling member 880 is positioned to the driving side flange 850 by a drive pin 890 fixed to the coupling member 880. At this time, the coupling member 880 receives an urging force of an urging member 870 to be urged toward the driving side along the axis L81. End portions 890*a*1, 890*a*2 of the drive pin 890 contact groove end portions 850*m*1, 850*m*2 of groove portions (rotational force transmitted portions) 850*a*1, 850*a*2 accommodating the end portions 890*a*1 and 890*a*2 of the drive pin 890 of the driving side flange 850, respectively, so that the coupling member 880 do not disengage from an opening 850*e* of the driving side flange 850.

Referring to FIG. 55, an inclining operation of the coupling member 880 will be described.

As shown in part (a) of FIG. 55, an axis AX is perpendicular to an axis L82 of the coupling member 880 and an axis L84 of the drive pin 890, and an axis AY is co-axial with the axis L84. As shown in part (b) of FIG. 55, the coupling member 880 is inclined counterclockwisely about the axis AX. At this time, the axis L82 of the coupling member 880 inclines relative to the axis L81 while keeping the contact between the end portion 890*a*2 of the drive pin 890 and the groove end portion 850*m*2 of the driving side flange 850. In other words, the coupling member 880 inclines about a fulcrum which is the contact portion between the end portion 890*a*2 of the drive pin 890 and the groove end portion 850*m*2 of the driving side flange 850. Simultaneously, the coupling member 880 moves in the direction of an arrow X81 parallel with the axis L81.

On the other hand, when the coupling member 880 is inclined central the axis AY, the situation is similar to Embodiment 1, and therefore, the description is omitted.

As described in the foregoing, with the structure of this embodiment, as compared with Embodiment 1, the position of the drive pin 890 in the direction of the axis L81 can be made closer to the main assembly side engaging portion. Therefore, the distance along the axis L82 from the contact portion between the coupling member 880 and the rotational force applying portion of the main assembly side engaging portion of the rotational force receiving portion 880*a*3, 880*b*3 to the drive pin 890 can be made smaller. Therefore, the twisting amount of the coupling member 880 during the rotational force transmission can be reduced, and therefore, the coupling member 880 can transmit the rotational force to the photosensitive drum 10 further smoothly.

In this embodiment, the description has been made taking the configuration of the coupling member 180 of Embodiment 1 for instance. However, as shown in FIG. 56, the configuration of the coupling member 280 of the Embodiment 2 may be used similarly, in which case the coupling member 885 is positioned (retained) relative to the driving side flange 855 by a drive pin 895. In this case, too, the position of the drive pin 895 in the direction of an axis L85 of the driving side flange (rotational force transmitted member) can be made closer to the main assembly side engaging portion.

(Embodiment 9)

Figure 57:
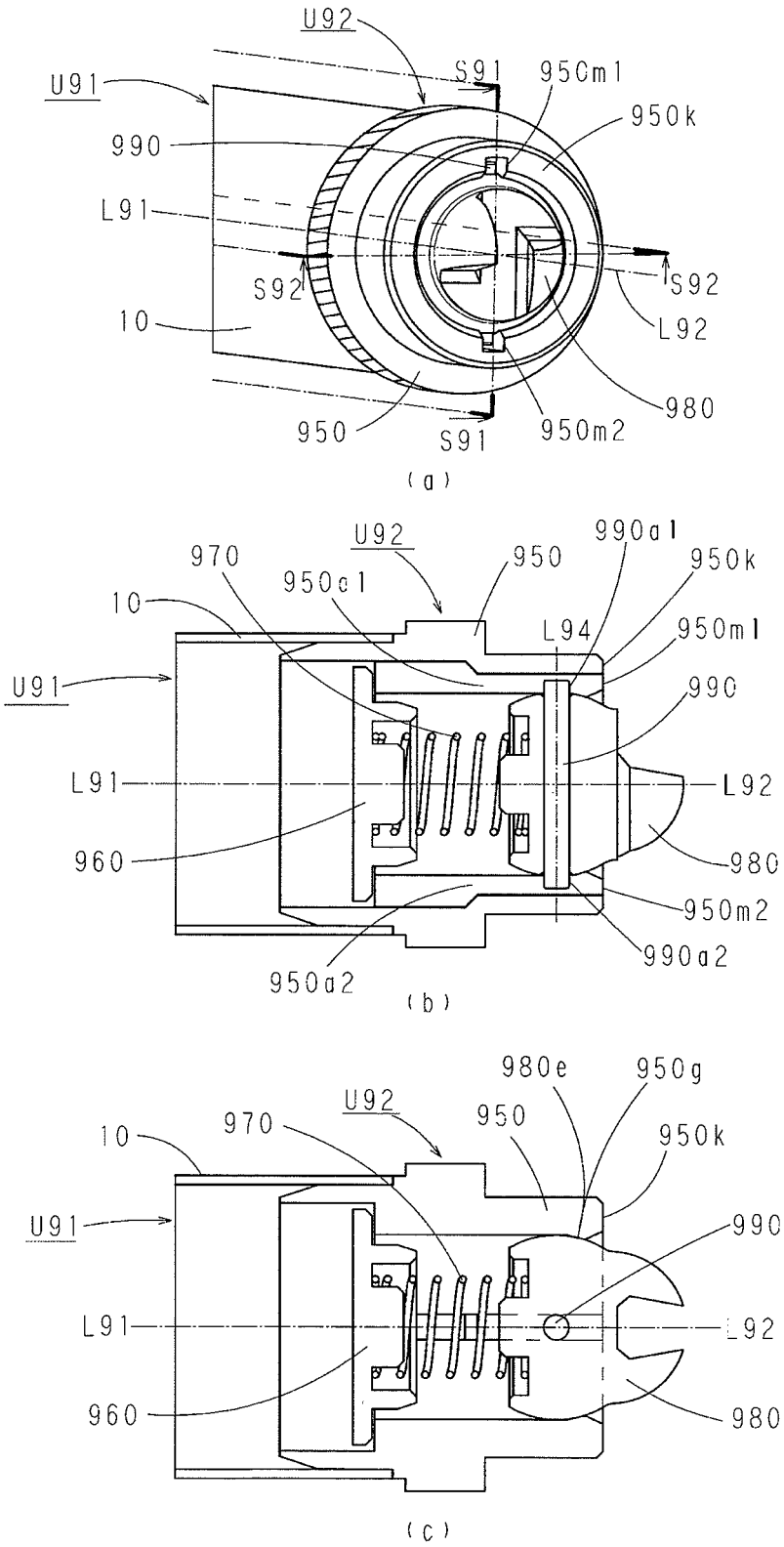
FIG. 57 is a schematic perspective view and a schematic sectional view of the photosensitive drum unit according to one embodiment of the present invention.
Figure 58:
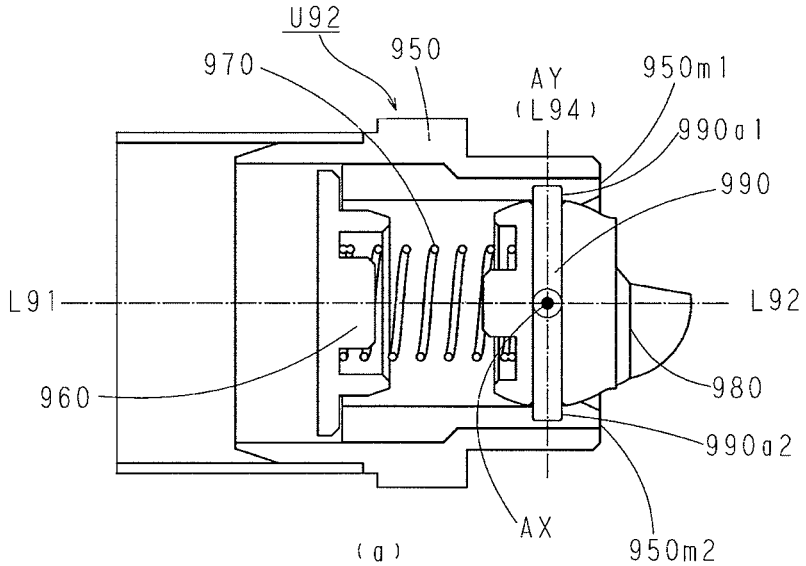
FIG. 58 is a schematic sectional view showing a state in which the coupling member is inclined relative to the driving side flange according to one embodiment of the present invention.
Figure 58:
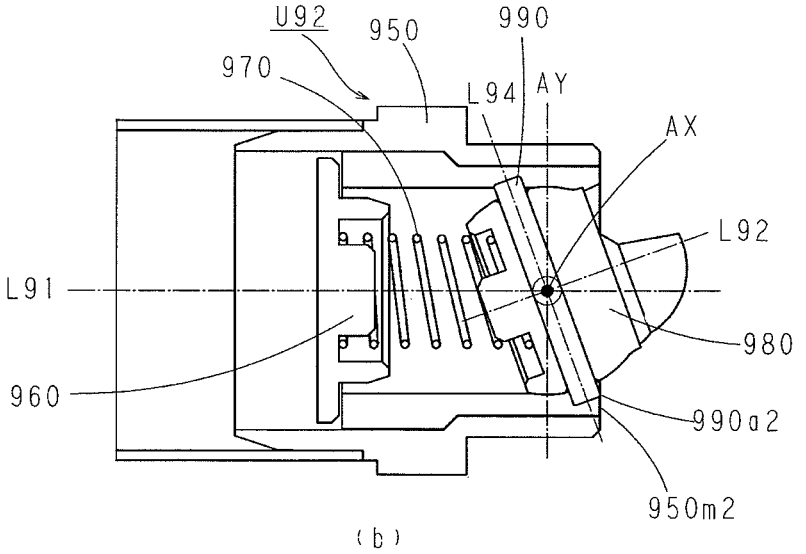
Figure 59:
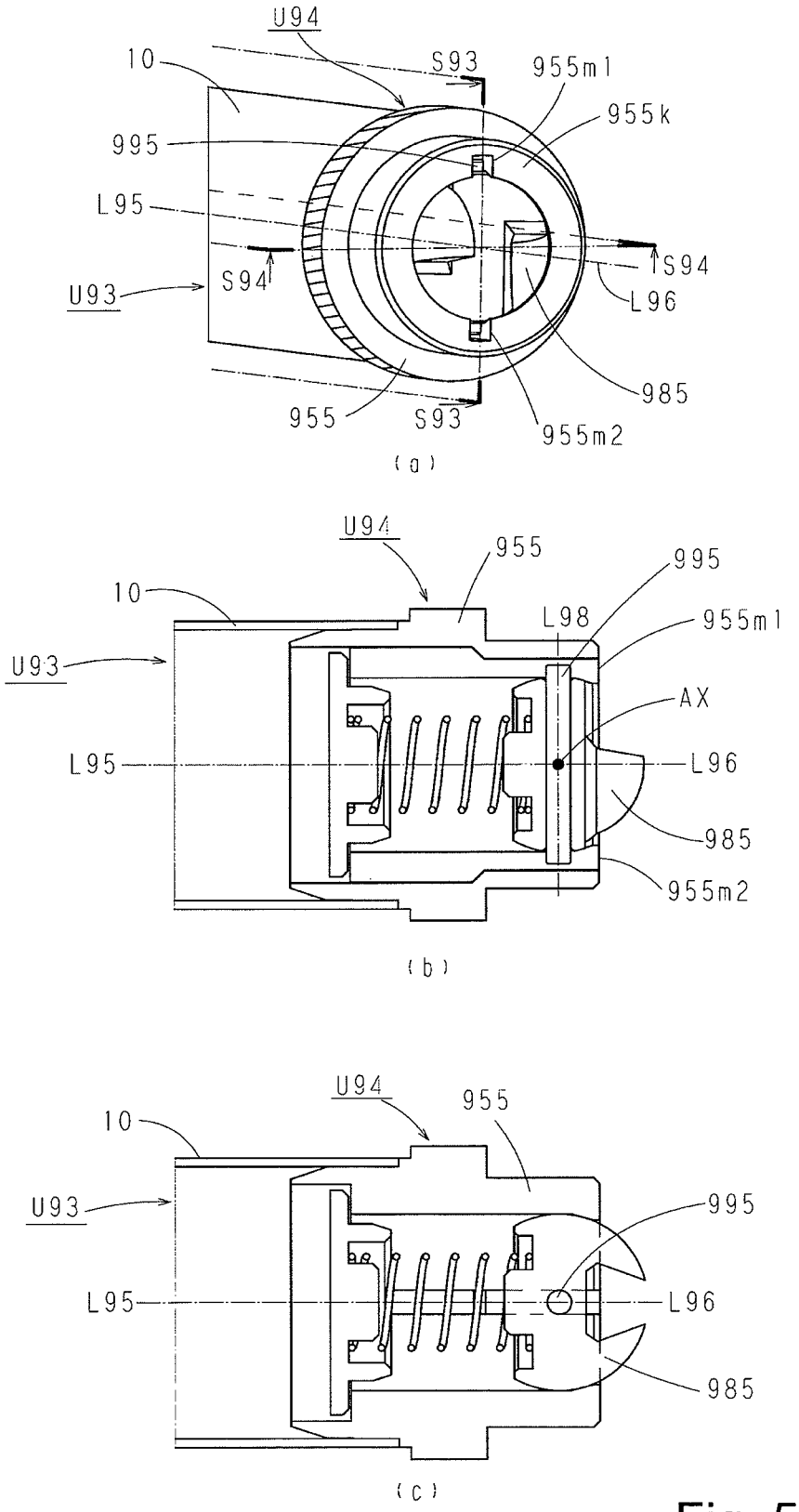
FIG. 59 is a schematic perspective view and a schematic sectional view of the photosensitive drum unit according to one embodiment of the present invention.

Referring to FIGS. 57 to 59, a ninth embodiment of the present invention will be described. FIG. 57 is an illustration of a driving side flange unit U92 incorporating a coupling member 980. Part (a) of FIG. 57 is a schematic perspective view of the photosensitive drum unit U91 having incorporated the coupling member 980, as seen from a driving side. Part (b) of FIG. 57 is a schematic sectional view taken along a plane S91 of the part (a) of FIG. 57, part (c) of FIG. 57 is a schematic sectional view taken along a plane S92 of part (a) of FIG. 57. FIG. 58 is a schematic sectional view showing an inclined state of the coupling member 980. FIG. 59 is a schematic perspective view of a photosensitive drum unit U93 incorporating a coupling member 985, as seen from the driving side. Part (b) of FIG. 59 is a schematic sectional view taken along a flat surface S93 of the part (a) of FIG. 59, and part (c) of FIG. 59 is a schematic sectional view taken along a flat surface S94 of the part (a) of FIG. 59.

This embodiment uses groove end portions 950*m*1, 950*m*2, different from the foregoing embodiments, of the groove portion (rotational force receiving portions) 950*a*1, 950*a*2 accommodating end portions 990*a*1, 990*a*2 of a drive pin 990 of a driving side flange (rotational force transmitted member) 950. As shown in part (a) of FIG. 57, the description will be made taking the configuration of the coupling member 180 of Embodiment 1 for instance.

As shown in parts (a) and (b) of FIG. 57, the groove end portions 950*m*1, 950*m*2 of the driving side flange 950 are cut-away, and the groove portions (rotational force transmitted portion) 950*a*1, 950*a*2 extends to an opening of the end portion 950*k* of the driving side flange 950. As shown in part (c) of FIG. 57, a portion-to-be-contacted 980*e* of the coupling member 980 abuts to a contact portion 950 *g* of the driving side flange 950, by which the coupling member 980 is prevented from disengaging from the driving side flange 950.

Referring to FIG. 58, an inclining operation of the coupling member 980 will be described.

Part (a) of FIG. 58 shows a state in which the coupling member 980 is not inclined. In this state, an axis AX is perpendicular to an axis L92 of the coupling member 980 and an axis L94 of the drive pin 990, and an axis AY is co-axial with the axis L94. Part (b) of FIG. 58 shows a state in which the coupling member 980 is inclined counterclockwisely about the axis AX. At this time, end portion 990*a*2 of the drive pin 990 does not contact the driving side flange, and therefore, the coupling member 980 can incline greatly about the axis AX.

On the other hand, when the coupling member 980 is inclined central the axis AY, the situation is similar to Embodiment 1, and therefore, the description is omitted.

The structure of this embodiment described above is effective when it is required to incline greatly the axis L92 of the coupling member 980 relative to the axis L1 of the driving side flange 950 during the rotational force transmission of the coupling member 980 or upon the dismounting of the cartridge B.

In this embodiment, the configurations of the driving side flange 150 of the coupling member 180 of Embodiment 1 are used. However, as shown in FIG. 59, the configurations of the coupling member 280 and the driving side flange 250 are similarly usable, in which the groove end portions 955*m*1, 955*m*2 of the driving side flange (rotational force transmitted member) 955 are cut away. In this case, similarly to the above-described case, the axis L96 of the coupling member 985 can incline greatly relative to the axis L95 of the driving side flange 955 about the axis AX perpendicular to the axis L96 of the coupling member 985 and the axis L98 of the drive pin 995.

(Embodiment 10)

Figure 60:
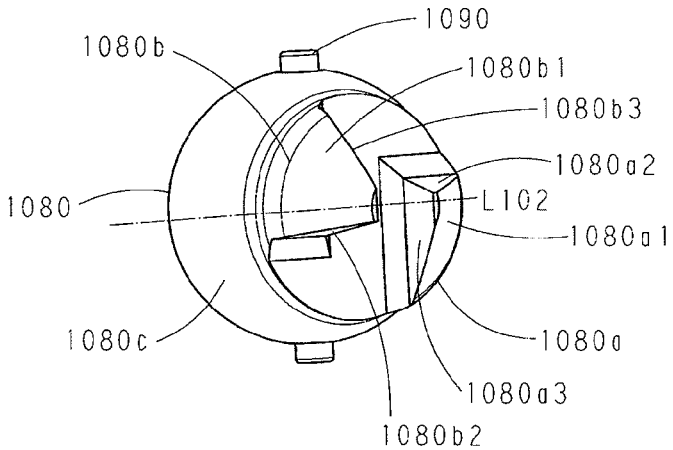
FIG. 60 is an illustration of the coupling member according to one embodiment of the present invention.
Figure 60:
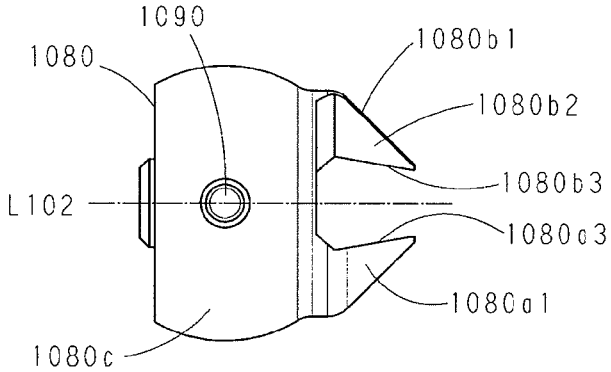
Figure 60:
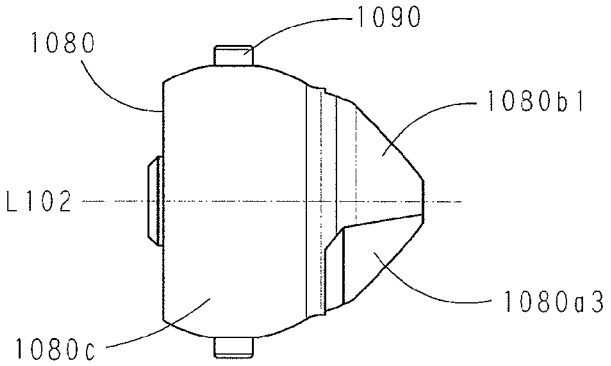
Figure 61:
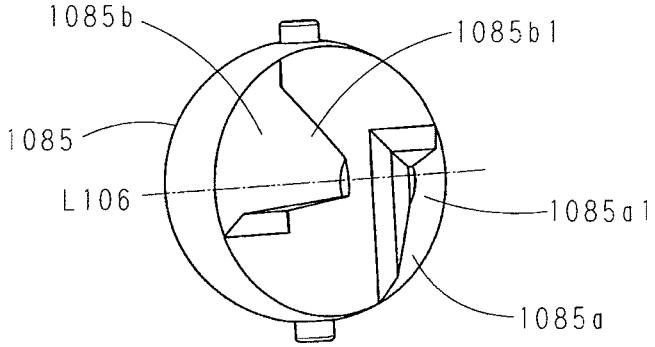
FIG. 61 is an illustration of the coupling member according to one embodiment of the present invention.
Figure 61:
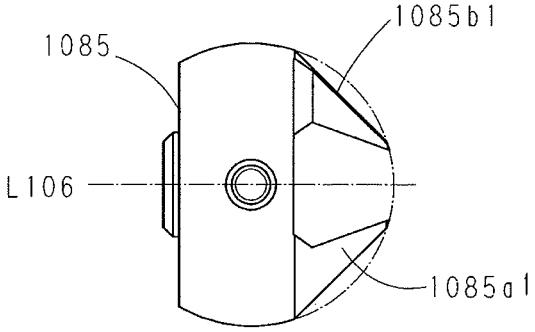
Figure 61:
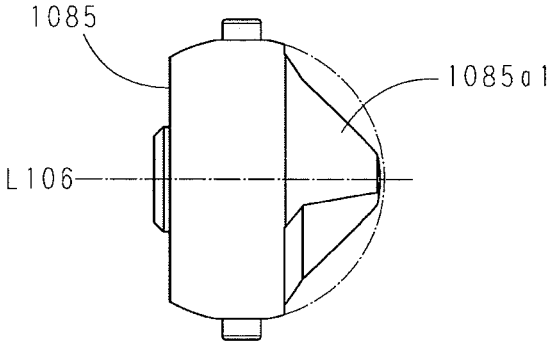

Referring to FIGS. 60 and 61, a tenth embodiment of the present invention will be described. FIGS. 60 and 61 are illustrations of a coupling member 1080 and a coupling member 1085 of this embodiment, respectively.

This embodiment is different from the above-described Embodiment 1 in the configurations of main assembly contact portions 1080*a*1 and 1080*b*1 of the coupling member 1080, as shown in part (a) of FIG. 60.

In the configuration of the coupling member 180 of Embodiment 1, the main assembly contact portions 180*a*1, 180*b*1 are parts of the spherical surface. As shown in parts (b) and (c) of FIG. 60, the main assembly contact portions 1080*a*1, 1080*b*1 of this embodiment are parts of a conical shape having a center axis coaxial with an axis L102 of the coupling member 1080. A center of gravity of a plane taken along a plane perpendicular to the axis L102 of the coupling member 1080 approaches to the axis L102 toward a free end portion of the coupling member 1080 (driving side in the direction of the axis L102).

As to the configurations and arrangements of the other main assembly contact portions 1080*a*2, 1080*b*2 constituting a first projected portion 1080*a* and a second projected portion 1080*b*, and rotational force receiving portions 1080*a*3, 1080*b*3, the description of Embodiment 1 applies.

With the structure of this embodiment described above, even if a contact position varies when the main assembly contact portions 1080*a*1, 1080*b*1 contact parts provided in the main assembly A of the apparatus upon a mounting operation of the cartridge B, the coupling member 1080 can be moved stably along an axis of the driving side flange. As a result, a usability performance upon mounting of the cartridge B to the main assembly A of the apparatus is improved.

As shown in part (a) of FIG. 61, as to the configuration of the coupling member 280 of Embodiment 2, a main assembly contact portion 1085*a*1, 1085*b*1 of the coupling member 1085 may be a part of a conical shape having a center axis coaxial with an axis L106. At this time, as shown in parts (b) and (c) of FIG. 61, the main assembly contact portions 1085*a*1, 1085*b*1 are inside the spherical constituting a portion-to-be-supported 1085*c* of the coupling member 1085. By doing so; in addition to the above-described effects, no additional space is required to incline the axis L106 of the coupling member 1085 relative to the axis of the driving side flange. Therefore, as compared with the above-described coupling member 1080, the main assembly A of the apparatus and/or the cartridge B can be downsized.

(Embodiment 11)

Figure 62:
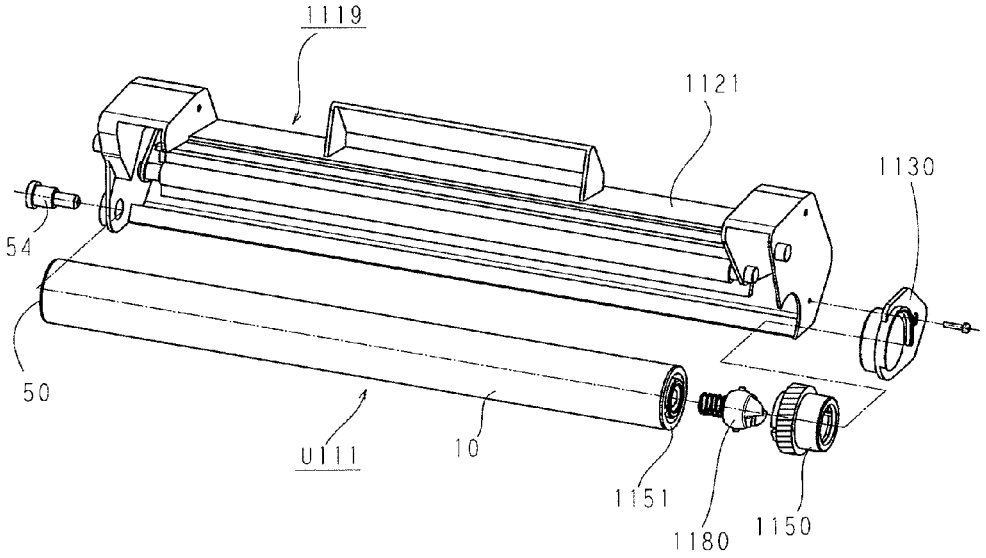
FIG. 62 is a schematic perspective view showing mounting of the photosensitive drum unit to second frame unit according to one embodiment of the present invention.
Figure 63:
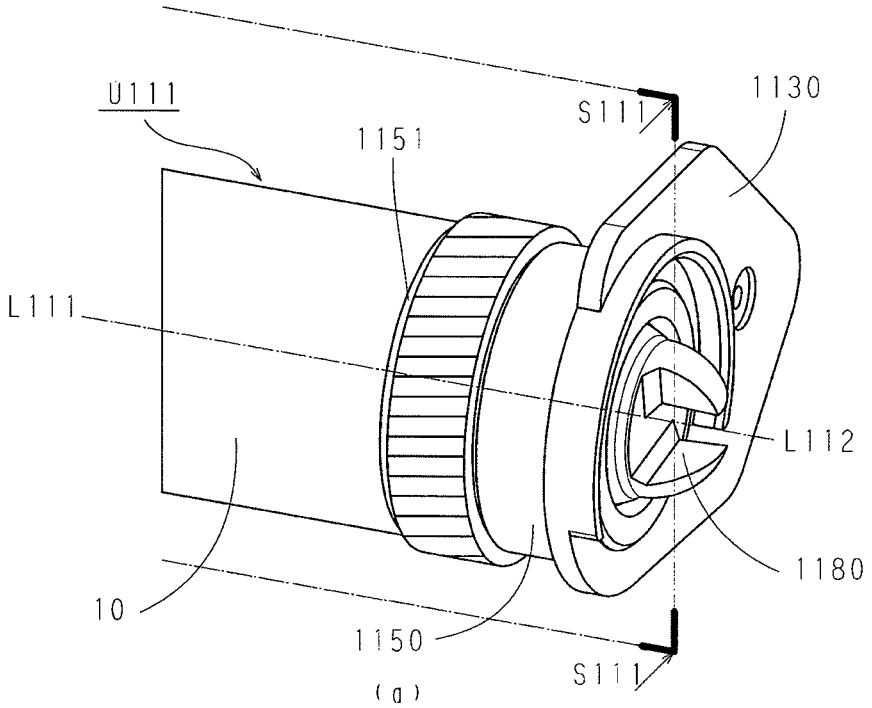
FIG. 63 is a schematic perspective view and a schematic sectional view of the photosensitive drum unit and a drum shaft reception according to one embodiment of the present invention.
Figure 63:
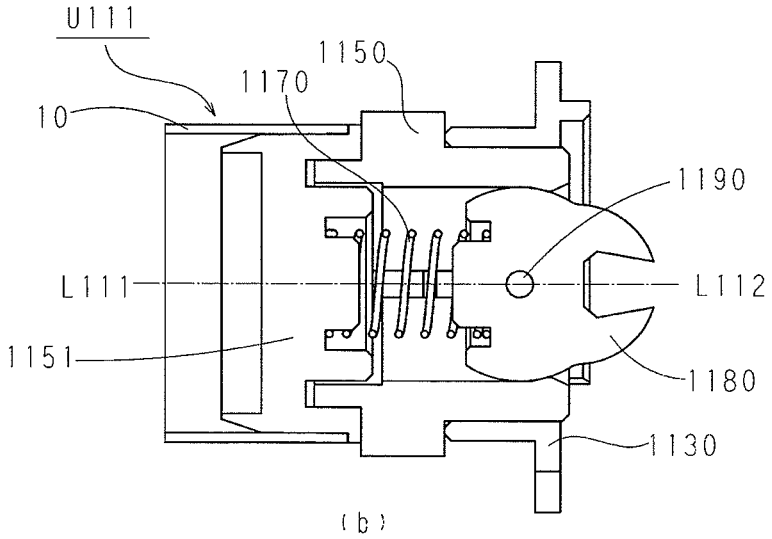
Figure 64:
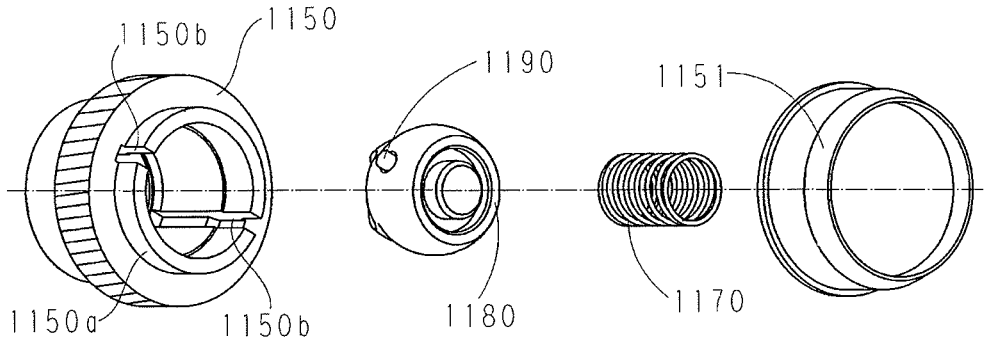
FIG. 64 is an exploded schematic perspective view of the photosensitive drum unit according to one embodiment of the present invention.
Figure 64:
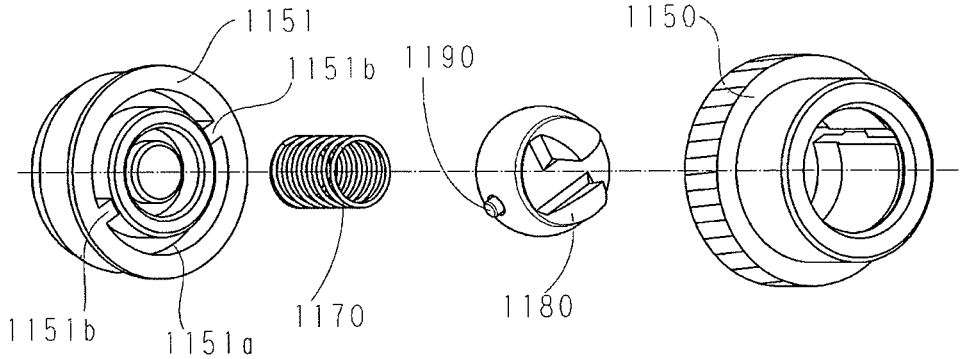

Referring to FIGS. 62 to FIG. 64, an eleventh embodiment of the present invention will be described. FIG. 62 is an illustration showing a state in which a photosensitive drum unit U111 is incorporated into a second frame unit 1119. Part (a) of FIG. 63 is a schematic perspective view of the photosensitive drum unit U111 having incorporated a drum bearing 1130 and a coupling member 1180, as seen from a driving side. Part (c) of FIG. 63 is a schematic sectional view taken along a plane S111 of the part (a) of FIG. 63. FIG. 64 is a schematic exploded perspective view of the photosensitive drum unit U111.

This embodiment is different from the above-described embodiments in the structure of a cylinder flange 1151. The configurations of the coupling member 180 and the driving side flange 150 of the Embodiment 1 will be taken for instance. As shown in FIG. 62, as contrasted to the driving side flange 150 of the Embodiment 1, it is divided into a cylinder flange 1151 and a gear flange 1150 in this embodiment. In this embodiment, the cylinder flange 1151 and the gear flange 1150 function as a driving side flange (rotational force transmitted member). The coupling member 1180 is provided inside the gear flange 1150.

The photosensitive drum unit U111 of this embodiment comprises a photosensitive drum 10, a non-driving side flange 50 and the cylinder flange 1151, and the 50 and the cylinder flange 1151 are fixed to an end portion of the photosensitive drum 10 by bonding, clamping or the like. The photosensitive drum unit U111 is rotatably supported by the second frame unit 1119. In this embodiment, in the driving side of the photosensitive drum unit U111, the gear flange 1150 engaged with the cylinder flange 1151 is rotatably supported by the drum bearing 1130. The non-driving side of the photosensitive drum unit U111 is rotatably supported by a drum shaft 54 similarly to the embodiment 1.

As shown in FIGS. 63 and 64, an outer periphery engaging portion 1150*a* of the gear flange 1150 and an inner surface engaging portion 1151*a* of the cylinder flange 1151 are engaged with each other, so that the gear flange 1150 and the cylinder flange 1151 are positioned co-axially with each other. At this time, a groove portion 1150*b* of the gear flange 1150 and a rib 1151*b* of the cylinder flange 1151 are engaged with each other, so that a rotational force can be transmitted from the gear flange 1150 to the cylinder flange 1151. The coupling member 1180 is provided inside of the gear flange 1150 is guided so as to be movable to the direction of the axis L111 of the gear flange 1150 and so that an axis L112 of the coupling member 1180 is inclinable relative to the axis L111. As to the structure for guiding the coupling member 1180 by the gear flange 1150, the structure of urging the coupling member 1180 toward the driving side by an urging member 1170, and the structure for transmitting the rotational force from the coupling member 1180 to the gear flange 1150 through a drive pin 1190.

With such a structure, in this embodiment, the rotational force received from the main assembly A of the apparatus is transmitted to the photosensitive drum 10 through the coupling member 1180, the drive pin 1190, the gear flange 1150 and the cylinder flange 1151.

As described in the foregoing, according to Embodiment 1, the covering member 160 is fixed to the driving side flange 150 by bonding, welding or the like, but according to the structure of this embodiment, no fixing step by the bonding or the welding is required, so that the assembling steps can be simplified. In addition, the gear flange 1150, the coupling member 1180 and the urging member 1170 can be dismounting easily, and therefore, these parts can be easily reused.

In this embodiment, the configurations of the driving side flange 150 of the coupling member 180 of Embodiment 1 are used. However, the structure of this embodiment can be applied, with the similar effects, to the configurations of the coupling member 280 and/or the driving side flange 250 of embodiment 2.

(Embodiment 12)

Figure 65:
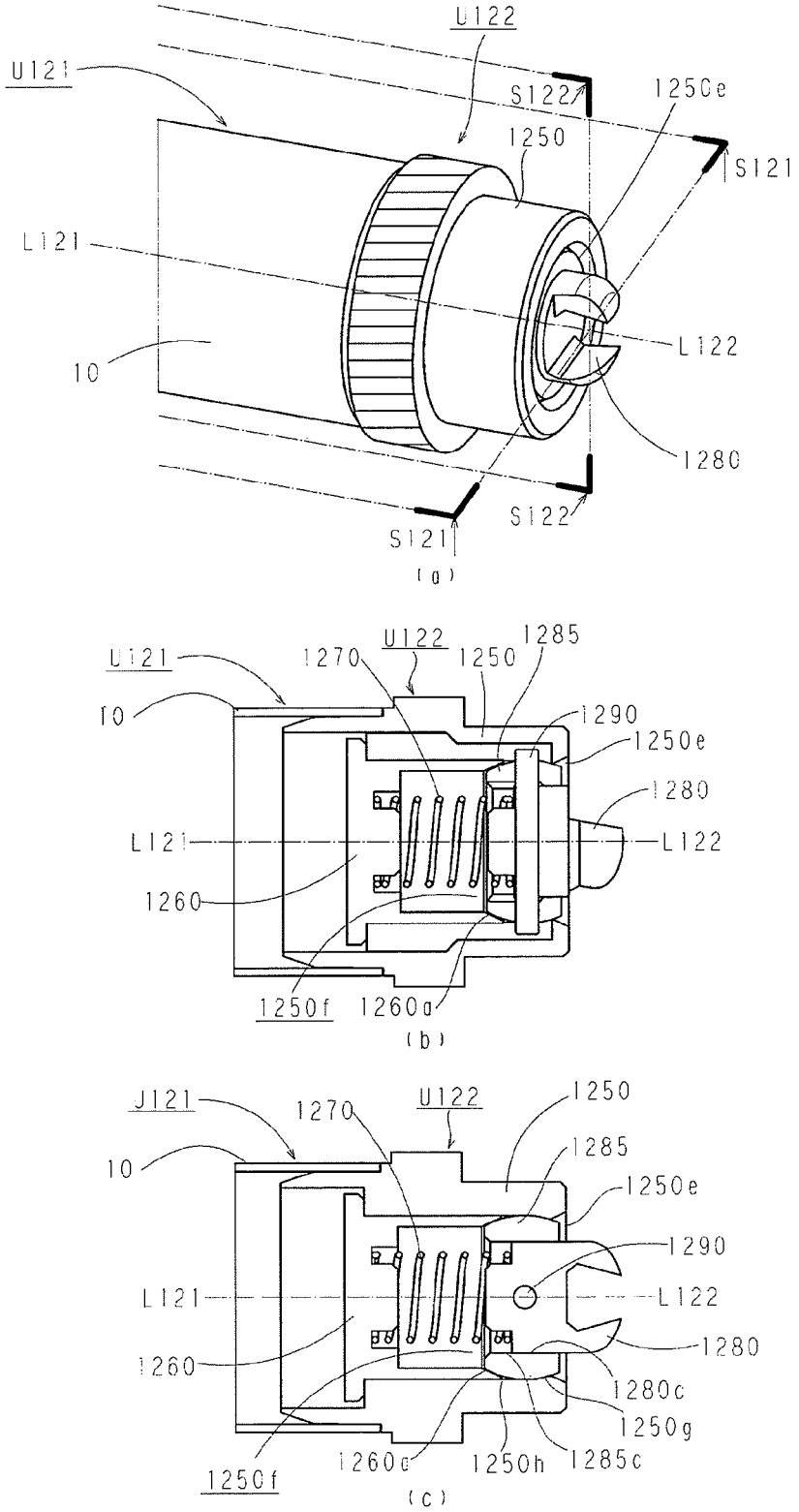
FIG. 65 is a schematic perspective view and a schematic sectional view of the photosensitive drum unit according to one embodiment of the present invention.
Figure 66:
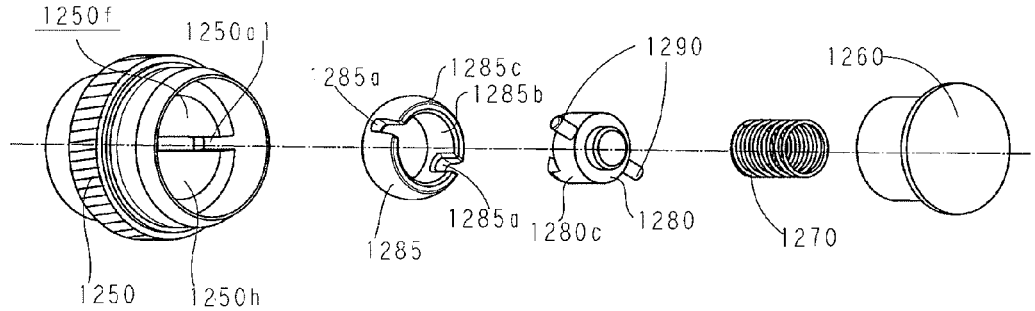
FIG. 66 is an exploded schematic perspective view of a driving side flange unit according to one embodiment of the present invention.
Figure 66:
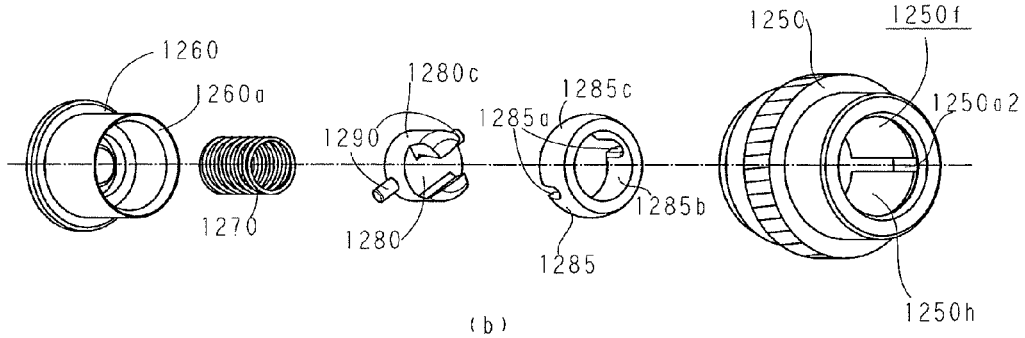

Referring to FIGS. 65 and 66, a twelfth embodiment of the present invention will be described. Part (a) of FIG. 65 is a schematic perspective view of the photosensitive drum unit U121 having incorporated the coupling member 1280, as seen from a driving side. Part (b) of FIG. 65 is a schematic sectional view taken along a plane S121 of the part (a) of FIG. 65. Part (c) of FIG. 65 is a schematic sectional view taken along a plane 5122 of the part (a) of FIG. 65. FIG. 12 is an exploded schematic perspective view of the driving side flange unit U122.

As shown in FIGS. 65 and 66, the driving side flange unit U122 of this embodiment comprises a driving side flange (rotational force transmitted member) 1250, a coupling member 1280, a drive pin 1290, an intermediary guiding member 1285, an urging member 1270, a covering member 1260.

The coupling member 1280 comprises a columnar portion-to-be-guided 1280*c*, and projected portions 1280*a* and 1280*b* for receiving a rotational force a main assembly of the apparatus. A drive pin 1290 is press-fitted into the coupling member 1280. On the other hand, the intermediary guiding member 1285 comprises a portion-to-be-guided 1285*c* in the form of a part of a spherical shape, and a guide portion 1285*b* including an inner surface of a hollow cylindrical shape. The portion-to-be-guided 1280*c* of the coupling member 1280 is guided by a guide portion 1285*c*, so that the coupling member 1280 is movable in a direction of an axis L122 of the intermediary guiding member 1285. At this time, the drive pin 1290 is engaged with a groove portion 1285*a* of the intermediary guiding member 1285, and the drive pin 1290 contacts the end surface of the groove portion 1285*a*. By doing so, a movement range of the coupling member 1280 in the direction of the axis L122 is limited.

Similarly to the Embodiment 1, a driving side flange 1250 comprises an inner wall 1250*h* of the hollow cylindrical shape, and rotational force transmitted portions 1250*a*1, 1250*a*2. A space portion 1250*f* defined by the inner wall 1250*h*, the intermediary guiding member 1285, the coupling member 1280 and the urging member 1270 are provided. By coupling the covering member 1260 with the driving side flange 1250, the intermediary guiding member 1285, the coupling member 1280 and the urging member 1270 are held inside of the driving side flange 1250. The covering member 1260 is connected with the driving side flange 1250 by bonding, welding or the like.

Here, the inner wall 1250*h* of the driving side flange 1250, the contact portion 1250 *g* and the contact portion 1260*a* of the covering member 1260 guide the portion-to-be-guided 1285*c* of the guiding member 1285. Therefore, the axis L122 of the intermediary guiding member 1285 is inclinable in any direction relative to the axis L121 of the driving side flange 1250. By the contact portion 1250 *g* of the driving side flange 1250 and the contact portion 1260*a* of the covering member 1260, the movement of the intermediary guiding member 1285 in the direction of the axis L121 is limited. The contact portion 1250 *g* and the contact portion 1260*a* are provided with a fine clearance relative to the intermediary guiding member 1285 so as not to disturb inclination of the intermediary guiding member 1285.

The coupling member 1280 is urged by the urging member 1270 in the direction of projecting through an opening 1250*e* of the driving side flange 1250. At this time, the drive pin 1290 contacts an end surface of the groove portion 1285*a* of the intermediary guiding member 1285, and the intermediary guiding member 1285 contacts to the contact portion 1250 *g* of the driving side flange 1250. By doing so, the position of the coupling member 1280 in the direction of the axis L122 is determined. In addition, the drive pin 1290 engages with the rotational force transmitted portions 1250*a*1, 1250*a*2 of the driving side flange 1250 to transmit the rotational force to the driving side flange 1250.

As to the structure for fixing the driving side flange unit U122 to end portion of the photosensitive drum 10, and the structure for rotatably supporting the photosensitive drum unit U122 on the second frame unit, the description in the above-described embodiments applies, and therefore, the description thereof is omitted.

As described in the foregoing, with such a structure of this embodiment, the axis L122 of the intermediary guiding member 1285 is inclinable in any directions relative to the axis L121 of the driving side flange 1250. The coupling member 1280 is movable along the axis L122 of the intermediary guiding member 1285. Therefore, in the inside of the driving side flange 1250, the coupling member 1280 is inclinable in any direction relative to the axis L121 of the driving side flange 1250 and translatable along the axis L121 of the driving side flange 1250. In other words, the portion-to-be-guided (portion-to-be-supported) 1280*c* of the coupling member 1280 is held indirectly by a holding portion of the driving side flange 1250. By this, the coupling member 1280 can move to the inside of the driving side flange 1250 with the mounting operation and the dismounting operation of the cartridge. In addition, the engagement and the disengagement relative to the main assembly side engaging portion are smooth, the similar effect as Embodiment 1 can be provided.

In this embodiment, the configurations of the driving side flange 150 of the coupling member 180 of Embodiment 1 are used. However, the structure of this embodiment can be applied, with the similar effects, to the configurations of the coupling member 280 and/or the driving side flange 250 of embodiment 2.

(Embodiment 13)

Figure 67:
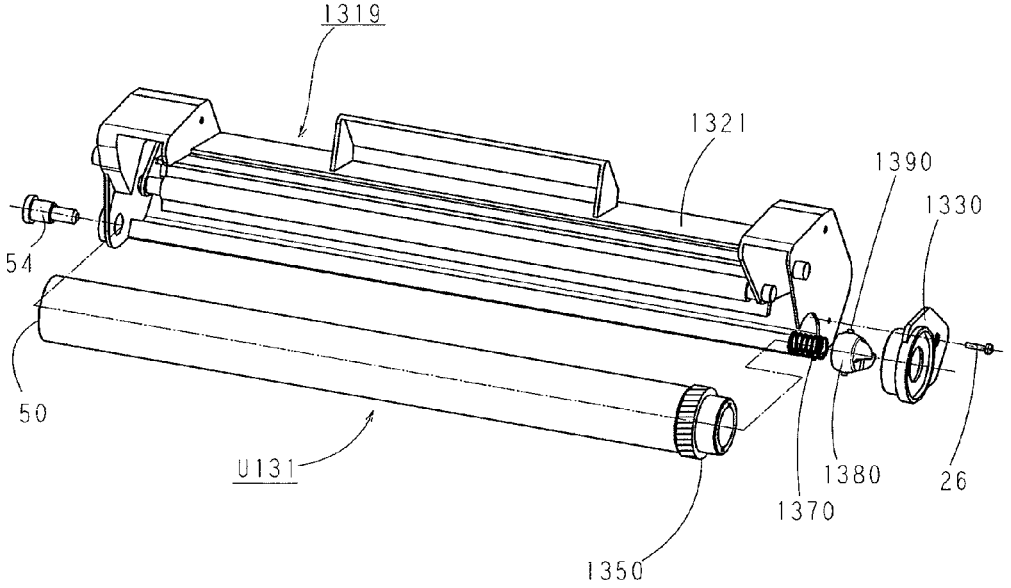
FIG. 67 is a schematic perspective view showing mounting of the photosensitive drum unit to second frame unit according to one embodiment of the present invention.
Figure 68:
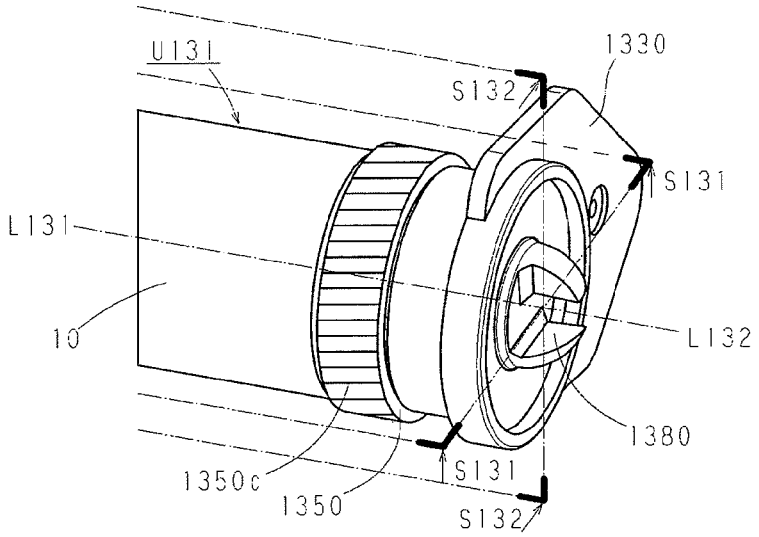
FIG. 68 is a schematic perspective view and a schematic sectional view of the photosensitive drum unit and a drum shaft reception according to one embodiment of the present invention.
Figure 68:
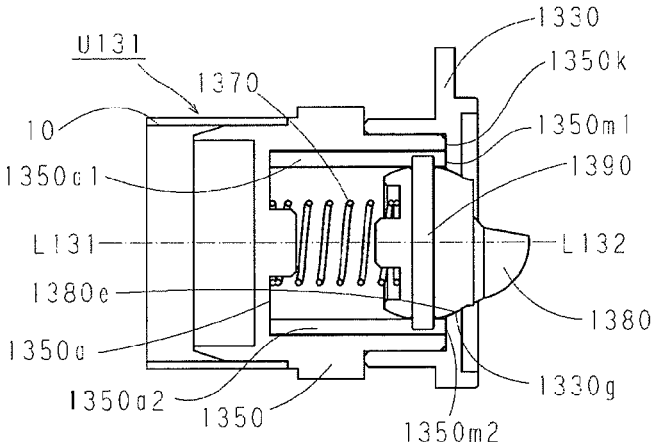
Figure 68:
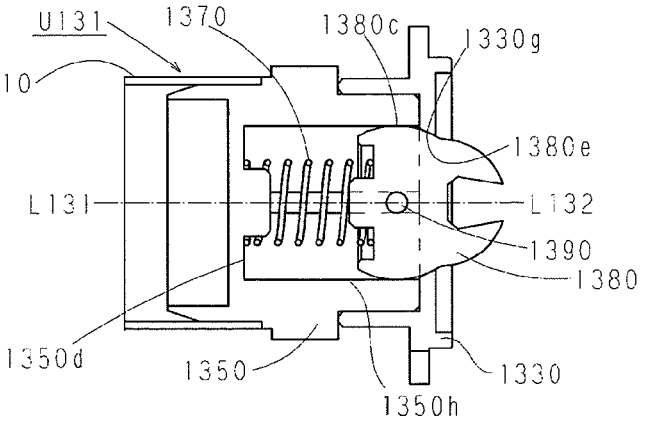
Figure 69:
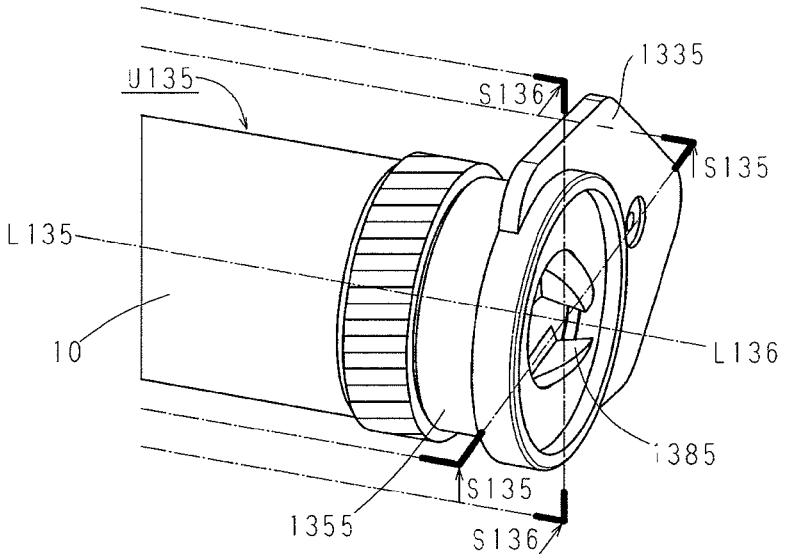
FIG. 69 is a schematic perspective view and a schematic sectional view of the photosensitive drum unit and a drum shaft reception according to one embodiment of the present invention.
Figure 69:
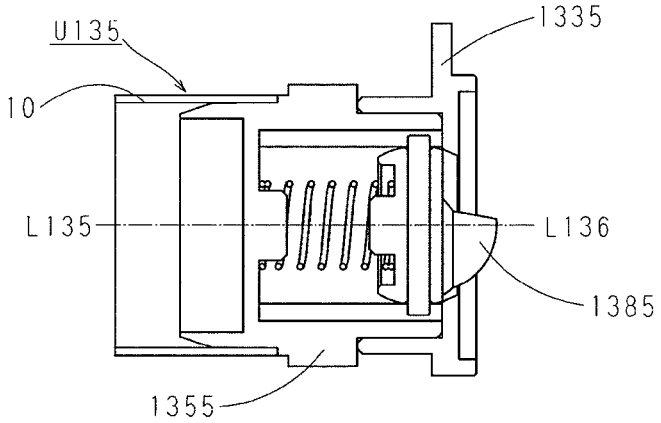
Figure 69:
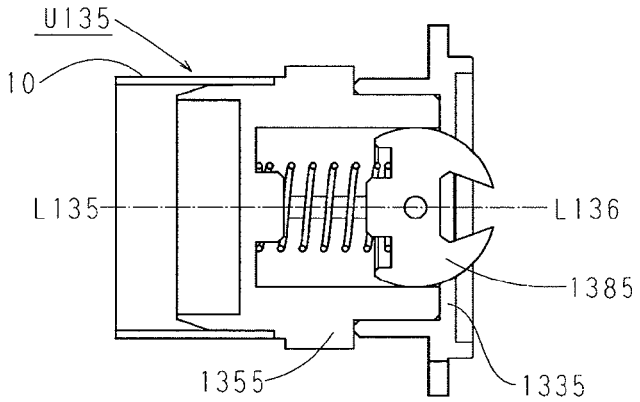

Referring to FIG. 67 to FIG. 69, a thirteenth embodiment of the present invention will be described. FIG. 67 is an illustration showing a state in which a photosensitive drum unit U131 is incorporated into a second frame unit 1319. Part (a) of FIG. 68 is a schematic perspective view of the photosensitive drum unit U131 having incorporated a coupling member 1380 and a drum bearing 1330, as seen from a driving side. Part (b) of FIG. 68 is a schematic sectional view taken along a plane S131 of the part (a) of FIG. 68, part (c) of FIG. 68 is a schematic sectional view taken along a plane S132 of part (a) of FIG. 68. Part (a) of FIG. 69 is a schematic perspective view of the photosensitive drum unit U135 having incorporated a drum bearing 1335 and a coupling member 1385, as seen from a driving side. Part (b) of FIG. 69 is a schematic sectional view taken along a plane S135 of the part (a) of FIG. 69, part (c) of FIG. 69 is a schematic sectional view taken along a plane S136 of part (a) of FIG. 69.

This embodiment is different from Embodiment 1 in the structure for the positioning (retention) of the coupling member 1380.

As shown in FIG. 67, the photosensitive drum unit U131 comprises a photosensitive drum 10, a non-driving side flange 50, a driving side flange (rotational force transmitted member) 1350. The non-driving side flange 50 and the driving side flange 1350 are fixed to the respective end portions of the photosensitive drum 10 by bonding, clamping or the like. Similarly to the above-described embodiments, the driving side flange 1350 is supported rotatably by the drum bearing 1330 in the driving side of the photosensitive drum unit U131. Then, in the non-driving side of the photosensitive drum unit U131, the non-driving side flange 50 is supported rotatably by a drum shaft 54.

In addition, as shown in FIG. 68, in the driving side flange 1350, end portions 1350*m*1, 1350*m*2 of a groove of the groove portions (rotational transmitted receiving portions) 1350*a*1, 1350*a*2 accommodating opposite ends of a drive pin 1390 is cut away, and the groove portions (rotational force transmitted portions) 1350*a*1, 1350*a*2 extend to end portion 1350*k* of the opening.

Then, the description will be made as to a structure for mounting a part such as the coupling member 1380 to the photosensitive drum unit U131. First, the photosensitive drum unit U131 is mounted to the second frame unit 1319. Then, the urging member 1370 and the coupling member 1380 are incorporated into the driving side flange 1350, in the order named. Finally, the drum bearing 1330 is mounted to a second frame unit.

Then, the description will be made as to the structure guiding the coupling member 1380 inclinably and translatably. As shown in parts (b) and (c) of FIG. 68 the driving side flange 1350 has an inner wall 1350*h*, similarly to the foregoing embodiments, and a hollow cylindrical shape is formed by the inner wall 1350*h*. And, the coupling member 1380 and the urging member 1370 are provided inside the cylindrical shape. In addition, by the contact between a portion-to-be-contacted 1380*e* of the coupling member 1380 and a contact portion 1330 *g* of the drum bearing 1330, the coupling member 1380 is prevented from disengaging from the second frame unit 1319. Similarly to the above-described embodiments, the portion-to-be-contacted 1380*e* is a part of a spherical surface constituting the portion-to-be-guided 1380*c*. Furthermore, the contact portion 1330 *g* has a conical shape having a center axis substantially coaxial with an axis L131 of the driving side flange 1350. Therefore, by the spherical surface of the portion-to-be-contacted 1380*e* contacting to the conical surface of the contact portion 1350 *g* the center of the sphere of the portion-to-be-guided 1380*c* is kept substantially on the axis L131.

On the other hand, in the side opposite from the drum bearing 1330, the urging member 1370 is mounted on a mounting portion 1350*d* of the driving side flange 1350.

With such a structure, the coupling member 1380 is positioned (retained) by the drum bearing 1330. In addition, the coupling member 1380 is guided by and inner wall 1350*h* of the driving side flange 1350 and the contact portion 1330 *g* of the drum bearing 1330 so as to be movable along the axis L131, and such that an axis L132 of the coupling member 1380 is inclinable relative to the axis L131.

As described in the foregoing, with the structure of this embodiment, it is unnecessary to fix the covering member 160 to the driving side flange 150 by bonding or welding or the like as in Embodiment 1, so that the assembling step can be simplified. In addition, by dismounting the drum bearing 1330, the coupling member 1380 and/or the urging member 1370 can be dismounted from the photosensitive drum unit U131, and therefore, reuse of the such parts are made easier.

In this embodiment, the configuration of the coupling member 180 or the like of Embodiment 1 is used, but the configuration of the coupling member 280 or the like of Embodiment 2 may be used. Then, as shown in FIG. 69, the coupling member 1385 is positioned (retained) by the drum bearing 1335. The coupling member 1385 may be guided by the driving side flange 1350 and the drum bearing 1335 so as to be movable along the axis L135 of the driving side flange the rotational force transmitted member) 1355, and so that the axis L136 of the coupling member 1380 is inclinable relative to the axis L135. In this case, the same effects can be provided.

(Embodiment 14)

Figure 70:
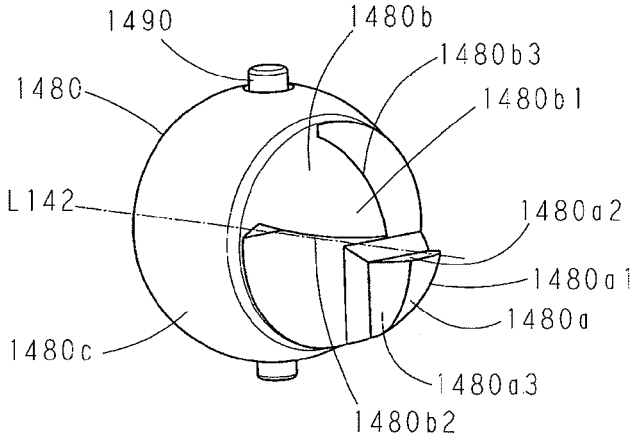
FIG. 70 is an illustration of the coupling member according to one embodiment of the present invention.
Figure 70:
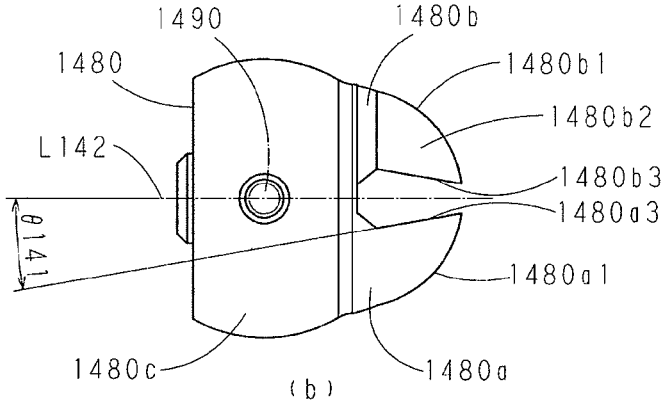
Figure 70:
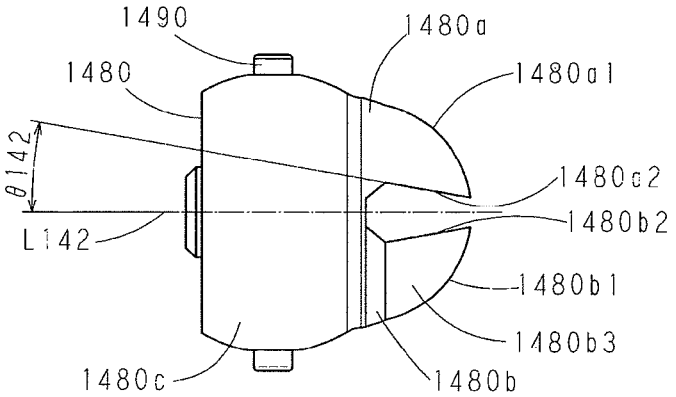
Figure 71:
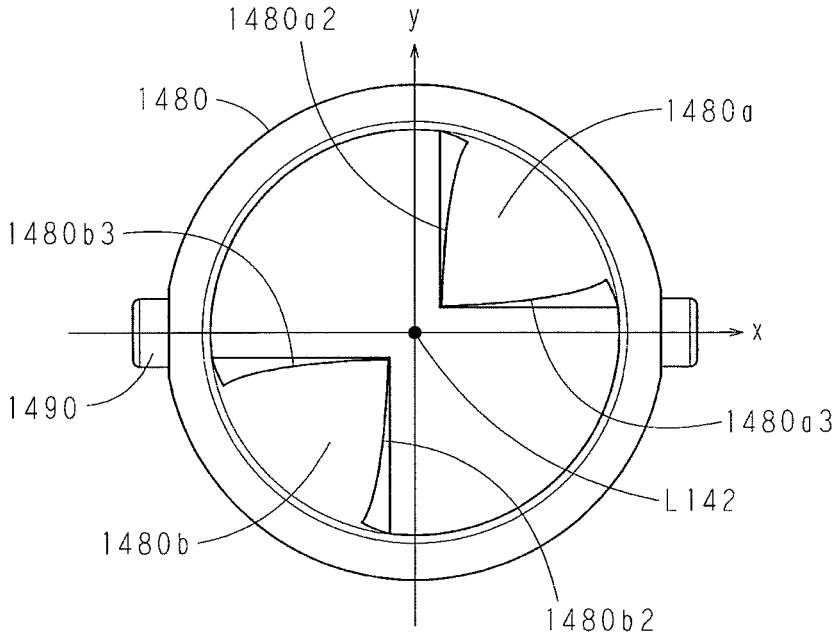
FIG. 71 is an illustration of the coupling member according to one embodiment of the present invention.
Figure 72:
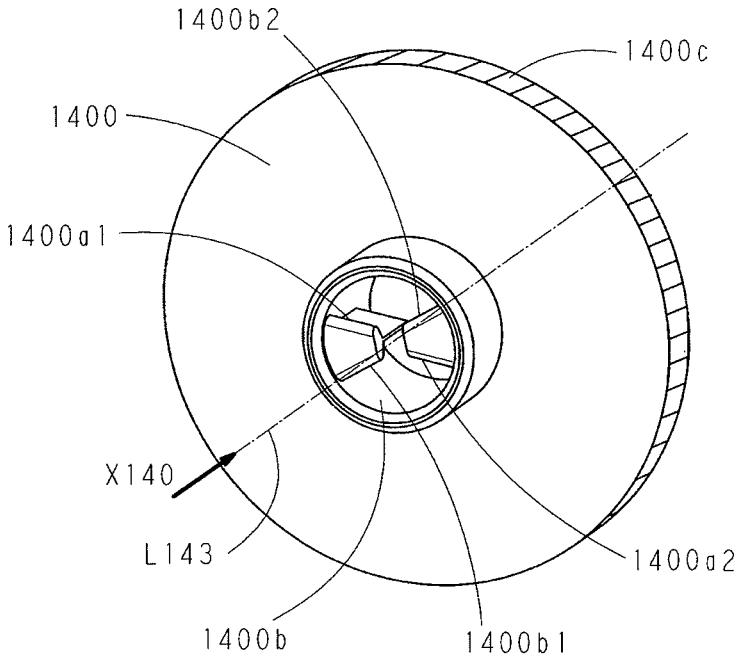
FIG. 72 is an illustration of the main assembly side engaging portion according to one embodiment of the present invention.
Figure 72:
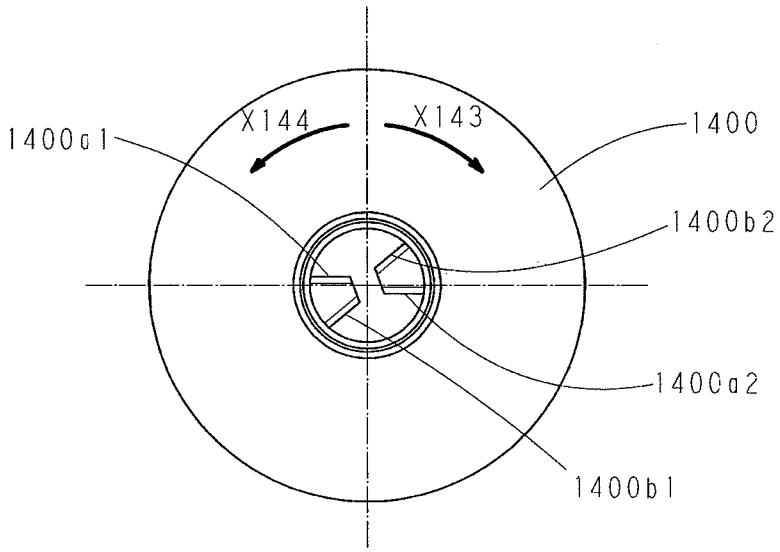
Figure 73:
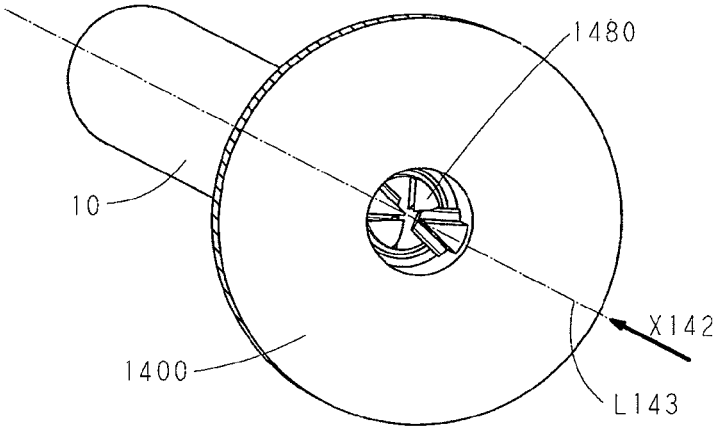
FIG. 73 is an illustration showing a state in which the coupling member is engaged with the main assembly side engaging portion, according to one embodiment of the present invention.
Figure 73:
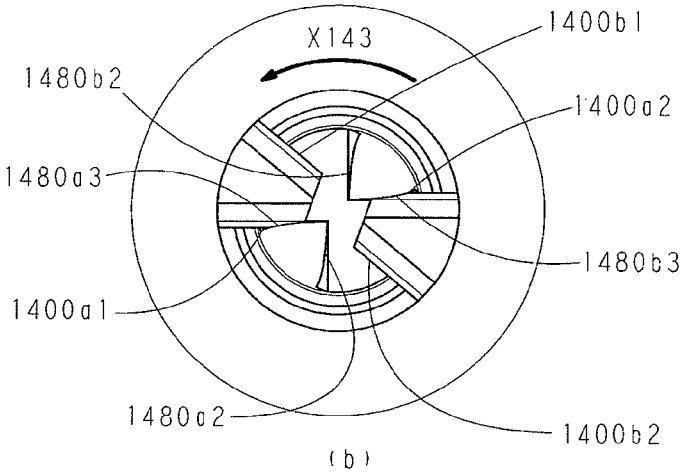
Figure 73:
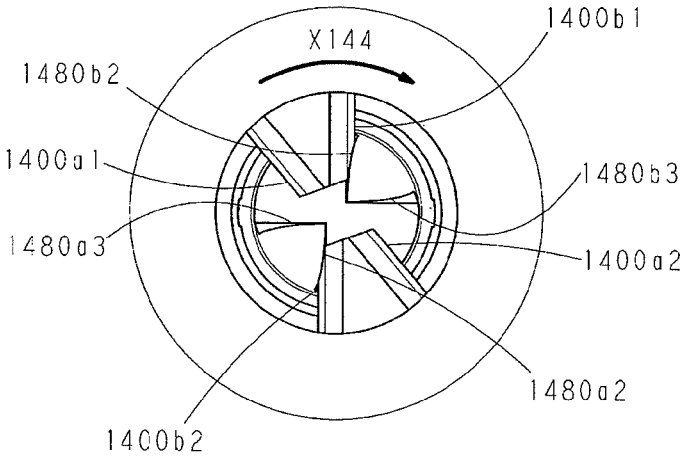
Figure 74:
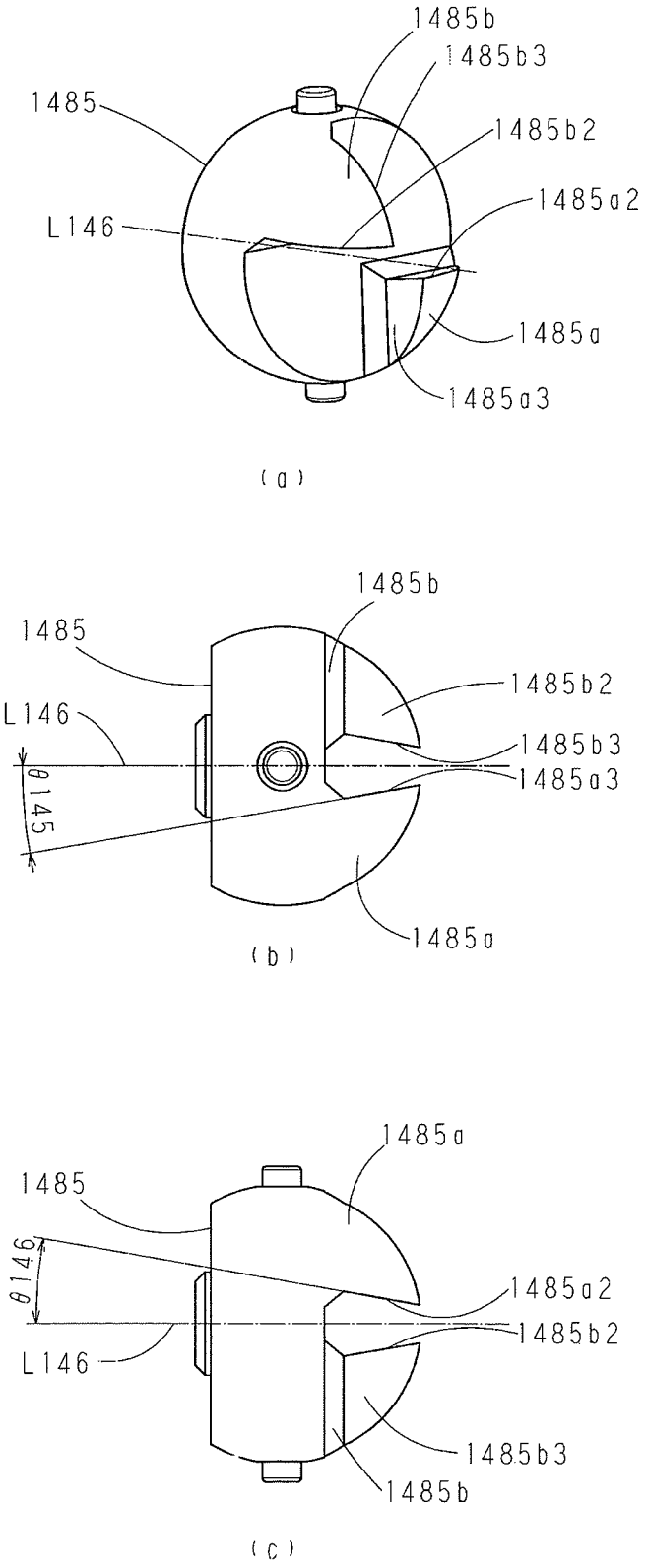
FIG. 74 is an illustration of the coupling member according to one embodiment of the present invention.

Referring to FIG. 70 to FIG. 74, a fourteenth embodiment of the present invention will be described. FIGS. 70 and 71 are illustrations of a coupling member 1480. FIG. 72 is an illustration of a main assembly side engaging portion 1400. FIG. 73 is an illustration showing a state in which the coupling member 1480 is engaged with the main assembly side engaging portion 1400. FIG. 74 is an illustration of a coupling member 1485.

This embodiment is different from Embodiment 1 in the configuration of the other main assembly contact portions 1480*a*2, 1480*b*2 of the coupling member 1480 and the configuration of the rotational force applying portion of the main assembly side engaging portion 1400.

As shown in the part (c) of FIG. 70, the other main assembly contact portion 1480*a*2 of this embodiment is an inclined surface inclined by an angle θ142 relative to the axis L142 of the coupling member 1480. As compared with the angle θ2 (part (b) of FIG. 16) of the other main assembly contact portion 180*a*2 in Embodiment 1, the inclining direction is different. The configuration is such that the inclined surface has an angle similar to the angle θ141 of the rotational force receiving portion 1480*a*3 shown in part (b) of FIG. 70. In addition, the other main assembly contact portion 1480*b*2 also has a configuration similar to the other main assembly contact portion 1480*a*2.

As to the dispositions of the rotational force receiving portions 1480*a*3, 1480*b*3 and the other main assembly contact portions 1480*a*2, 1480*b*2, they are similar to Embodiment 1, the description in the above-described Embodiment 1 applies, and therefore, the description thereof is omitted. It can be properly selected as to whether the other main assembly contact portions 1480*a*2, 1480*b*2 enter the second quadrant and the fourth quadrant, respectively.

Referring to FIG. 72, the main assembly side engaging portion 1400 engageable with the coupling member 1480 of this embodiment will be described.

As shown in parts (a) and (b) of FIG. 72, the main assembly side engaging portion 1400 is provided with first rotational force applying portions 1400*a*1, 1400*a*2 at the circumferentially different positions of an inner wall 1400*b*. The first rotational force applying portions 1400*a*1, 1400*a*2 are disposed at the 180-degrees symmetrical positions about an axis L143 of the main assembly side engaging portion 1400. Similarly, the second rotational force applying portions 1400*b*1, 1400*b*2 are also provided at the circumferentially different positions of the inner wall 1400*b* and are disposed at the 180-degrees symmetrical positions about the axis L143 of the main assembly side engaging portion 1400.

The first rotational force applying portions 1400*a*1, 1400*a*2 and the second rotational force applying portions 1400*b*1, 1400*b*2 functions to transmit a rotational force to the coupling member 1480. Here, the first rotational force applying portions 1400*a*1, 1400*a*2 are to transmit the rotational force in the direction of an arrow X143 shown in part (b) of FIG. 72, and the are to transmit the rotational force in the direction of an arrow X144 shown in part (b) of FIG. 72.

Referring to FIG. 73, a structure for transmitting a rotational force to the coupling member 1480 at main assembly side engaging portion 1400 will be described.

As shown in part (b) of FIG. 73, when the main assembly side engaging portion 1400 rotates in the direction of an arrow X143 about the axis L143, the first rotational force applying portions 1400*a*1, 1400*a*2 of the main assembly side engaging portion 1400 abut, respectively rotational force receiving portions 1480*a*3 1480*b*3, respectively to transmit the rotational force. On the other hand, as shown in part (c) of FIG. 73, when the main assembly side engaging portion 1400 rotates in the direction of the arrow X144 about the axis L143, the second rotational force applying portions 1400*b*1, 1400*b*2 of the main assembly side engaging portion 1400 abut the other main assembly contact portions 1480*b*2 1480*a*2, respectively to transmit the rotational force. That is, the rotational force receiving portions 1480*a*3, 1480*b*3 function as a first rotational force receiving portion, and the other main assembly contact portions 1480*a*2, 1480*b*2 function as a second rotational force receiving portion.

As described in the foregoing, with the structure of this embodiment, the forward rotation and backward rolling can be transmitted.

In this embodiment, the configurations of the coupling member 180 and the main assembly side engaging portion 100 of Embodiment 1 are used, but the coupling member 280 and/or the main assembly side engaging portion 200 of Embodiment 2 may be used. More particularly, as shown in FIG. 74, the rotational force receiving portions 1485*a*3, 1485*b*3 of the coupling member 1485 are inclined surfaces of angle θ145 relative to the axis L146 of the coupling member 1485 to make it function as the first rotational force receiving portion. In addition, other main assembly contact portions 1485*a*2, 1485*b*2 are inclined surfaces of angle θ146 relative to the axis L146 to make it function as the second rotational force receiving portion. In this case, the same effects can be provided.

(Other Embodiments)

Figure 75:
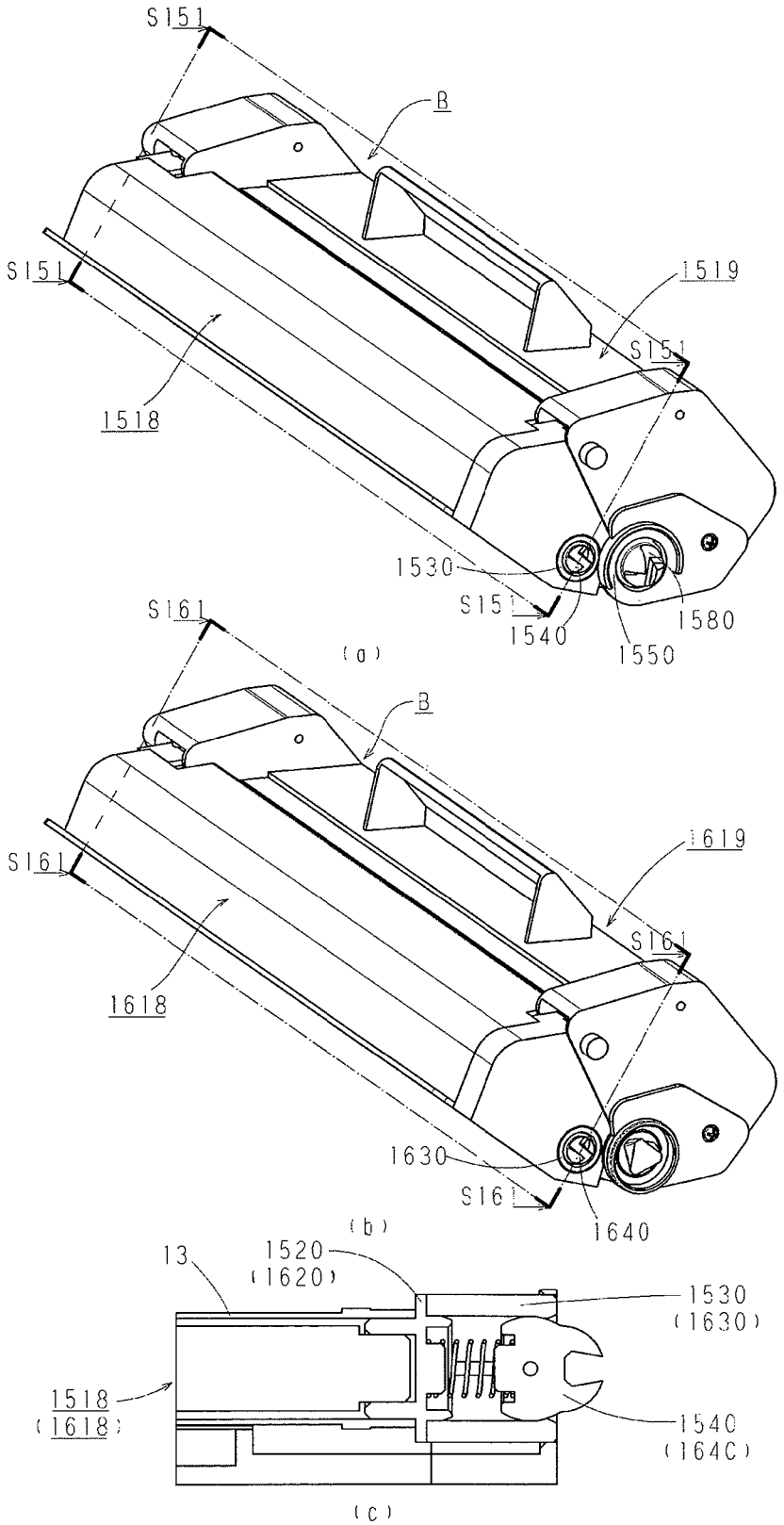
FIG. 75 is a schematic perspective view and a schematic sectional view of the process cartridge according to one embodiment of the present invention.
Figure 76:
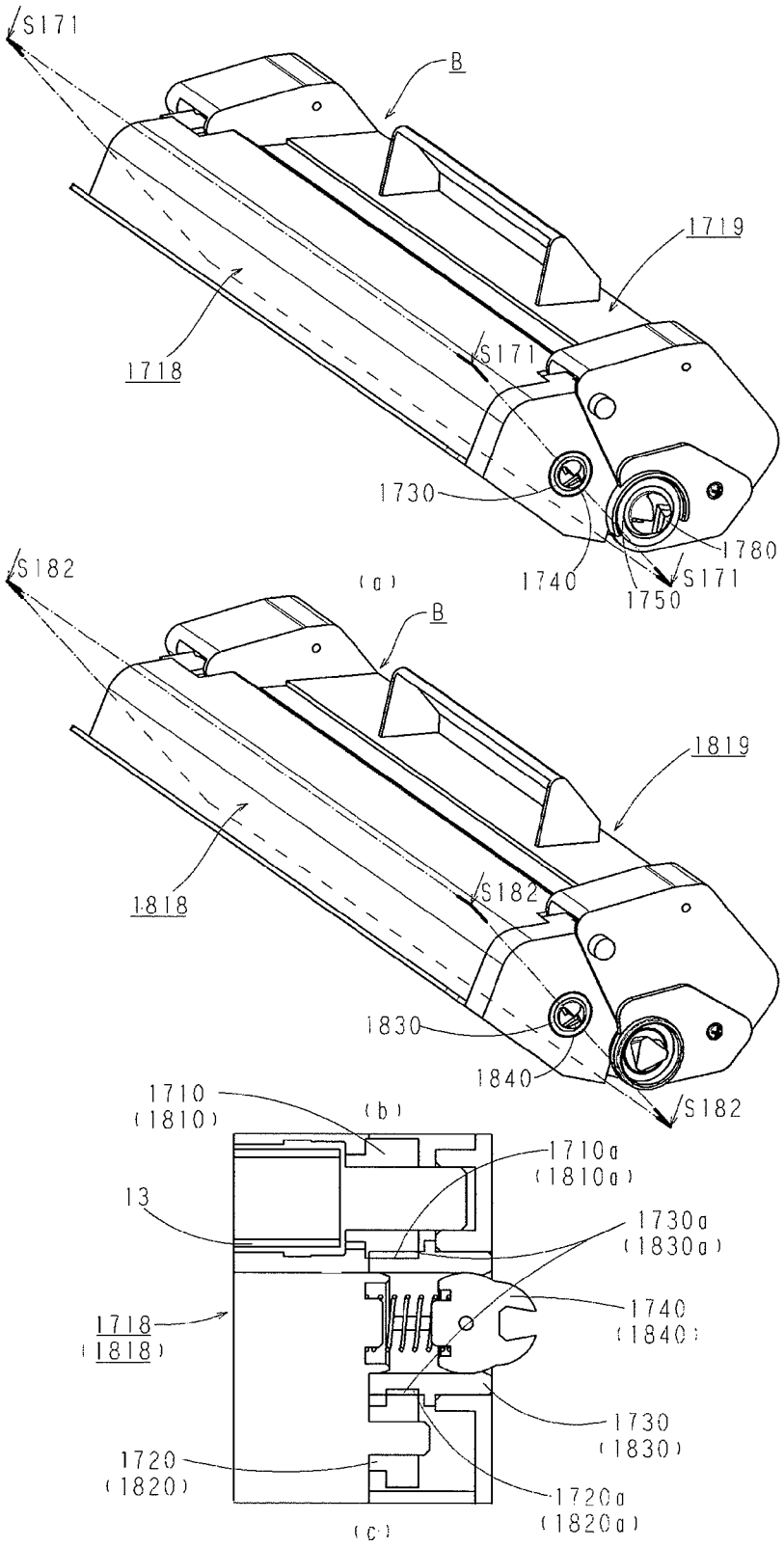
FIG. 76 is a schematic perspective view and a schematic sectional view of the process cartridge according to one embodiment of the present invention.

In the above-described embodiments, the coupling member 180 transmits the rotational force to the photosensitive drum 10 from the main assembly side engaging portion 100. But, this is not inevitable. For example, FIGS. 75 and 76 shows a cartridge B including a photosensitive drum 10 wherein the rotational force is transmitted from the main assembly A of the apparatus to another rotatable member provided in the first frame unit. Parts (a) and (b) of FIG. 75 are schematic perspective views of the cartridge B. Part (c) of FIG. 75 is a sectional view of the first frame units 1518, 1618 taken along a plane S151 of the part (a) of FIG. 75 and a flat surface 5161 of the part (b) of FIG. 75. Parts (a) and (b) of FIG. 76 are schematic perspective views of the cartridge B. In addition, part (c) of FIG. 76 is a schematic sectional view of first frame units 1718, 1818 taken along a plane 5182 of the part (b) of FIG. 76.

As shown in FIG. 75, driving side flanges 1530 and 1630 are provided at the positions co-axial with a rotational axis of a developing roller 13 as a rotatable member carrying a developer provided in a first frame unit 1518 and first frame unit 1618. Coupling members 1540, 1640 may be provided in the driving side flanges 1530, 1630. Here, the driving side flange 1530 (1630) transmits the rotational force to the developing roller 13 through a development flange 1520 (1620) fixed integrally with the developing roller 13. The driving side flange 1530 (1630) may transmit the rotational force to the development flange 1520 (1620) from the driving side flange 1530 (1630) by engaging with the development flange 1520 (1620). In addition, the driving side flange 1530 (1630) and the development flange 1520 (1620) may be connected by bonding, welding or the like to transmit the rotational force the driving side flange 1530 (1630) to the development flange 1520 (1620). The present invention is conveniently applicable to such a structure.

As shown in FIG. 76, the driving side flanges 1730, 1830 are provided at the positions not co-axial with the rotational axis of the developing roller 13 in the first frame unit 1718 and in the first frame unit 1718. The coupling members 1740, 1840 may be provided in said driving side flanges 1730, 1830, respectively (part (c) of FIG. 76). Here, a developing roller gear 1710 (1810) is provided at a longitudinal end portion of the developing roller 13 co-axially with the rotational axis thereof. In addition, the developing roller gear 1710 (1810) rotates integral with the developing roller 13. And, the gear portion 1730*a* (1830*a*) of said driving side flange 1730 (1830) engages with the gear portion 1710*a* (1810*a*) of the developing roller gear 1710 (1810) so that the driving side flange 1730 (1830) transmits the rotational force to the developing roller 13. In the first frame unit 1718 (1818), a rotatable member 1720 (1820) other than the developing roller 13 is provided. And, the gear portion 1730*a* (1830*a*) of the driving side flange 1730 (1830) is engaged with the gear portion 1720*a* (1820*a*) of the rotatable member 1720 (1820) so that the driving side flange 1730 (1830) transmits the rotational force the rotatable member 1720 (1820). The present invention is conveniently applicable to such a structure. Here, the driving side flange 1730 may not transmit the rotational force to the rotatable member 1720 (1820) other than the developing roller 13.

The cartridge B of the above-described embodiments includes the photosensitive drum 10 and the plurality of process means. However, this is not inevitable. As for the types of the cartridge B, the present invention is applicable to a process cartridge or the like including the photosensitive drum 10 and at least one process means. Therefore, in addition to the above-described example of the process cartridges, the present invention is usable with a cartridge integrally including the photosensitive drum 10 and a charging means as the process means. As a further example, the cartridge may integrally include the photosensitive drum 10, charging means and a cleaning means as the process means. As an even further example, the process cartridge may integrally include the photosensitive drum 10, a developing means, the charging means and the cleaning means as the process means.

Figure 77:
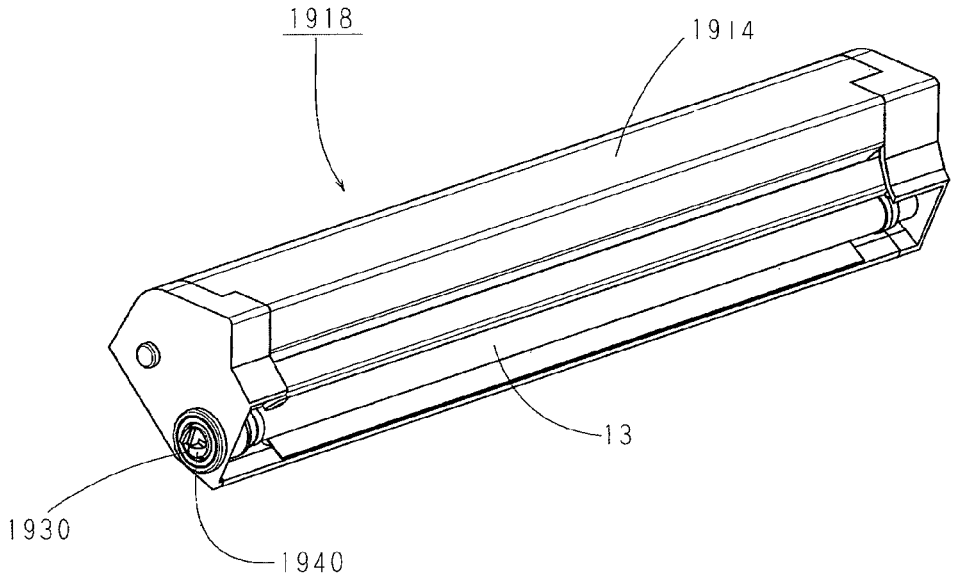
FIG. 77 is a schematic perspective view of a cartridge according to one embodiment of the present invention.
Figure 77:
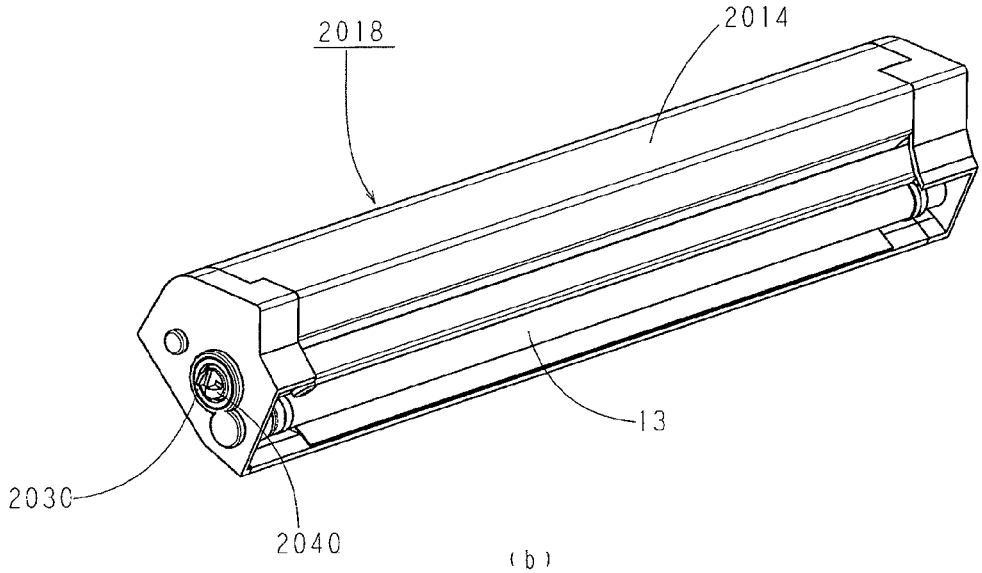

The cartridges B of the above-described embodiments include photosensitive drums 10. But, this is not inevitable. As shown in FIG. 77, for example, the cartridge B may be a cartridge or the like not including a photosensitive drum but including the developing roller 13. In such a case, it can be properly selected whether the driving side flanges 1930, 2030 and the coupling members 1940, 2040 are co-axial with the rotational axis of the developing roller 13 (part (a) of FIG. 77) or it is non-coaxial with the developing roller 13 (part (b) FIG. 77).

The cartridges B of the above-described embodiments are the ones for forming monochromatic images. But, this is not inevitable. The present invention is conveniently applicable to a cartridge, including a plurality of developing means, for forming different color images (two-color image, three-color image or full-color or the like).

A mounting-and-demounting path the cartridge B relative to the main assembly A of the apparatus may be rectilinear or a combination of lines or may include a curve line or lines.

As described in the foregoing, according to the present invention, the process cartridge can be mounted, in the direction substantially perpendicular to the rotational axis of said photosensitive drum, to the main assembly of the apparatus not provided with a mechanism for moving, in the rotational axis direction, the main assembly side engaging portion provided in the main assembly of the electrophotographic image forming apparatus to transmit the rotational force to the photosensitive drum, by an opening and closing operation of the main assembly cover of said main assembly of the apparatus.

In addition, according to the present invention, the process cartridge can be mounted, in the direction substantially perpendicular to the rotational axis of said photosensitive drum, to the main assembly of the apparatus not provided with a mechanism for moving, in the rotational axis direction, the main assembly side engaging portion provided in the main assembly of the electrophotographic image forming apparatus to transmit the rotational force to the photosensitive drum, by an opening and closing operation of the main assembly cover of said main assembly of the apparatus, and the load required for dismounting the process cartridge in the direction substantially perpendicular to the rotational axis of said photosensitive drum can be reduced.

INDUSTRIAL APPLICABILITY

According to the present invention, the process cartridge can be mounted, in the direction substantially perpendicular to the rotational axis of said photosensitive drum, to the main assembly of the apparatus not provided with a mechanism for moving, in the rotational axis direction, the main assembly side engaging portion provided in the main assembly of the electrophotographic image forming apparatus to transmit the rotational force to the photosensitive drum, by an opening and closing operation of the main assembly cover of said main assembly of the apparatus, and the load required for dismounting the process cartridge in the direction substantially perpendicular to the rotational axis of said photosensitive drum can be reduced, and the apparatus can be downsized.

In addition, according to the present invention, the process cartridge can be mounted, in the direction substantially perpendicular to the rotational axis of said photosensitive drum, to the main assembly of the apparatus not provided with a mechanism for moving, in the rotational axis direction, the main assembly side engaging portion provided in the main assembly of the electrophotographic image forming apparatus to transmit the rotational force to the photosensitive drum, by an opening and closing operation of the main assembly cover of said main assembly of the apparatus, and the load required for dismounting the process cartridge in the direction substantially perpendicular to the rotational axis of said photosensitive drum can be reduced, and the apparatus can be downsized, and Furthermore, the rotational force can be transmitted with high accuracy.

The present invention can be applied to a process cartridge, a photosensitive drum unit, a developing unit and an electrophotographic image forming apparatus.

According to the present invention, there is provided a process cartridge, a photosensitive drum unit or a developing unit which can be dismounted, in the direction substantially perpendicular to the rotational axis of the image bearing member, from the main assembly of the apparatus not provided with a mechanism for moving, in the rotational axis direction, the main assembly side engaging portion provided in the main assembly of the electrophotographic image forming apparatus to transmit the rotational force to the image bearing member, by an opening and closing operation of the main assembly cover of the main assembly of the apparatus, without deterioration of the usability performance. In addition, there is provided an electrophotographic image forming apparatus to which the process cartridge, the photosensitive drum unit or the developing unit is detachably mountable.

The invention claimed is:

1. A process cartridge detachably mountable to a main assembly of an electrophotographic image forming apparatus, wherein the main assembly includes a rotatable main assembly side engaging member having a recess and a rotational force applying portion provided in the recess, said process cartridge comprising:

a photosensitive drum having a rotational axis substantially perpendicular to a mounting and demounting direction of said process cartridge;

process means actable on said photosensitive drum;

a cylindrical rotational force transmitted member for receiving a rotational force for rotating said photosensitive drum; and a coupling member held inside said cylindrical rotational force transmitted member and including (i) a rotational force receiving portion for receiving the rotational force from the rotational force applying portion and (ii) a rotational force transmitting portion for transmitting the rotational force to said cylindrical rotational force transmitted member, wherein said coupling member enters the recess of the rotatable main assembly side engaging member in a state that said process cartridge is mounted to the main assembly, and wherein said coupling member is inclinable and translatable relative to a rotational axis of said rotational force transmitted member to disengage from the rotatable main assembly side engaging member when said process cartridge is dismounted from the main assembly.

2. A process cartridge according to claim 1, wherein a translatable amount through which said coupling member is translatable in a direction away from the main assembly side engaging member along the rotational axis of said rotational force transmitted member without inclination relative to a rotational axis of a guiding member from a reference state in which said coupling member receives the rotational force from the main assembly side engaging member is larger than an overlying amount between the main assembly side engaging member and said coupling member in the direction of the rotational axis of said cylindrical rotational force transmitted member in a state that said coupling member receives the rotational force from the main assembly side engaging member.

3. A process cartridge according to claim 1 or 2, wherein said coupling member includes a first projected portion and a second projected portion each of which is provided with a said rotational force receiving portion and which are disposed at the 180-degrees symmetrical positions.

4. A process cartridge according to claim 3, wherein said first projected portion and said second projected portion protrude toward a free end portion in a direction of the rotational axis of said coupling member from portions-to-be-supported held inside said cylindrical rotational force transmitted member.

5. A process cartridge according to claim 3, wherein a gravity center of a cutting plane of said first projected portion or said second projected portion taken along a plane perpendicular to the rotational axis of said coupling member approaches the rotational axis of said coupling member toward the free end portion in the direction of the rotational axis of said coupling member.

6. A process cartridge according to claim 4, wherein said first projected portion and said second projected portion are formed at positions closer to the rotational axis of said coupling member than a most outer diameter position of the portions-to-be-supported held inside said cylindrical rotational force transmitted member in a radial direction of said coupling member.

7. A process cartridge according to claim 3, wherein said coupling member has a connecting portion connecting said first projected portion and said second projected portion with each other.

8. A process cartridge according to claim 3, further comprising a contact portion provided at a position outside said first projected portion and said second projected portion in a radial direction of said coupling member and contactable to an edge of said recess when said coupling member disengages from the rotatable main assembly side engaging member.

9. A process cartridge according to claim 8, wherein said contact portion approaches the rotational axis of said coupling member toward a free end portion of said coupling member in the direction of the rotational axis of said coupling member.

10. A process cartridge according to claim 8, wherein said contact portion has a curved surface.

11. A process cartridge according to claim 10, wherein said contact portion has a portion having a shape of part of a substantially spherical surface.

12. A process cartridge according to claim 1 or 2, wherein said cylindrical rotational force transmitted member positions said coupling member so that when said rotational force receiving portion receives the rotational force from said rotational force applying portion, a clearance is provided between a portion other than said rotational force receiving portion of said coupling member and a portion other than the rotational force applying portion of the rotatable main assembly side engaging member.

13. A process cartridge according to claim 12, wherein the main assembly of the apparatus includes a bearing member rotatably supporting the rotatable main assembly side engaging member, and wherein, when said rotational force receiving portion receives the rotational force from said rotational force applying portion, a contact region between said rotational force receiving portion and the rotational force applying portion is in a contact region between the bearing member and the rotatable main assembly side engaging member.

14. A photosensitive drum unit detachably mountable to a main assembly of an electrophotographic image forming apparatus, wherein the main assembly includes a rotatable main assembly side engaging member having a recess and a rotational force applying portion provided in the recess, said photosensitive drum unit comprising:

a photosensitive drum having a rotational axis substantially perpendicular to a mounting and demounting direction of said photosensitive drum unit;

a cylindrical rotational force transmitted member for receiving a rotational force for rotating said photosensitive drum; and a coupling member held inside said cylindrical rotational force transmitted member and including (i) a rotational force receiving portion for receiving the rotational force from the rotational force applying portion and (ii) a rotational force transmitting portion for transmitting the rotational force to said cylindrical rotational force transmitted member, wherein said coupling member enters the recess of the rotatable main assembly side engaging member in a state that said photosensitive drum unit is mounted to the main assembly, and wherein said coupling member is inclinable and translatable relative to a rotational axis of said rotational force transmitted member to disengage from the rotatable main assembly side engaging member when said photosensitive drum unit is dismounted from the main assembly.

15. A developing unit detachably mountable to a main assembly of an electrophotographic image forming apparatus, wherein the main assembly includes a rotatable main assembly side engaging member having a recess and a rotational force applying portion provided in the recess, said process cartridge comprising:

a developing roller having a rotational axis substantially perpendicular to a mounting and demounting direction of said developing unit;

a cylindrical rotational force transmitted member for receiving a rotational force for rotating said developing roller; and a coupling member held inside said cylindrical rotational force transmitted member and including (i) a rotational force receiving portion for receiving the rotational force from the rotational force applying portion and (ii) a rotational force transmitting portion for transmitting the rotational force to said cylindrical rotational force transmitted member, wherein said coupling member enters the recess of the rotatable main assembly side engaging member in a state that said developing unit is mounted to the main assembly, and wherein said coupling member is inclinable and translatable relative to a rotational axis of said rotational force transmitted member to disengage from the rotatable main assembly side engaging member when said developing unit is dismounted from the main assembly.

16. An electrophotographic image forming apparatus comprising:

a main assembly including a rotatable main assembly side engaging member having a recess and a rotational force applying portion provided in the recess; and a process cartridge including:

a photosensitive drum having a rotational axis substantially perpendicular to a mounting and demounting direction of said process cartridge;

process means actable on said photosensitive drum;

a cylindrical rotational force transmitted member for receiving a rotational force for rotating said photosensitive drum; and a coupling member held inside said rotational force transmitted member and including (i) a rotational force receiving portion for receiving the rotational force from the rotational force applying portion and (ii) a rotational force transmitting portion for transmitting the rotational force to said cylindrical rotational force transmitted member, wherein said coupling member enters the recess of said rotatable main assembly side engaging member in a state that said process cartridge is mounted to said main assembly, and wherein said coupling member is inclinable and translatable relative to a rotational axis of said rotational force transmitted member to disengage from said main assembly side engaging member when said process cartridge is dismounted from said main assembly.

* * * * *